US008574403B2

(12) United States Patent
Hoehsl et al.

(10) Patent No.: US 8,574,403 B2
(45) Date of Patent: Nov. 5, 2013

(54) FABRIC BELT FOR A MACHINE FOR PRODUCING WEB MATERIAL, IN PARTICULAR PAPER OR CARDBOARD

(75) Inventors: Matthias Hoehsl, Heidenheim (DE); Johann Boeck, Fornach (AT)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 13/493,339

(22) Filed: Jun. 11, 2012

(65) Prior Publication Data

US 2012/0291975 A1 Nov. 22, 2012

Related U.S. Application Data

(63) Continuation of application No. PCT/EP2010/066707, filed on Nov. 3, 2010.

(30) Foreign Application Priority Data

Dec. 11, 2009 (DE) ..... 10 2009 054 534

(51) Int. Cl.
*D21F 1/10* (2006.01)
*D03D 11/00* (2006.01)

(52) U.S. Cl.
USPC ..... 162/348; 162/903; 139/383 A

(58) Field of Classification Search
USPC ..... 162/116, 348, 900, 902–904, 358.2; 139/383 A, 425 A, 383 AA, 383 R
See application file for complete search history.

(56) References Cited

U.S. PATENT DOCUMENTS

| | | | | |
|---|---|---|---|---|
| 6,244,306 | B1 * | 6/2001 | Troughton | 139/383 A |
| 6,334,467 | B1 * | 1/2002 | Barrett et al. | 139/383 A |
| 7,571,746 | B2 * | 8/2009 | Hay et al. | 139/383 A |
| 2005/0103397 | A1 * | 5/2005 | Quigley et al. | 139/383 A |
| 2008/0264511 | A1 * | 10/2008 | Boeck | 139/383 A |

FOREIGN PATENT DOCUMENTS

| | | | |
|---|---|---|---|
| DE | 102006008812 | A1 | 8/2007 |
| WO | 2008068317 | A2 | 6/2008 |

OTHER PUBLICATIONS

International Search Report and Written Opinion for PCT/EP2010/066707 dated Feb. 4, 2011. (11 pages).

* cited by examiner

*Primary Examiner* — Eric Hug
(74) *Attorney, Agent, or Firm* — Taylor IP, P.C.

(57) ABSTRACT

A fabric belt for producing a web material, the fabric belt including a first layer on a web material side and a second layer on a machine side of the belt. The layers each having a basic weave connected to each other by binding threads extending in a binding thread direction. The layers having base binding threads extending both in and transverse to the binding thread direction. The binding threads form binding segments which are successive in the binding thread direction in the second layer. The binding threads are tied off on one base binding thread of the second layer extending transversely to the binding thread direction. The binding segments formed in the second layer are arranged in a binding pattern repeat extended in and transverse to the binding thread direction along a binding segment diagonal progressing obliquely to the binding thread direction and transverse to the binding thread direction.

19 Claims, 86 Drawing Sheets

FABRIC BELT FOR A MACHINE FOR PRODUCING WEB MATERIAL, IN PARTICULAR PAPER OR CARDBOARD

CROSS REFERENCE TO RELATED APPLICATIONS

This is a continuation of PCT application No. PCT/EP2010/066707, entitled "FABRIC STRIP FOR A MACHINE FOR PRODUCING WEB MATERIAL, IN PARTICULAR PAPER OR CARTON", filed Nov. 3, 2010, which is incorporated herein by reference.

BACKGROUND OF THE INVENTION

1. Field of the Invention

The current invention relates to a fabric belt for a machine for producing a web material, in particular paper or cardboard.

2. Description of the Related Art

A fabric belt for a machine to produce a web material is known from WO 2008/068317 wherein the two fabric layers composed of the two respective basic weaves are connected with each other by binding threads which are arranged in pairs and are positioned side by side, immediately adjacent to each other. The binding threads of a respective binding thread pair alternate between the two fabric layers at respective changeover points so that they form binding segments in the paper side first fabric layer on the one hand, and in the machine operating or machine side second fabric layer on the other hand. A binding segment of this type extends over at least one basic weave thread of the respective fabric layers extending transversely to the binding thread direction, through which a respective binding thread ties off. Tying-off in this instance is to be understood that the binding thread is routed around that side of a basic weave thread facing away from the respective other fabric layer, thereby tying off this basic weave thread and thereby the entire basic weave onto the respective other fabric layer. Binding thread segments, in particular binding thread segments formed in the first fabric layer which, for example extend over five basic weave threads are known from this documentation, whereby the hereby involved binding thread ties off above the first, third and fifth basic weave thread of a particular binding segment and which however at the intermediary second and fourth basic weave threads is routed at the inside facing the second fabric layer. Thus, the binding threads form the basic weave of the first fabric layer, in this case a plain weave at the location where the binding threads form binding elements so that the two threads of a particular binding thread pair continuing in binding thread direction form an apparent basic weave thread of the first fabric layer.

A comparatively non-uniform pattern of the binding segments in the second fabric layer is superimposed over the very uniform weave design of the first fabric layer which, in this instance is provided by the plain weave formation continuing over the entire first fabric layer. Through avoidance of any uniformity—in other words provision of an arbitrary distribution of the binding segments in the second fabric layer within a binding thread repeat extending in binding thread direction and transversely thereto—it was attempted to reduce as far as possible the marking tendency which can be associated with such binding segments. What is needed in the art is a fabric belt that achieves a reduction in the tendency to work the weft as compared to the prior art.

SUMMARY OF THE INVENTION

It is the objective of the current invention to design a fabric belt for a machine to produce a web material, in particular paper or cardboard, for example a forming fabric in such a way that an additional reduction in the tendency to mark can be achieved.

According to the current invention this objective is met by fabric belt for a machine to produce web material, in particular paper or cardboard comprising a first fabric layer on the web material side and a second fabric layer on the machine side, wherein the first fabric layer and the second fabric layer each have a basic weave connected to each other by binding threads extending in a binding thread direction, having base binding threads extending in the binding thread direction and transversely to the binding thread direction, wherein the binding threads form binding segments which are successive in the binding thread direction in the second fabric layer and in which the binding threads are tied off on at least one base binding thread of the second fabric layer extending transversely to the binding thread direction, wherein the binding segments formed in the second layer are arranged in a binding pattern repeat extended in the binding thread direction and transverse to the binding thread direction along at least one binding segment diagonal progressing obliquely to the binding thread direction and transverse to the binding thread direction.

Based on the design of a fabric belt known from WO 2008/068317 it has become known that in arranging of the binding segments which are located in the second or respectively the operating—or machine side fabric layer in an as arbitrary as possible manner a cluster formation occurs—in other words a local accumulation of binding segments in which the binding segment density is clearly greater than in other regions. This uncontrolled cluster formation leads to an unexpected strong marking tendency which, based on the arbitrary distribution of the binding segments was not expected to occur to the same extent.

The current invention counters this problem in that a departure is made from a completely arbitrary distribution of the binding segments located in the second fabric layer by changing over to a greater uniformity in that the binding segments, or essentially all binding segments within a particular binding thread repeat are arranged obliquely along the binding thread direction or transverse to the binding thread direction, in other words along diagonally progressing binding segment diagonals. In general several virtual lines along which the binding segments are clustered occur hereby in a particular binding thread repeat, so that nevertheless a certain local accumulation occurs, which however, is provided through an alignment along particular diagonals, with a certain organization and thereby uniformity. It was shown that hereby a clearly reduced marking tendency was achieved.

With the fabric belt according to the invention adjacently located binding threads can form a binding thread pair, whereby preferably the binding threads of a binding thread pair are located immediately adjacent to each other.

In an alternative configuration it is possible that between the binding threads of a binding thread pair at least one basic weave thread of the second fabric layer extending in binding thread direction and/or at least one basic weave thread of the first fabric layer extending in binding thread direction is arranged. Especially if the fabric belt is designed having two fabric layers, these can be firmly connected with each other by the binding threads, so that the binding threads of the first fabric layer form successive binding segments in a binding thread direction, wherein the binding threads are tied off on at least one basic weave thread of the first fabric layer extending transversely to the binding thread direction.

In order to provide the possibility through the binding threads to continue the basic weave pattern created by the basic weave threads in the first fabric layer, to be able to provide a stable cohesion between the fabric layers, at the same time however to be able to provide a certain uniformity for the first fabric layer it is further suggested that the binding threads of a particular binding thread pair cross each other at changeover points and that one of the binding threads, in order to form a binding segment in the first fabric layer, crosses into same and that the changeover points are arranged along a plurality of changeover point diagonals. The changeover point diagonals can hereby progress parallel to the binding segment diagonals, whereby based on the fact that at the location where binding segments are formed in the second fabric layer no changeover points can be present it is ensured that diagonals overlapping each other cannot occur.

An alternative variation provides that the changeover point diagonals extend at an angle relative to the binding segment diagonals.

In order to interrupt the uniform pattern which was created by arranging the changeover points along changeover point diagonals in certain regions and to achieve an improved marking characteristic through insignificant non-uniformities it is suggested that the changeover point diagonals include at least one changeover point diagonal of a first kind with uninterrupted stringing together of changeover points and at least one changeover point diagonal of a second kind with interrupted stringing together of changeover points due to changeover point offsets.

Non-uniformity overlapping a uniform pattern can also be provided with the different types of changeover point diagonals in that the changeover point diagonals of the first type and the changeover point diagonals of the second type alternate in a uniform pattern.

Provision can further be made that the changeover point offset points are arranged in a uniform pattern.

It can further be provided that in the first fabric layer binding segments of a binding thread of a binding thread pair and binding segments of the other binding thread of the same binding thread pair follow consecutively alternating in the binding thread direction.

A further reduction in marking tendency can be achieved in that a number ratio of binding segments in the first fabric layer, relative to binding segments in the second fabric layer, is greater than 1. By providing a lower number of binding segments in the second fabric layer it becomes possible to leave a comparatively large space between the individual binding segment diagonals.

It is further suggested that a number ratio of basic weave threads of the first fabric layer extending transversely to the binding thread direction and basic weave threads of the second fabric layer is greater than 1. By providing such a ratio it becomes possible to superimpose an aspect of non-uniformity in the second fabric layer over the comparatively high uniformity in the first fabric layer, resulting in an accordingly reduced marking tendency.

The pattern of integration of the binding threads into the second fabric layer can, for example, be such that in at least one binding segment diagonal essentially all consecutive binding segments are binding segments of the same type and/or are formed by binding threads of the same type. The binding segments of the same type are fundamentally characterized in that the manner and means in which a particular binding thread ties off with basic weave threads of the second fabric layer is the same—which can relate to the progression of a particular binding thread, as well as also the number of the involved basic weave threads of the second fabric layer. Binding threads of the same type distinguish themselves in that, in regard to basic weaves of the various fabric layers with which they form binding segments feature the same progression, in other words the same sequence of tie-off points which, however may be offset relative to each other in a longitudinal binding thread direction. Binding threads of a different type distinguish themselves in that, regardless of the fact that they may be offset in the longitudinal binding thread direction with their particular integration pattern into the fabric layers, they have varying integration patterns.

It is further provided that in at least one binding segment diagonal, binding segments of a different type and/or binding segments formed by binding threads of a different type follow each other, whereby preferably the binding segments of a different type and/or the binding segments formed by binding threads of a different type contained in at least one binding segment diagonal alternate with each other in a uniform pattern. In this manner an aspect of unevenness is provided on the one hand in the uniformity provided by the binding segment diagonals in that binding segments of a different type, or different binding threads, follow each other which, however then contribute again to a certain homogenizing due to the even pattern of the reciprocal alternating.

In order to achieve a certain break in the uniform pattern in regard to the aspect of uniformity provided by the binding segment diagonals, it is further suggested that in one binding thread repeat several binding segment diagonals are provided with a varying distribution relative to each other and/or a different type of binding segments and/or binding segments formed by threads of a different type.

In one advantageous variation based on an as simple as possible design, in regard to the weave pattern, it is further suggested that in one binding thread repeat, the number of binding thread pairs with a different progression relative to each other of the binding threads forming the pairs is smaller than the number of binding thread pairs present in one binding thread repeat. Here too, the binding threads with different progressions distinguish themselves in that in regard to the basic weaves or fabric layers, with which they form binding segments, they display a different succession of tie-off points and are not only offset in longitudinal binding thread direction, but basically then display the same succession of tie-off points or the same pattern of integration into the basic weaves.

In order to be able to provide a very high uniformity of the weave structure, in particular in the first fabric layer, it is suggested that the binding threads of a binding thread pair in the first fabric layer form an apparent basic weave thread of the first fabric layer to continue the weave of the first fabric layer.

It may further be provided that a repeat length of the binding threads in binding thread direction is greater than a repeat length of the basic weave of the first fabric layer and/or the second fabric layer in the binding thread direction.

The invention also relates to a machine to produce web material, in particular paper or cardboard which uses at least one inventively designed fabric belt.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1A:
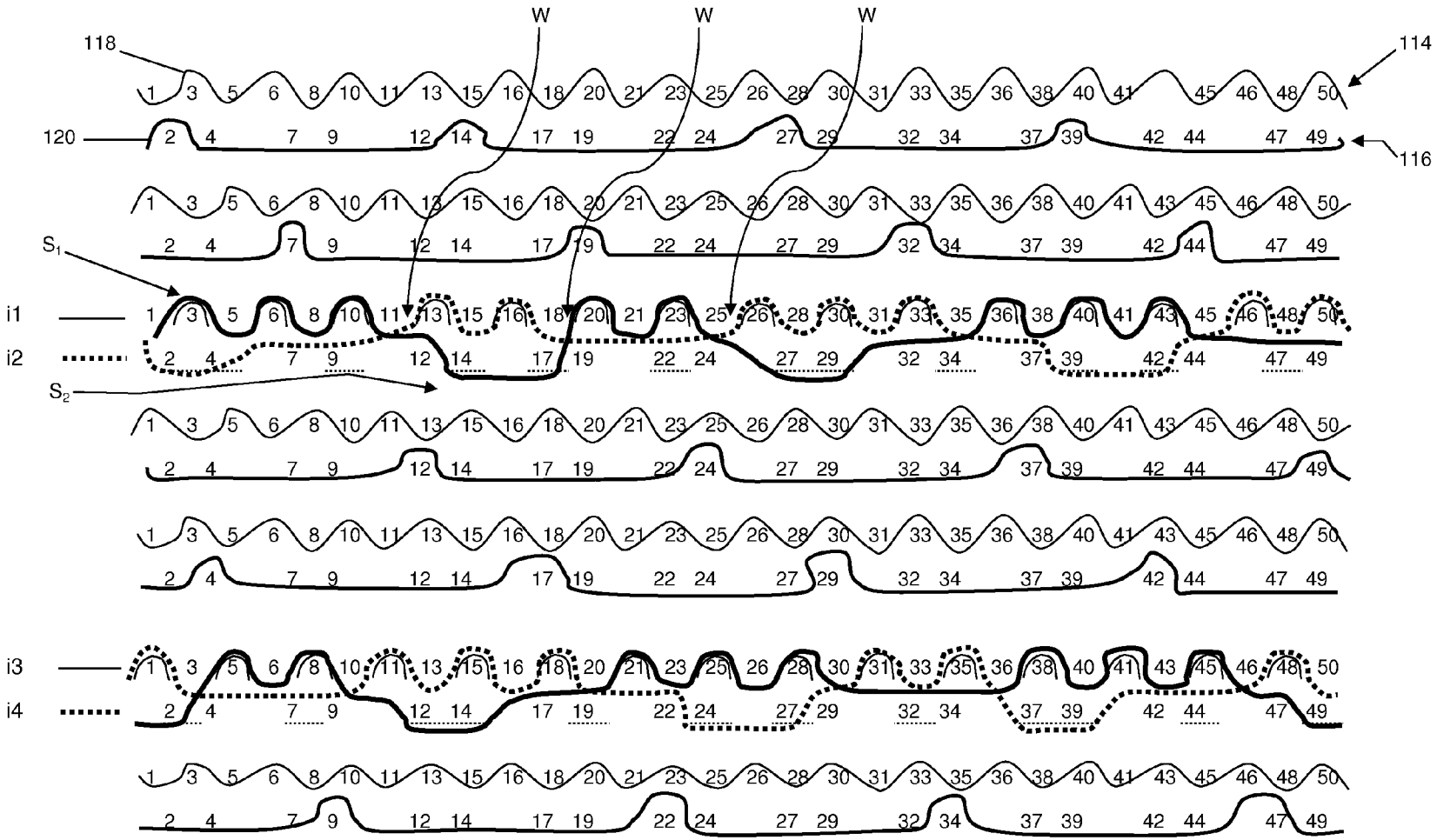
FIGS. 1A-1D and 2 show the progression for a binding thread repeat of the various involved binding threads and the distribution of the binding segments in an embodiment of the machine side fabric layer in this binding thread repeat of the present invention.
Figure 1B:
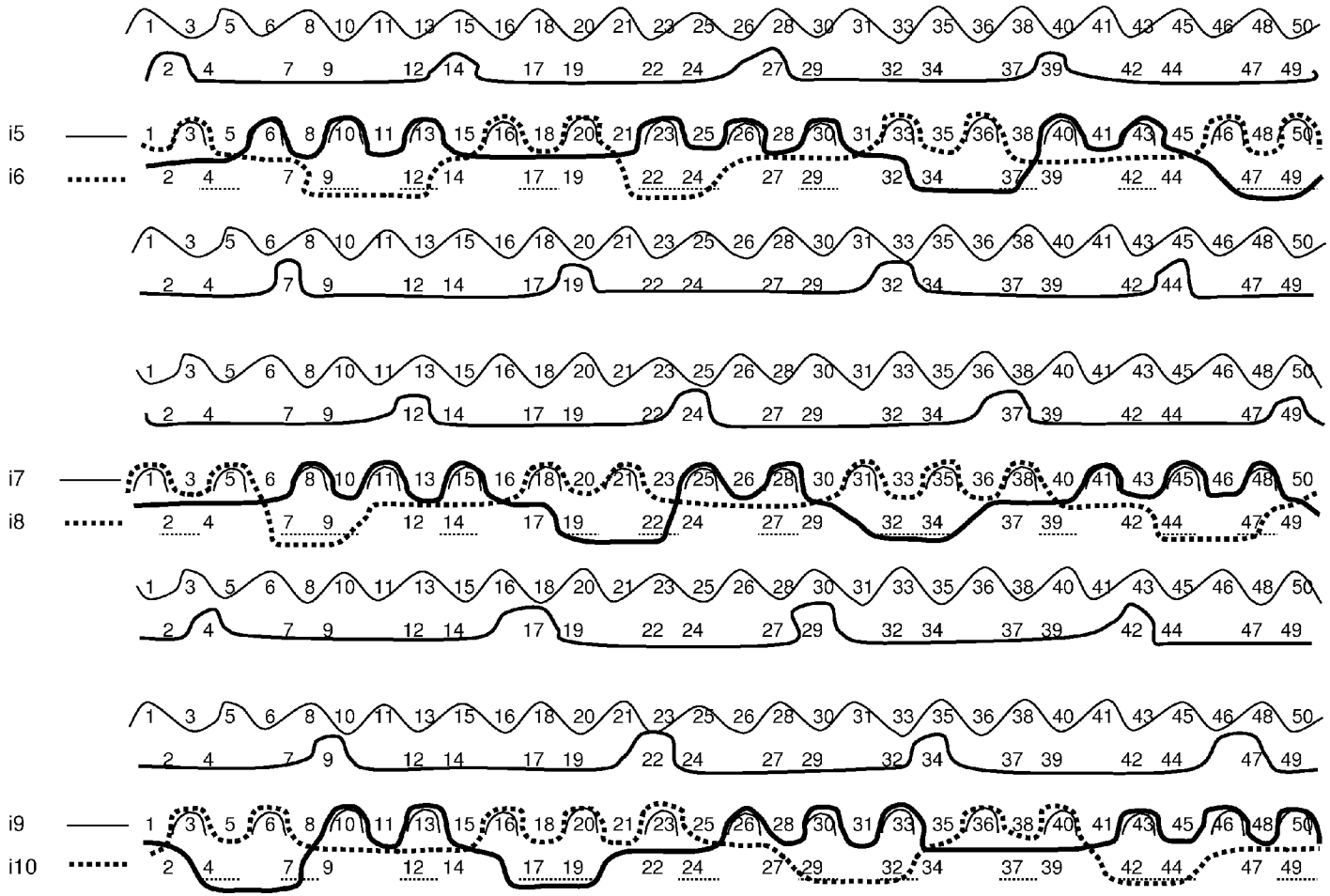
Figure 1C:
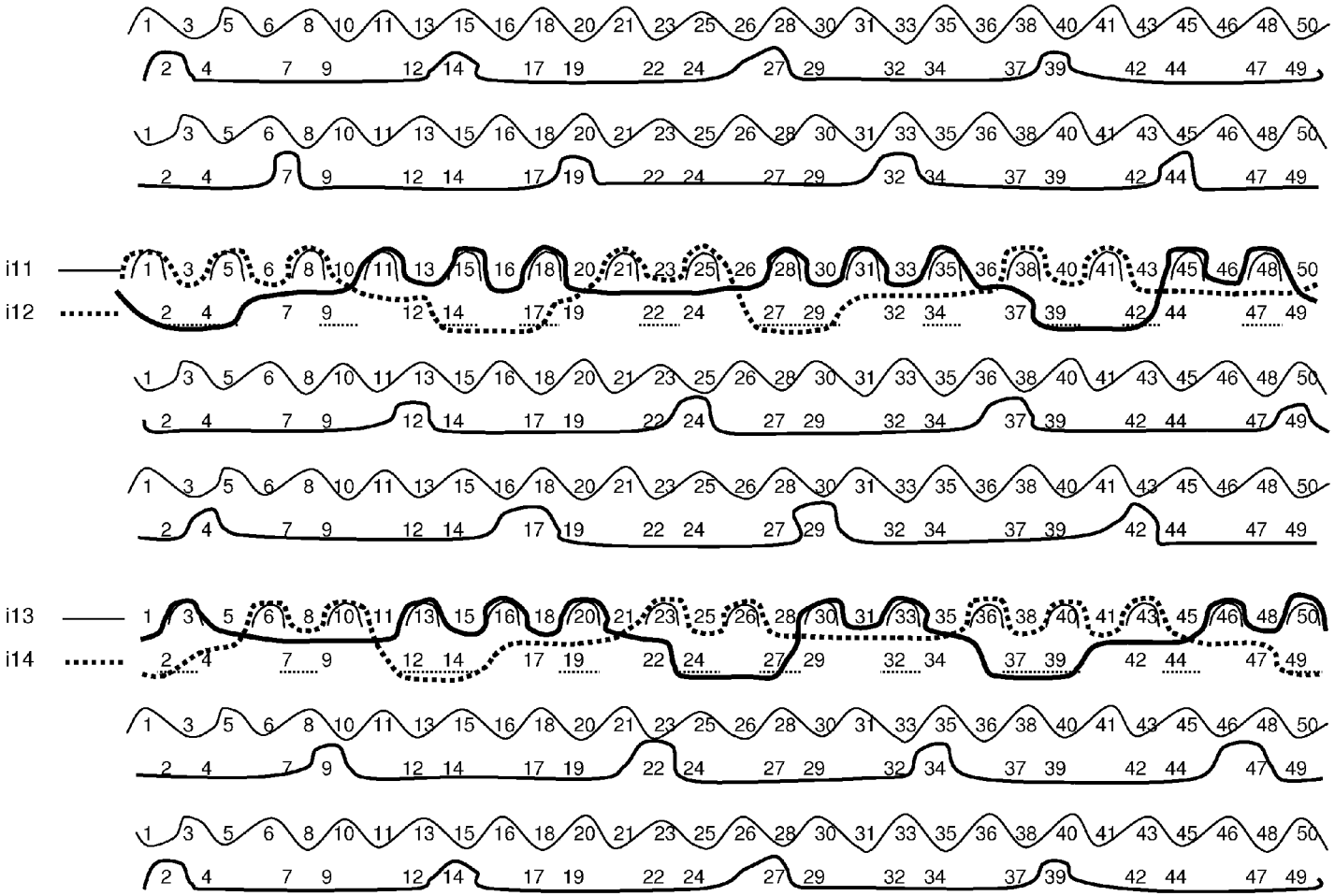
Figure 1D:
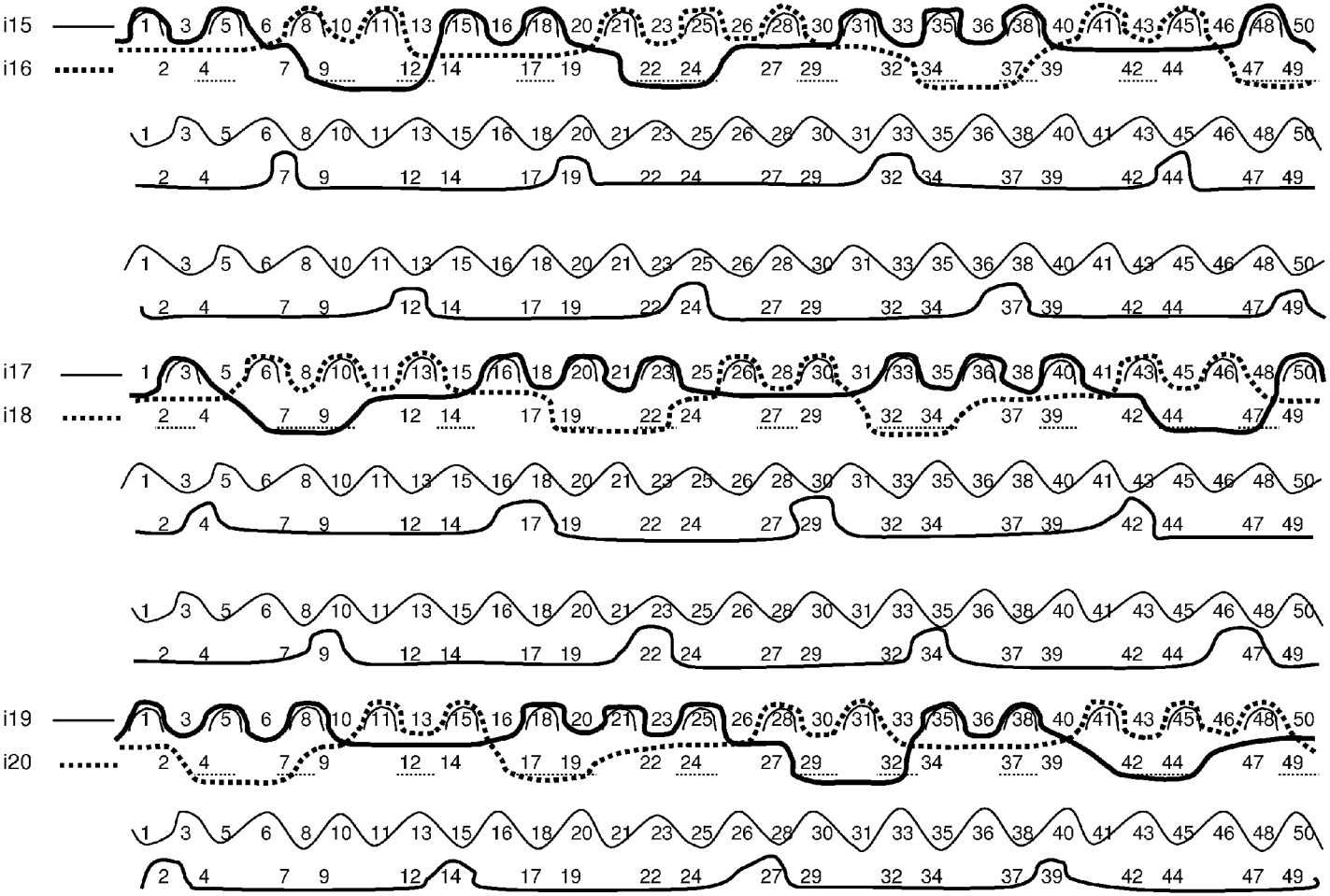

The following describes a first design example for a weave structure for a fabric belt for a machine to produce a web material, for example paper or cardboard, with reference to FIGS. 1A-1D, 2 and 3. In the examples illustrated in FIGS. 1A-1D and 2 a fabric belt of this type, for example utilized as a forming fabric, is constructed having two fabric layers 114, and 116. Here, fabric layer 114 represents a web-side, web material carrying first fabric layer. Fabric layer 116 is a machine- or operating-side second fabric layer, which comes into contact with the various rolls supporting or driving the belt. Many of the figures are on multiple pages and each figure number that is followed by a sequence of alphabetic characters denotes that the figure is continued and the weave pattern depicted is continuous even though the figure is on separate pages. A singular reference to a set of pages as a Fig. is only intended to recognize the continuity of the depicted weave pattern.

FIG. 1A-1D illustrates a section of a fabric belt of this type progressing in a weft direction, so that the threads located in this plane of projection represent the weft threads and the threads progressing perpendicular to the plane of projection represent the warp threads of the fabric belt. In the sequence from top to bottom all weft threads contained within one binding thread repeat, as well as all warp threads contained in one binding thread repeat are illustrated. The weft threats include on the one hand weft threads 118 utilized for the basic weave of first fabric layer 114, as well as the weft threads 120 utilized for the basic weave of second fabric layer 116. These weft threads 118 and 120 respectively remain in first fabric layer 114 or respectively second fabric layer 116 where they form a respective basic weave with the warp threads located there. It can be seen that the basic weave of the first fabric layer 114 is a plain weave, whereas the basic weave of second fabric layer 116 is a five-unit satin weave. This means that weft threads 120 of the basic weave of the second fabric layer 116 layer always float over four warp threads of second fabric layer 116, thus providing a fabric belt surface which is highly protective against wear and tear.

In order to provide an interconnection between the two fabric layers 114 and 116 a total of ten pairs of binding threads exist in a particular binding thread repeat. These binding threads i1-i2, i3-i4, i5-i6, i7-i8, i9-i10, i11-i12, i13-i14, i15-i16, i17-i18 and i19-i20 which are allocated to each other in pairs are always located immediately adjacent to each other in the warp direction. The binding threads of a particular binding thread pair alternate between the two fabric layers 114 and 116 so that for binding thread pair i1-i2 changeover points of binding threads i1 and i2 occur, for example, underneath warp threads 11,18, 25, 35 and 45.

The binding threads of the particular binding thread pair are thereby integrated into first fabric layer 114, so that they continue the basic weave, in other words the plain weave there. It can be seen, in particular, that also due to the repeated changeover of the binding threads between the individual fabric layers 114 and 116 within one binding thread repeat, the two binding threads of a particular binding thread pair create a seemingly continuous fictitious basic weave thread in the first, that is the paper side fabric layer 114, which is integrated into first fabric layer 114.

Each of binding threads i1 through i20 of a binding thread repeat respectively forms several binding segments $S_1$ and $S_2$, in first fabric layer 114, as well as in second fabric layer 116. One binding segment is hereby always formed by a segment of the affected binding thread where it ties off in a respective fabric layer 114 or 116 over at least one, possibly also over several warp threads, which do not necessarily need to be located immediately adjacent to each other. Binding thread 11 of the uppermost binding thread pair i1-i2 in FIG. 1A-1D forms, for example, a binding segment $S_1$, in first fabric layer 114 which extends from warp thread 3 to warp thread 10. Binding thread 1 ties off above warp threads 3, 6 and 10 on the outside of first fabric layer 114, in other words on the side facing away from second fabric layer 116. It is passed beneath warp threads 5 and 8 so that the previously addressed plain weave results. An additional binding segment $S_1$ in first fabric layer 114 is formed by binding thread i1 with warp threads 20, 21 and 23 or respectively also an additional one with warp threads 36, 38, 40, 41, and 43. Binding segments $S_1$ of first fabric layer 114 are separated from each other by a warp thread 1, 11, 18, 25, 35 or 45 which equally contributes to achieving the plain weave.

Binding segments $S_2$ are also formed in second fabric layer 116, whereby, for example, first binding thread i1 forms one binding segment $S_2$ with warp threads 14 and 17. An additional binding segment is formed by this binding thread i1 with warp threads 27 and 29. Here, the binding segments also encompass several warp threads, in particular always two immediately adjacently located warp threads, so that in each binding segment $S_2$ binding thread i1 and equally also binding thread i2 floats over two warp threads on the machine side.

Within the binding thread repeat illustrated in FIG. 1A-1D, which in this case provides the smallest repeat unit in the weave structure which, in weft direction and in warp direction, successively repeated results in the entire weave structure with a total of ten binding thread pairs, basically only two types of differently integrated binding threads exist. This means that all unevenly numbered binding threads i1, i3, . . . , i19 have fundamentally the same progression in regard to the warp threads, are however offset from each other relative to each other in the weft direction. The same applies to the evenly numbered binding threads i2, i4, . . . , i20. It can also be seen that the distribution of binding segments $S_1$ or respectively $S_2$ is such that in first fabric layer 114 a greater number, actually six binding segments $S_1$ are present than in second fabric layer 116, where within one binding thread repeat only four binding segments $S_2$ are present which are separated from each other by respectively three warp threads. This is attributable to the inventive pattern in which each of the two binding threads of a particular binding thread pair in first fabric layer 114 forms two binding segments which are separated by a binding segment of the respective other binding thread, without, in the interim, changing into second fabric layer 116.

Figure 2:
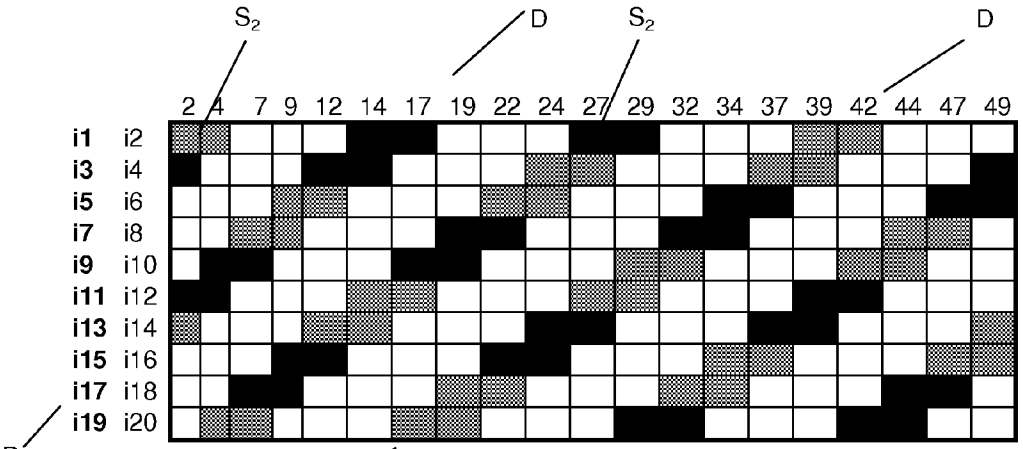

Viewed from the machine side FIG. 2 shows the positioning of binding segments $S_2$ in second fabric layer 116. Columns numbered 2-49 in FIG. 2 represent the warp threads of a binding thread repeat of second fabric layer 116, whereas the rows represent the weft threads or in particular in this instance binding threads i1-i20 in the form of the weft threads. Clearly recognizable are binding segments $S_2$ following each other in succession in the weft direction, for example of first binding thread pair i1-i2, whereby the sequence of succession is always such that two binding segments $S_2$ of the binding threads of the one type follow two binding segments $S_2$ of the binding threads of the other type.

The configuration of binding segments $S_2$ in second fabric layer 116 is selected such that these binding segments $S_2$ are arranged along binding segment diagonals D. These binding segment diagonals D progress obliquely to the warp direction as well as also obliquely to the weft direction. One recognizes that within one binding thread repeat, a plurality of binding segment diagonals D, which progress essentially parallel relative to each other, exists along which binding segments $S_2$ of second fabric layer 116 are arranged in succession.

It has been shown that by providing such binding segment diagonals D along which binding segments $S_2$ of second fabric layer 116 are preferably arranged, a uniformity deviating from a completely random distribution of binding segments $S_2$ is achieved, which in turn results in a marking tendency. In particular the cluster formation occurring with random positioning can herewith be avoided.

In the illustration in FIG. 2 it can be seen that a comparatively high uniformity is also present in the binding segment diagonals. In particular, the binding segments $S_2$ of a diagonal are offset relative to each other respectively by one warp thread in weft direction and overlap at one warp thread. Together with the distribution of the warp threads onto both fabric layers 114 and 116 in such a way that a greater number of warp threads are present in fabric layer 114 than in fabric layer 116—whereby therefore consequently a certain non-uniformity in the overlay of the warp threads is produced—positioning of binding segments $S_2$ along binding segment diagonals D results in a fabric belt having a very low marking tendency.

It is further recognized in FIG. 2 that uniformity is also present in the individual binding segment diagonals D also in regard to binding segments $S_2$ contained therein. Always two binding segments $S_2$ having binding threads of the one type—binding threads relative to each other in regard to the two fabric layers 114 and 116 integrated fundamentally in the same way, relative to each other however arranged offset in the weft direction—follow two binding segments $S_2$ which are created respectively with one binding thread of the other type.

Figure 3:
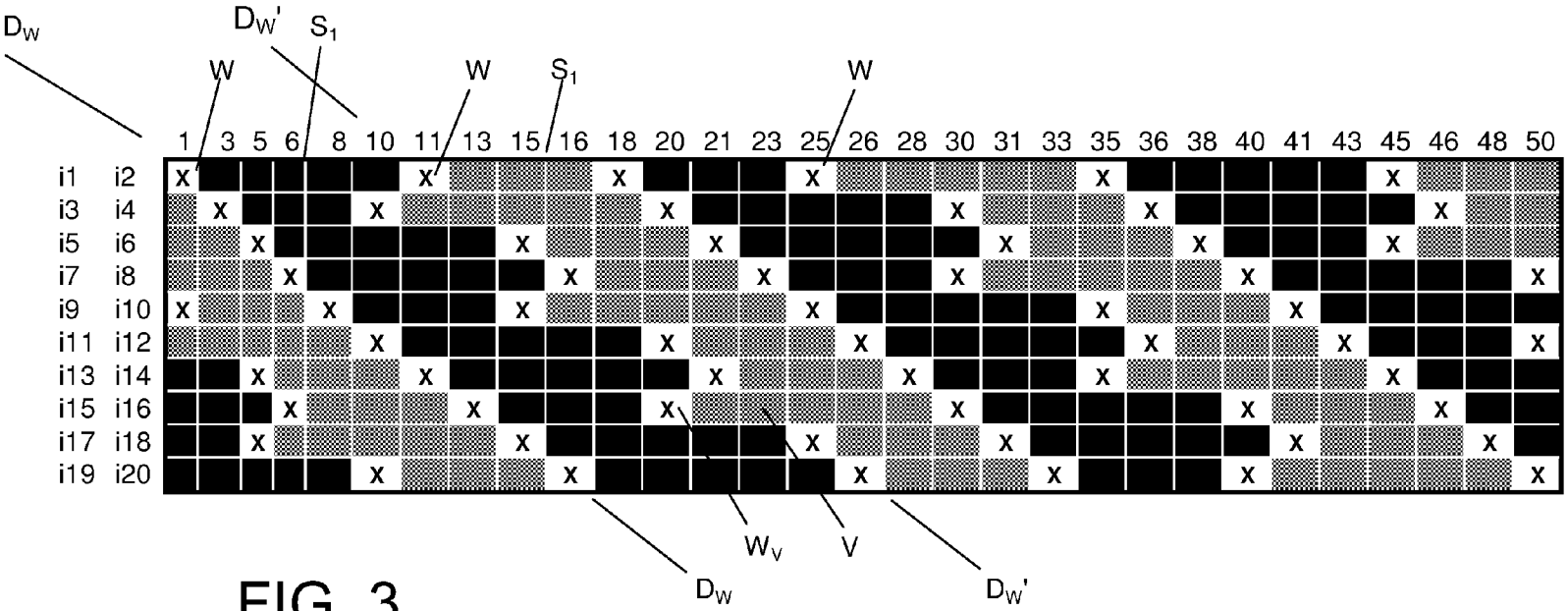
FIG. 3 illustrates the arrangement of binding segments in a paper side fabric layer and the changeover points created in such binding segments for the weave pattern shown in FIGS. 1A-1D and 2.
Figure 4A:
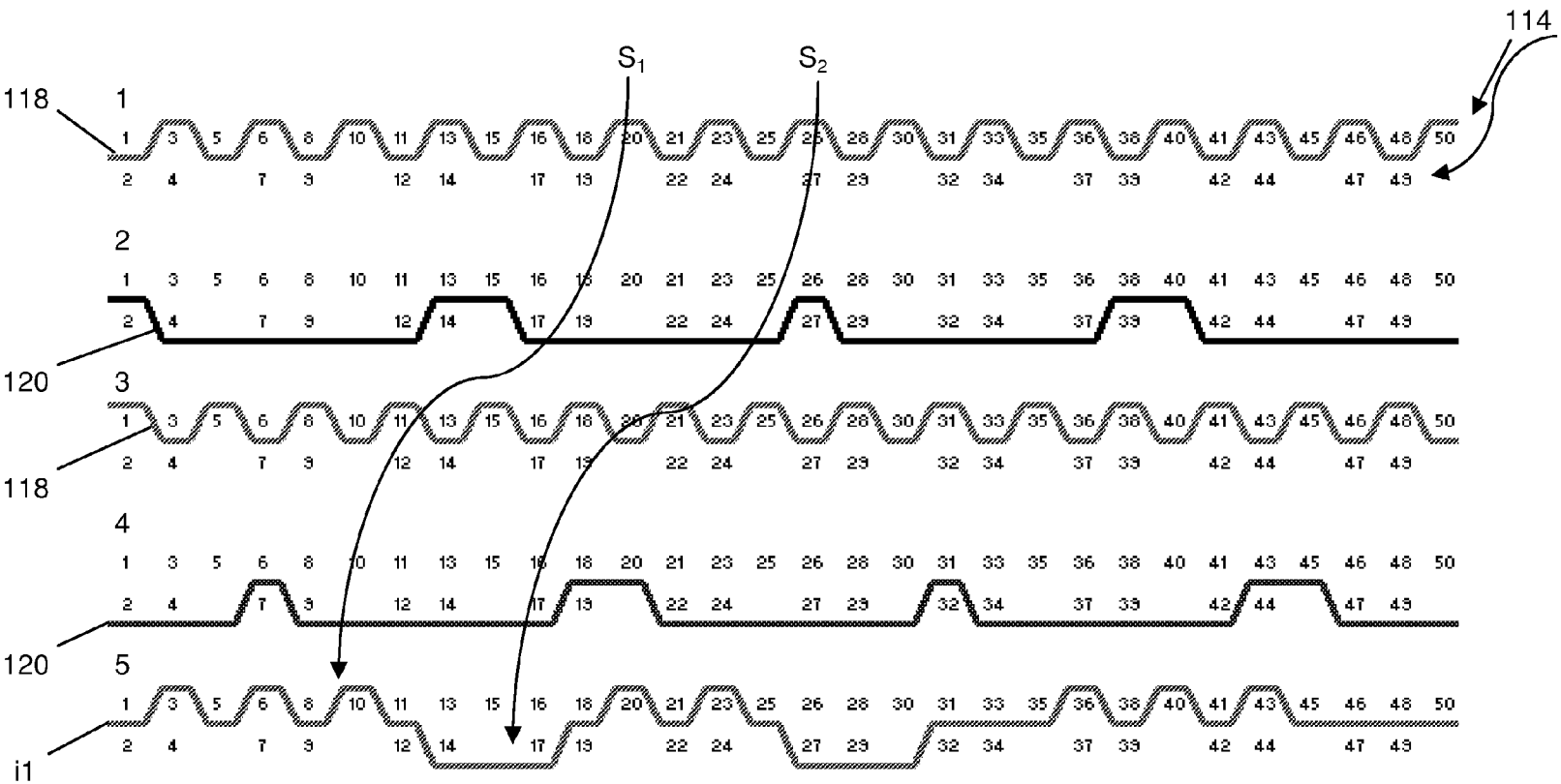
Figure 4B:
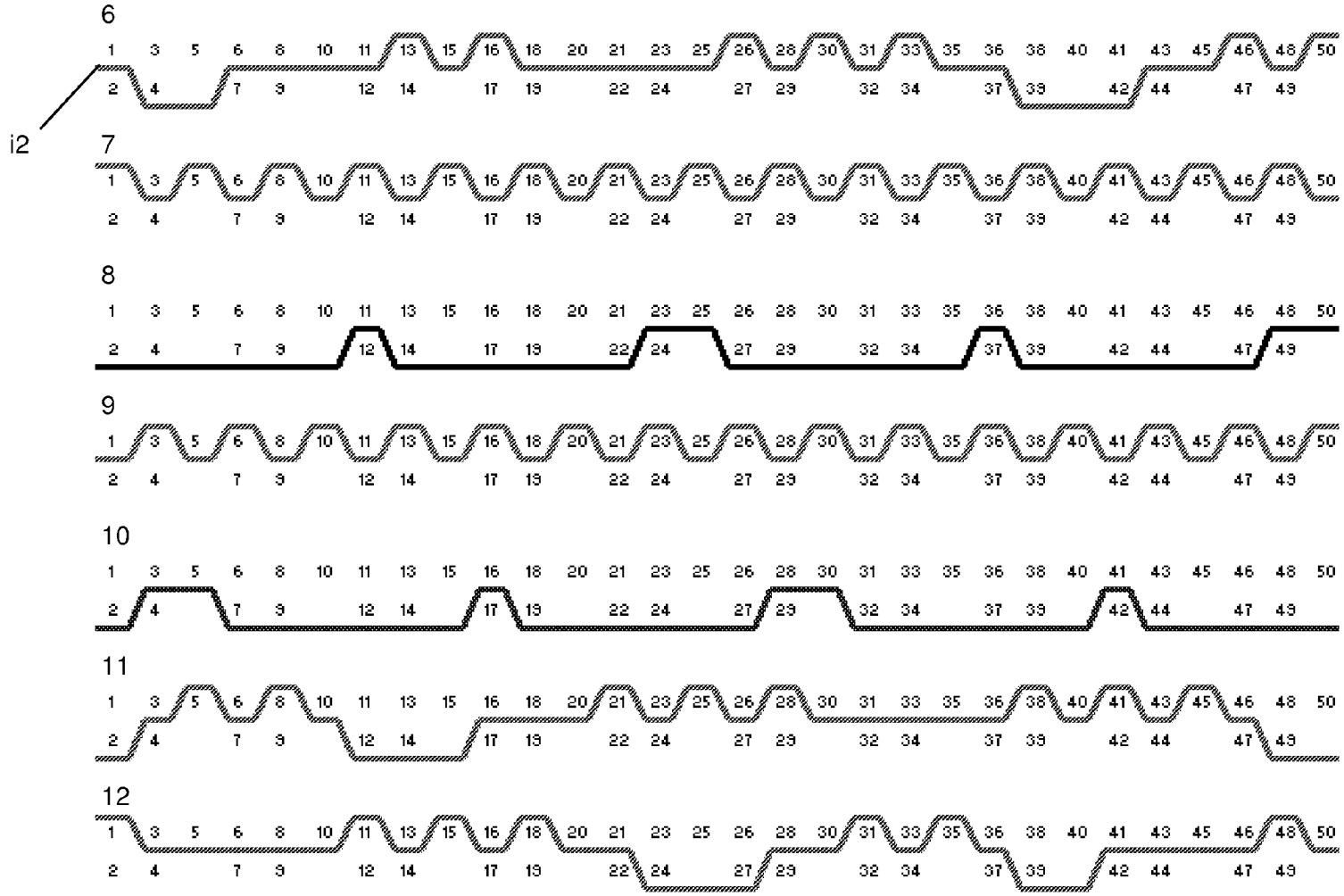
Figure 4C:
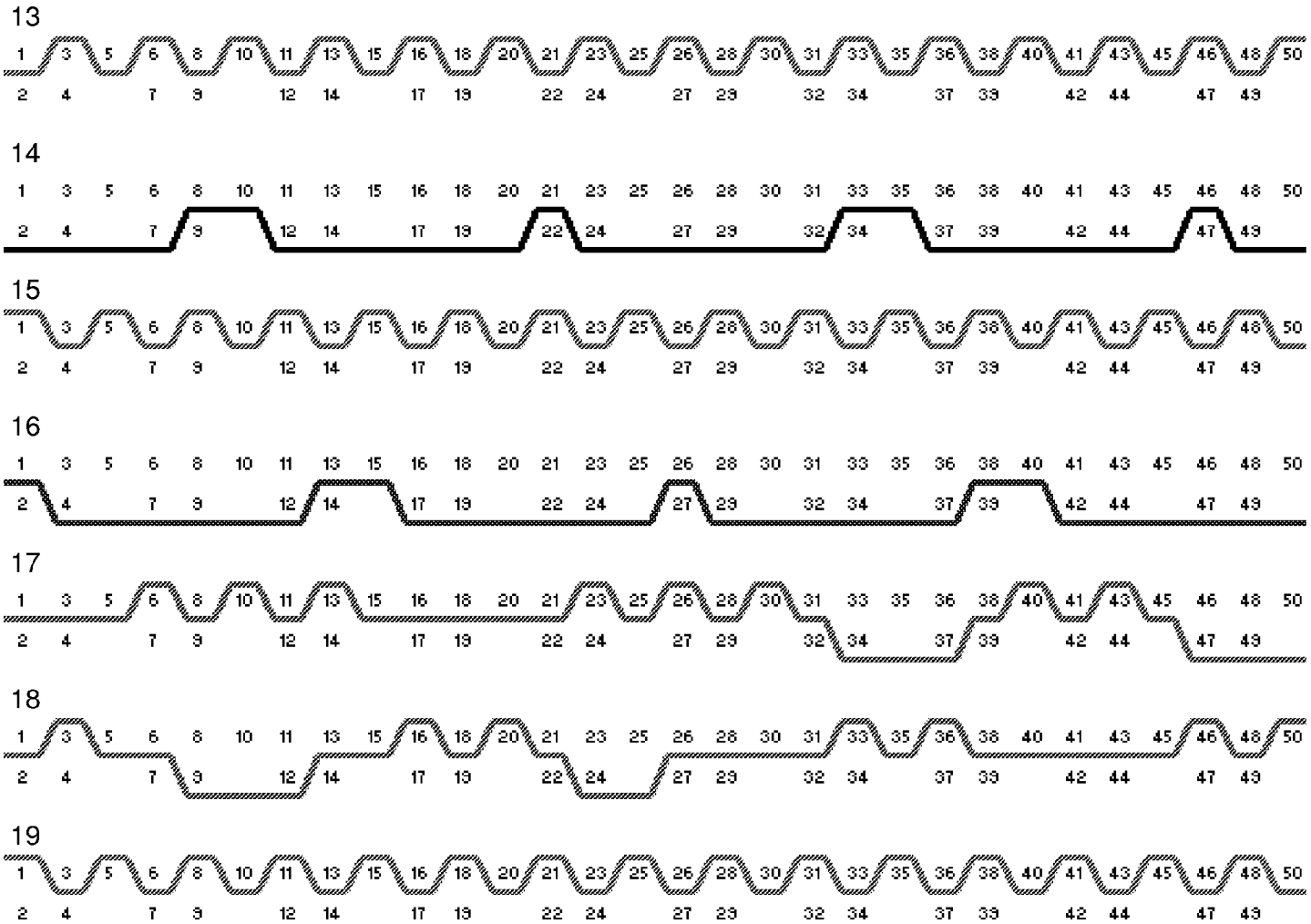
Figure 4D:
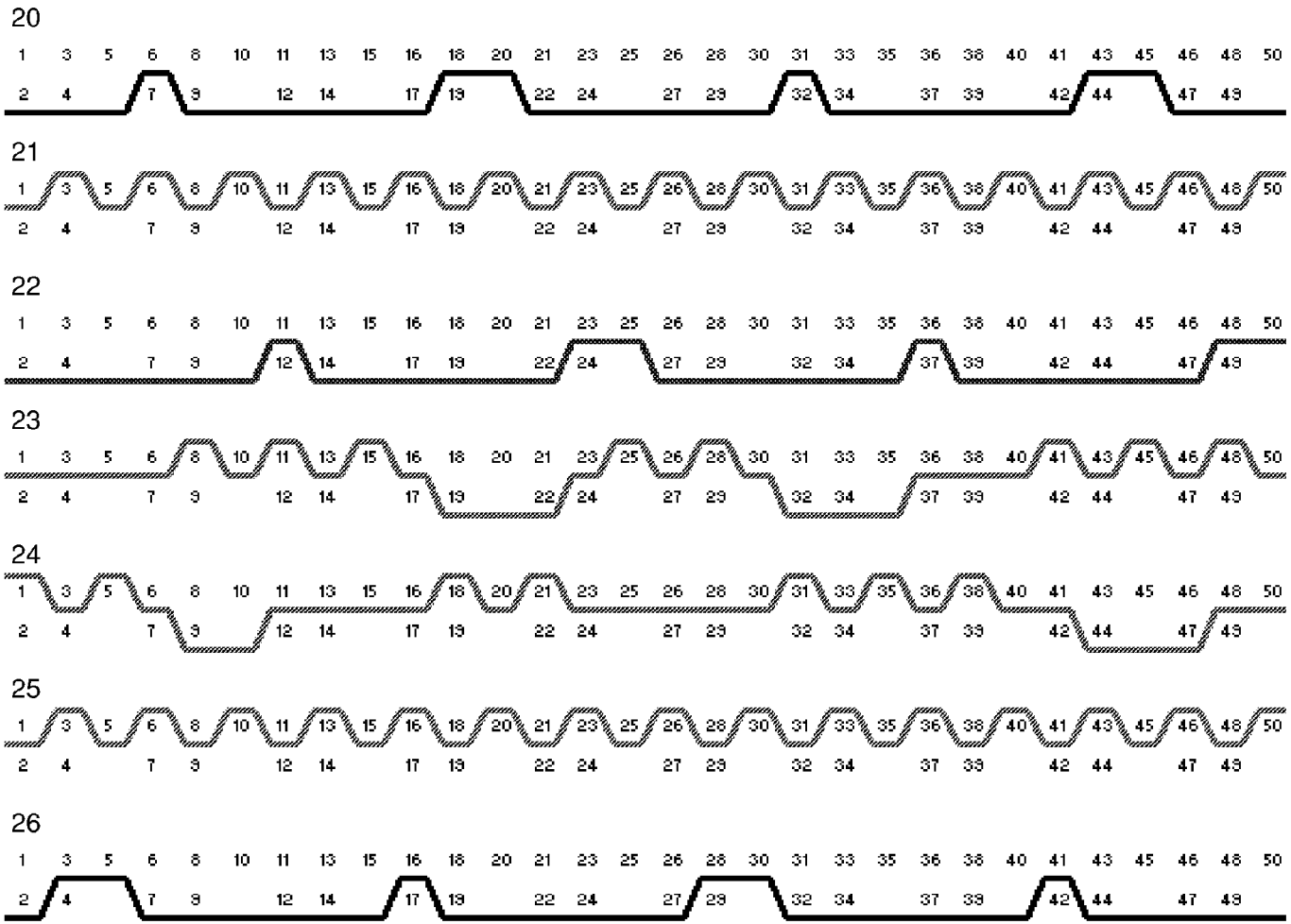
Figure 4E:
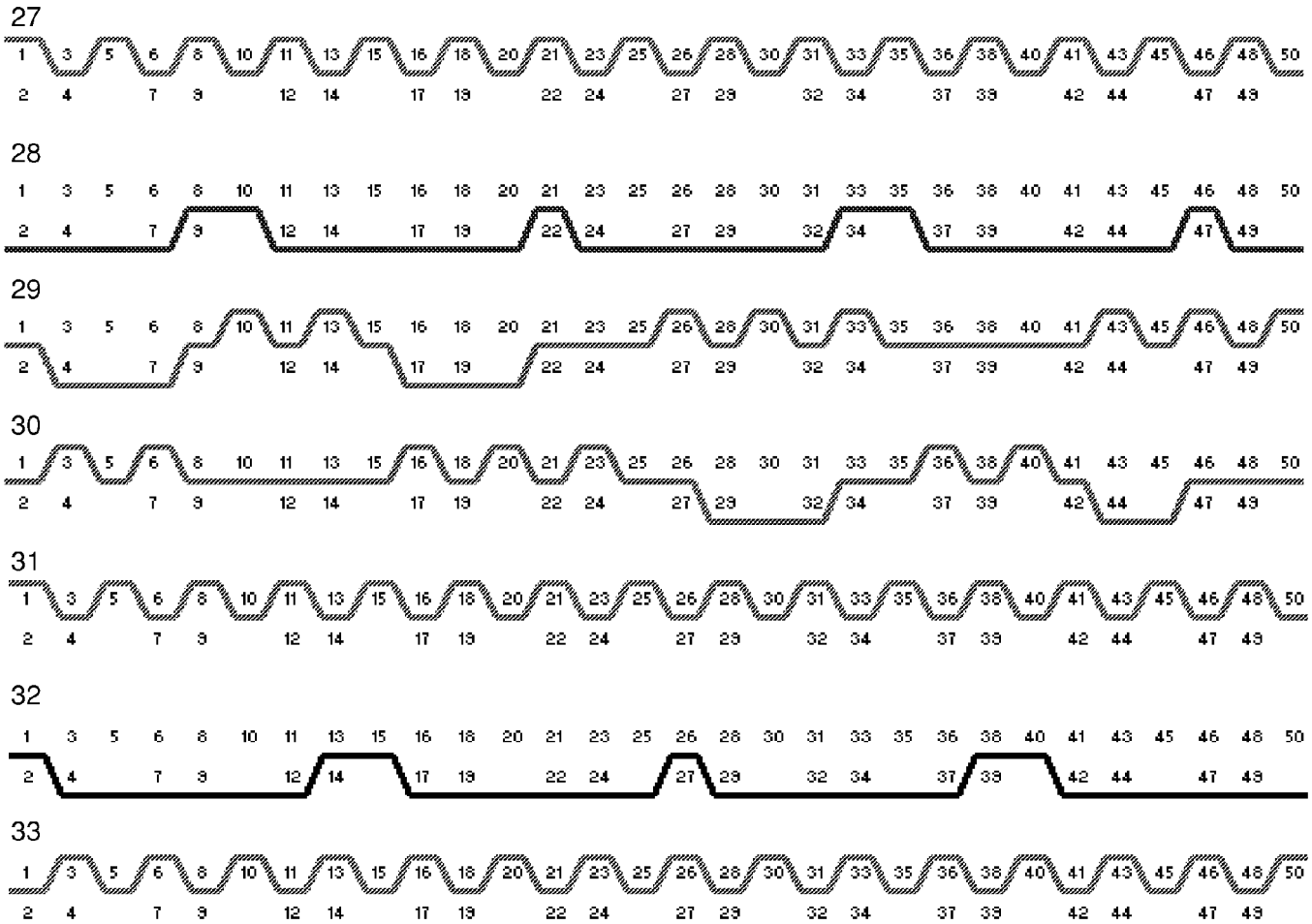
Figure 4F:
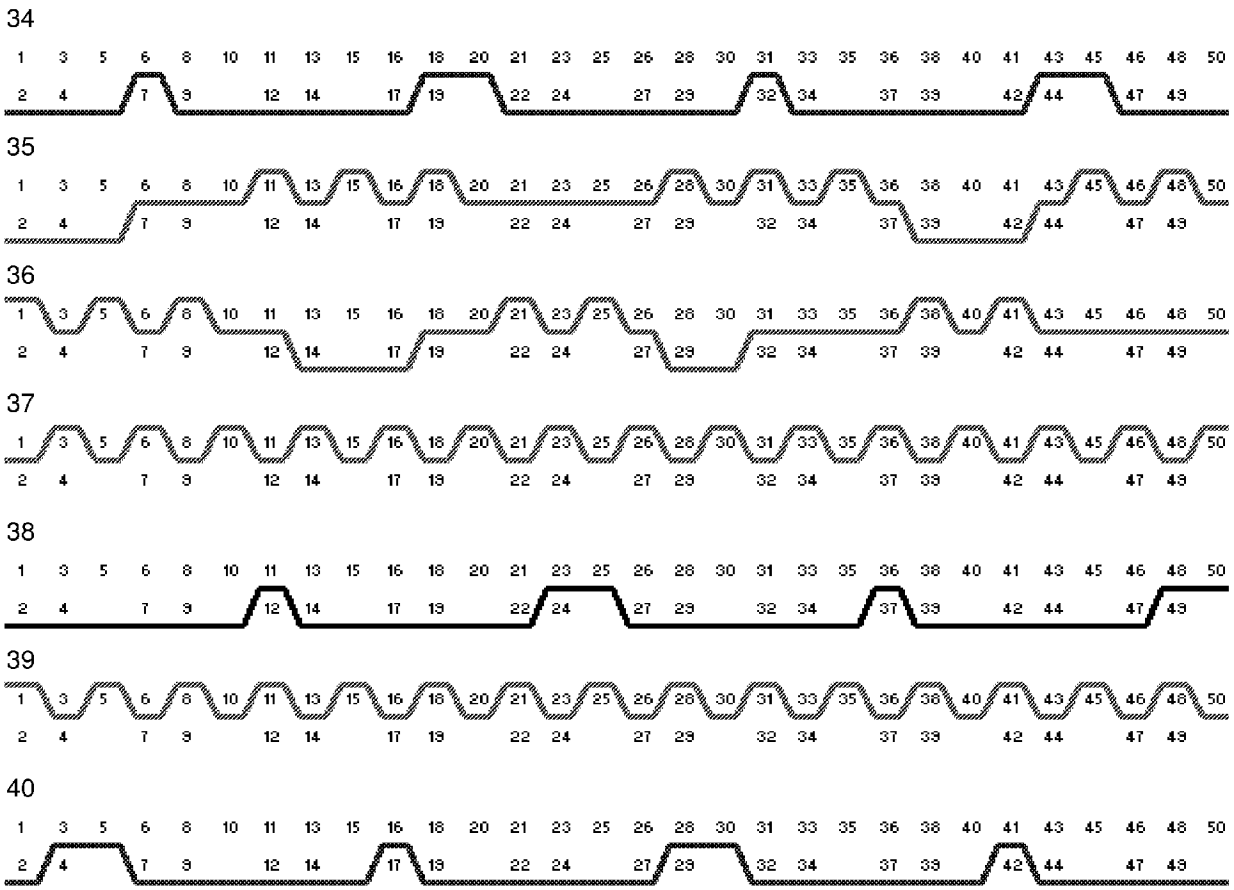
Figure 4G:
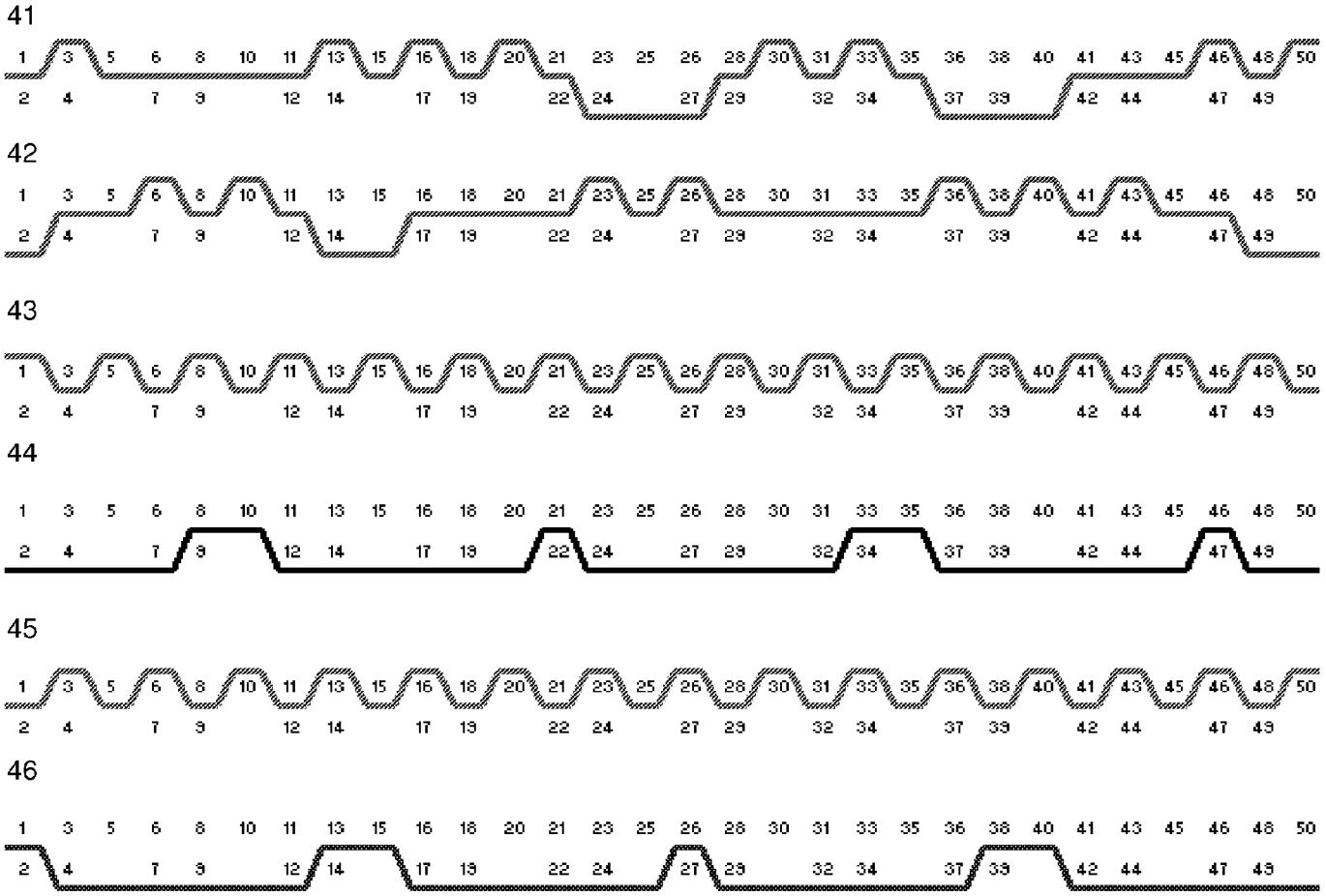
Figure 4H:
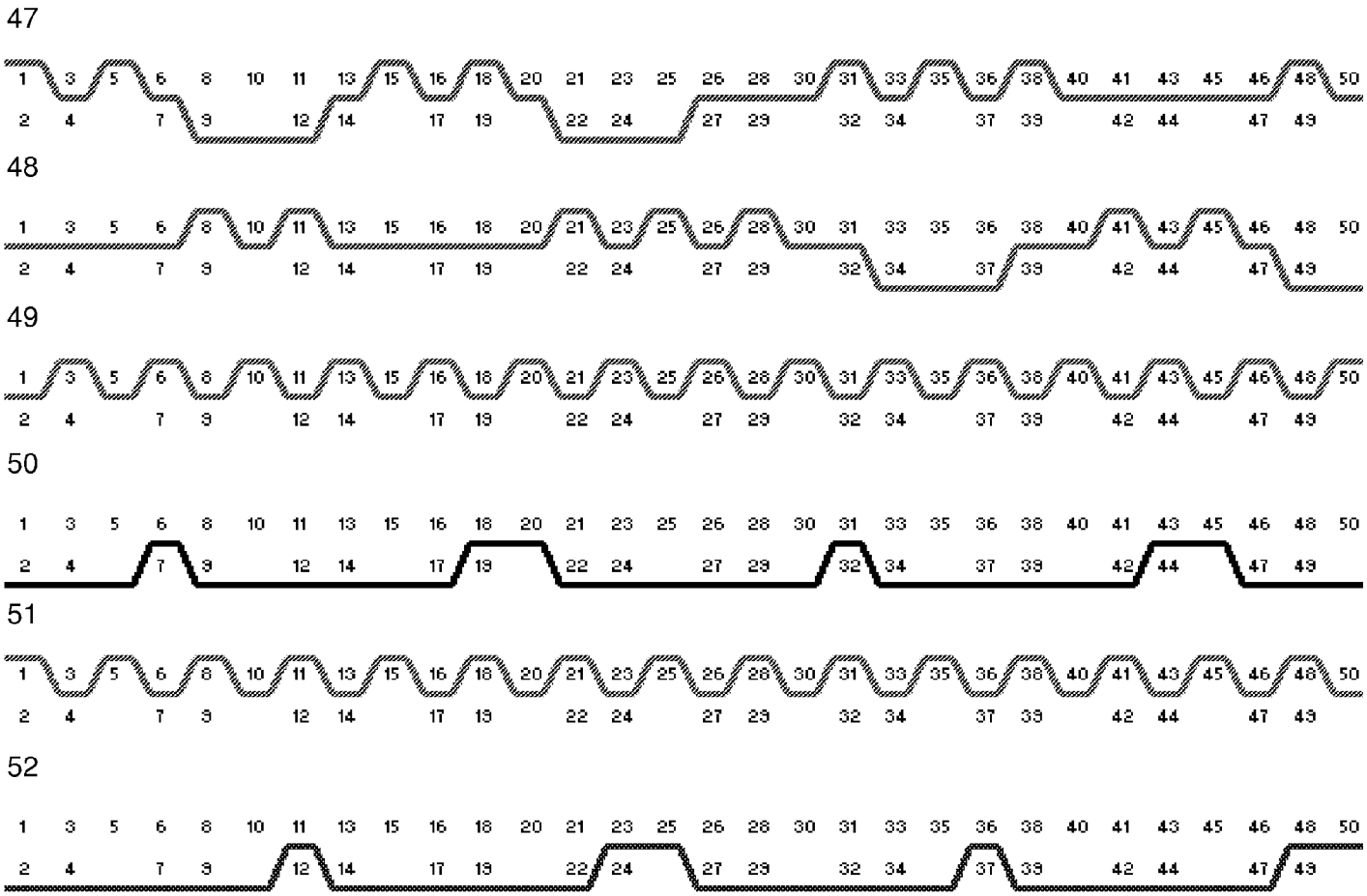
Figure 4I:
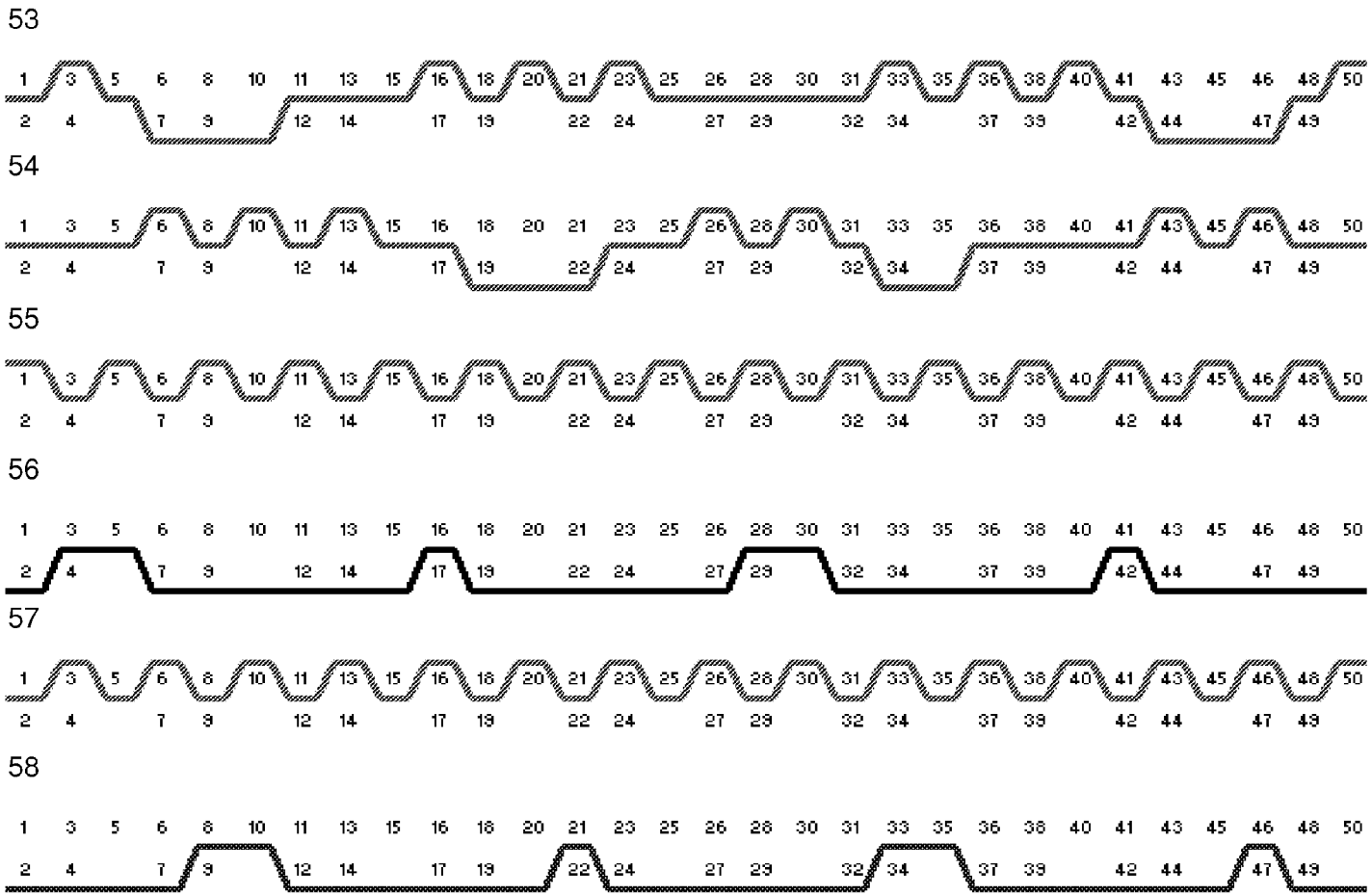
Figure 4J:
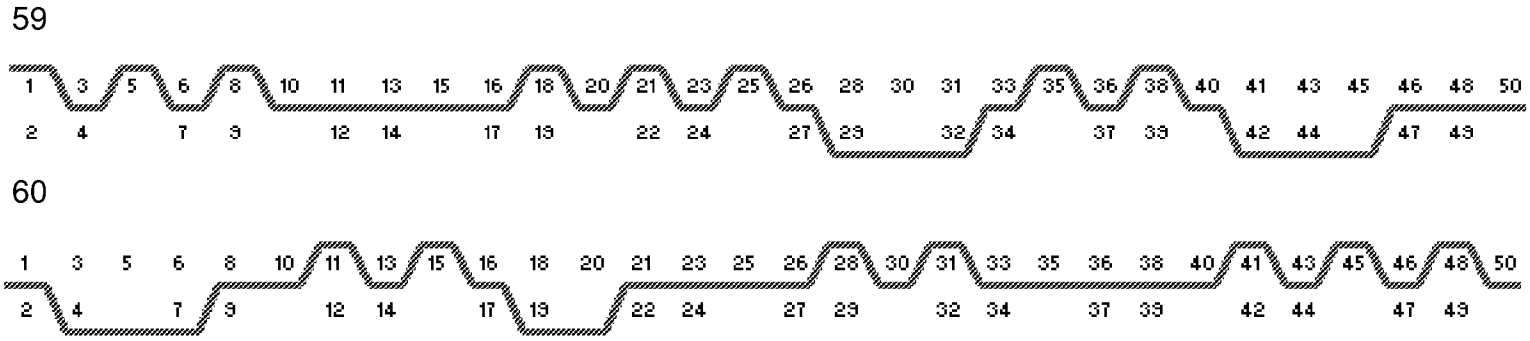
Figure 6A:
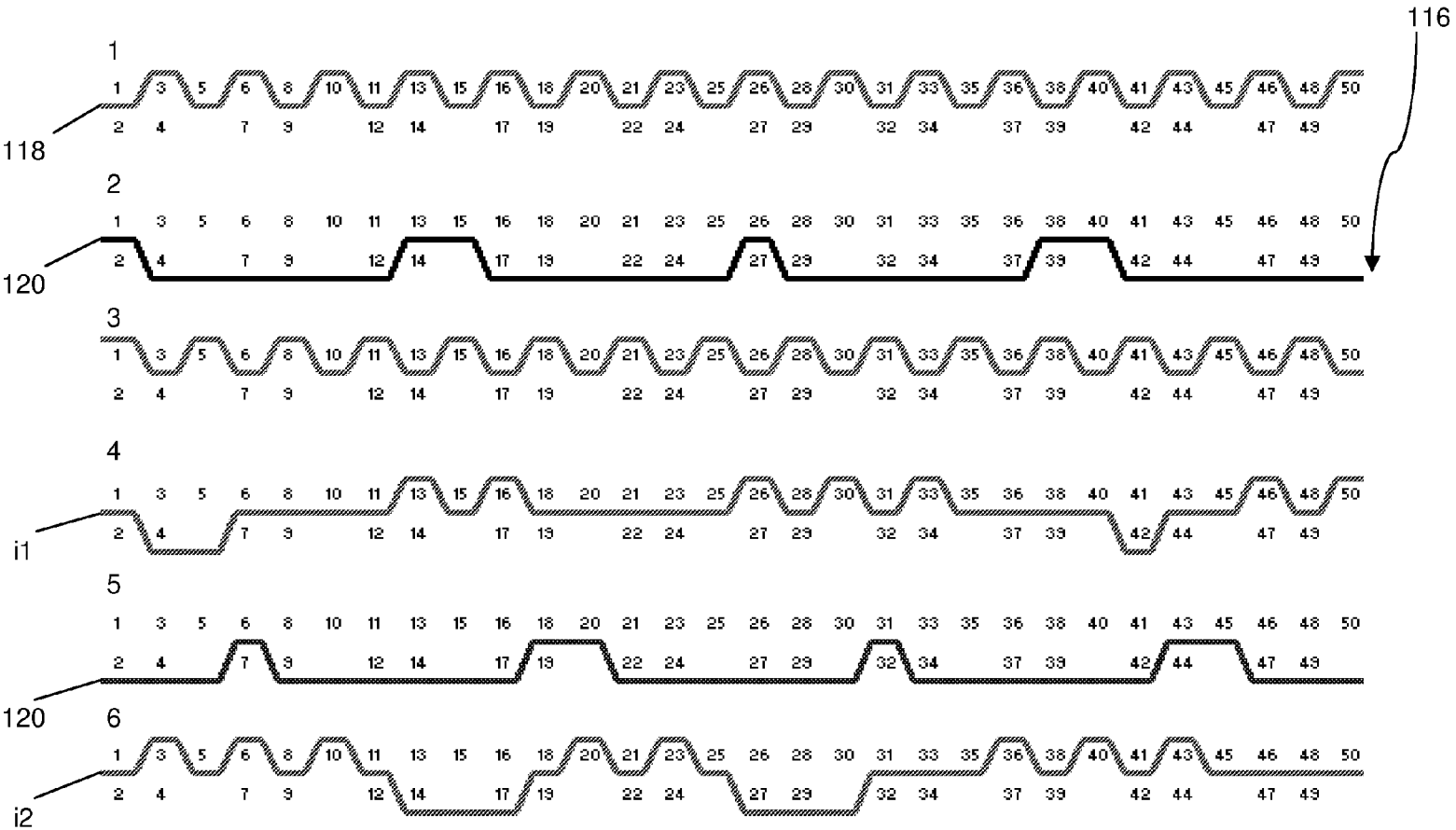
FIGS. 6A-6I and 7 illustrate an alternative design form of that shown according to FIGS. 1A-1D and 2.
Figure 6B:
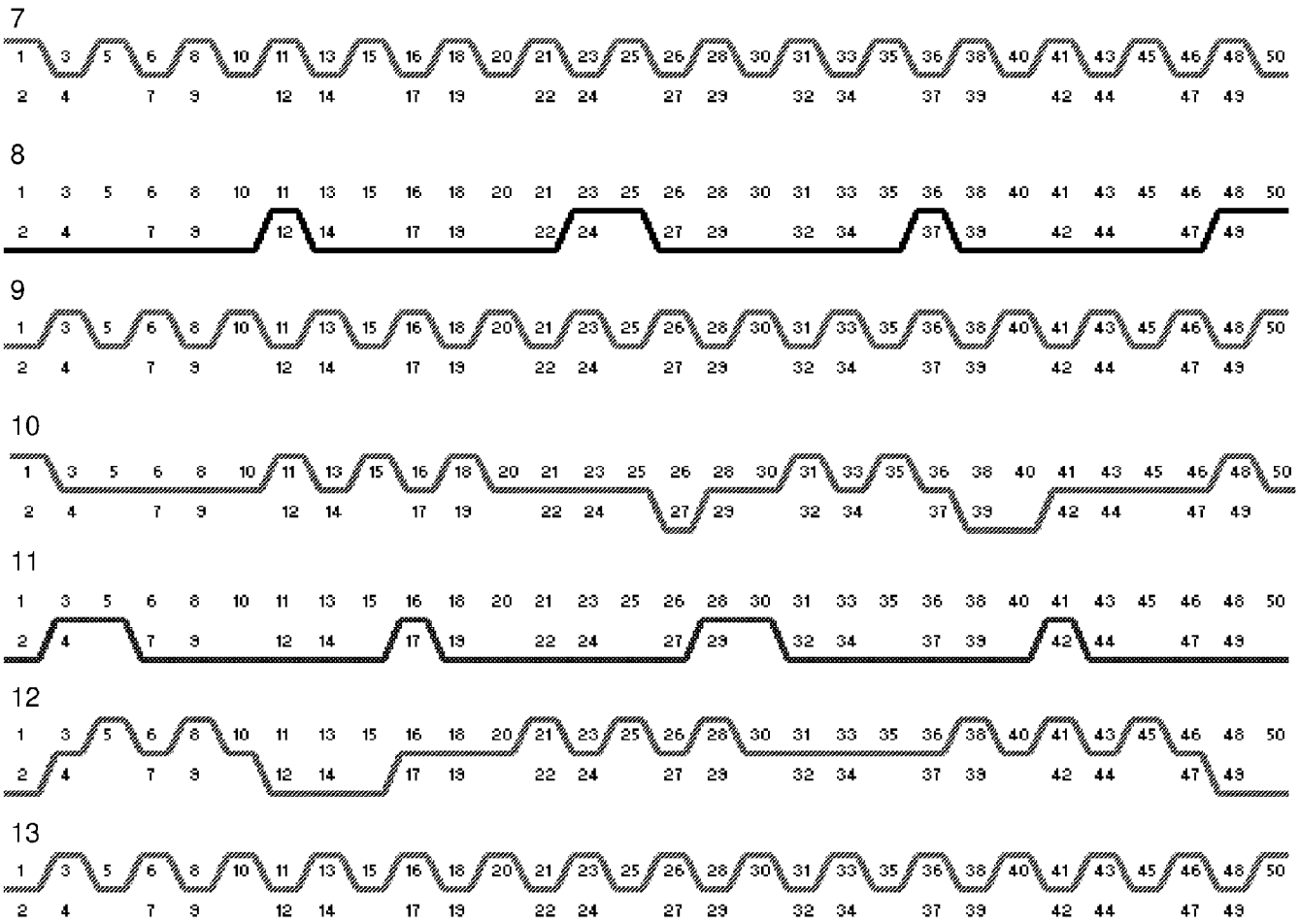
Figure 6C:
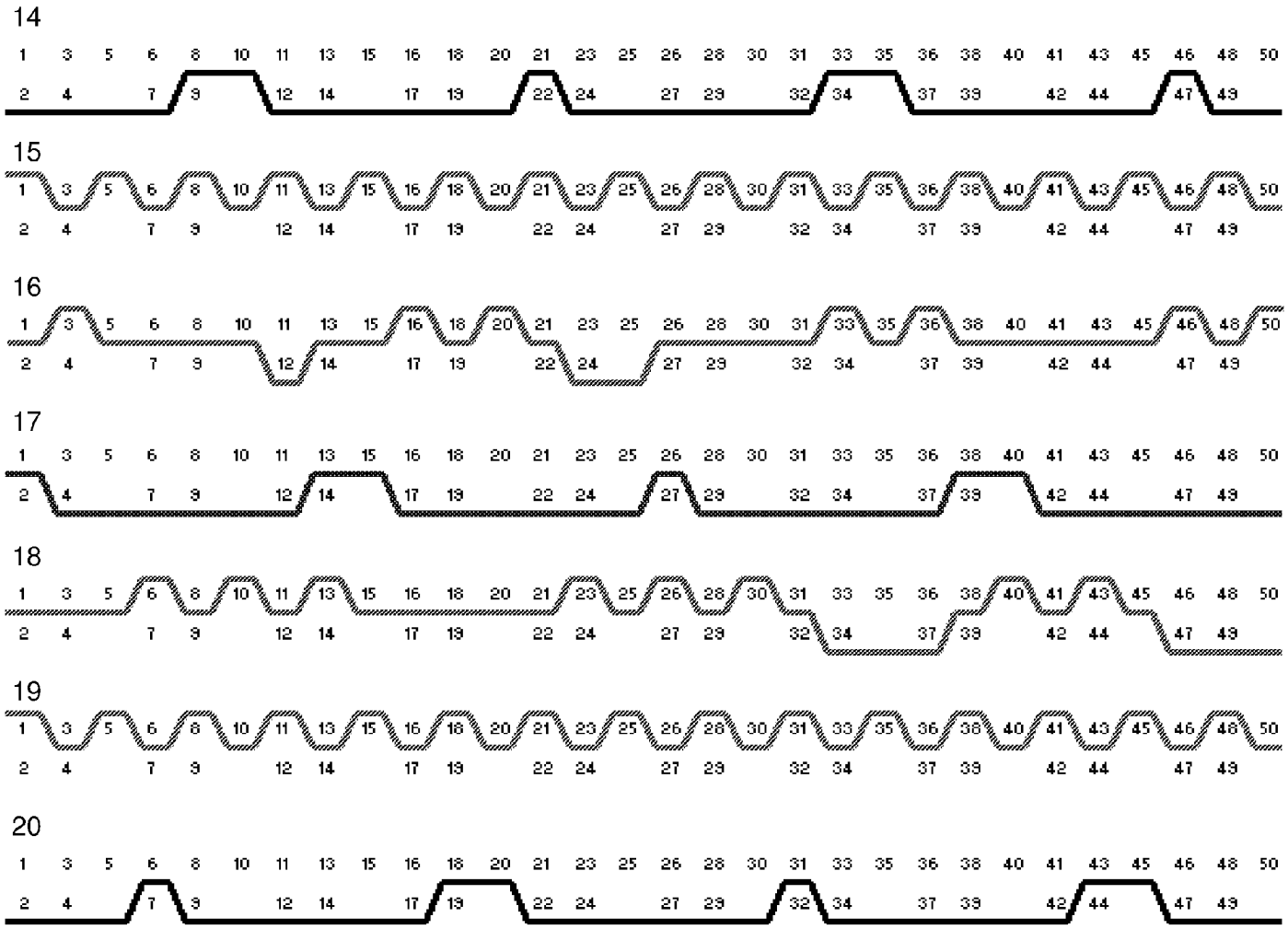
Figure 6D:
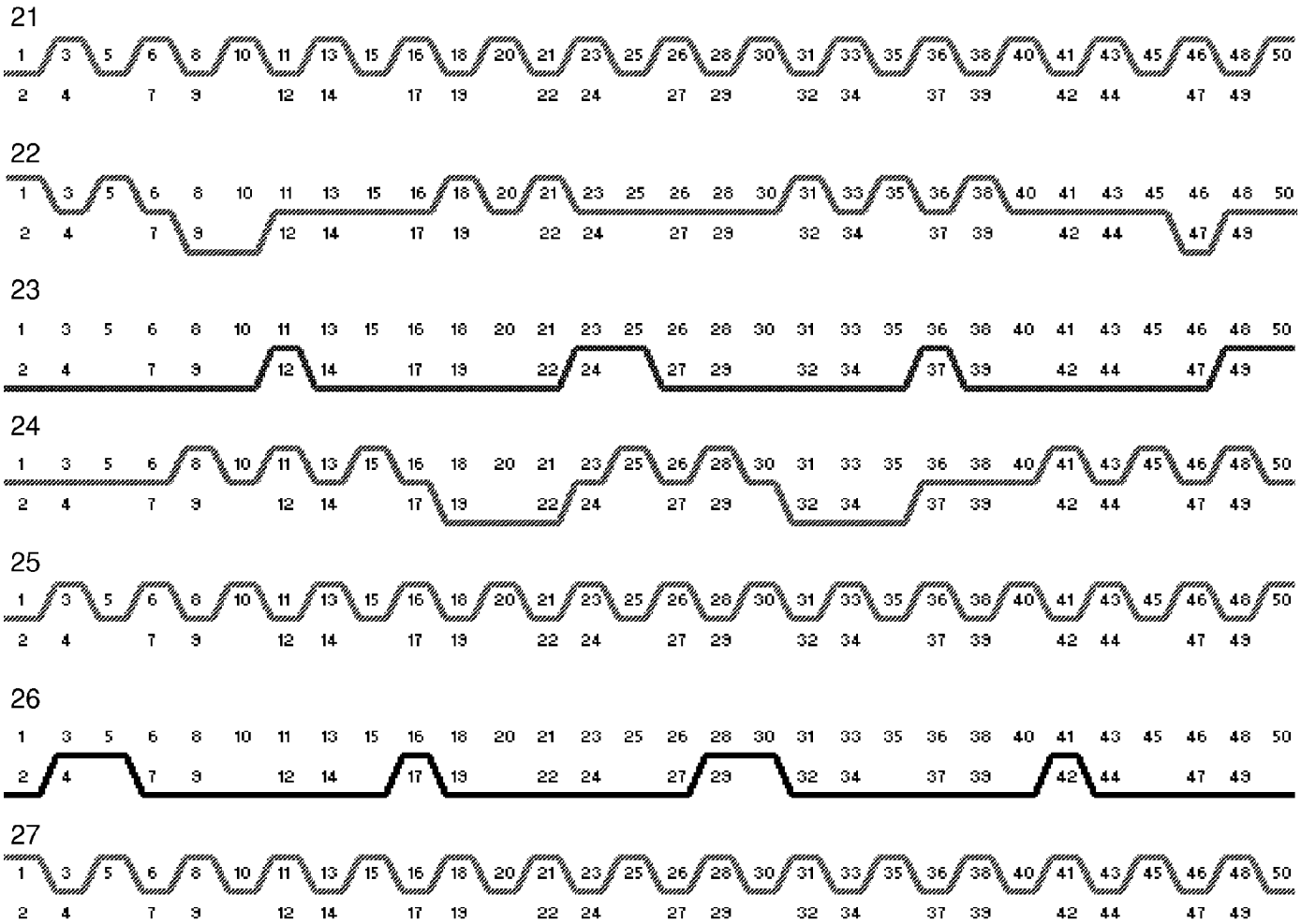
Figure 6E:
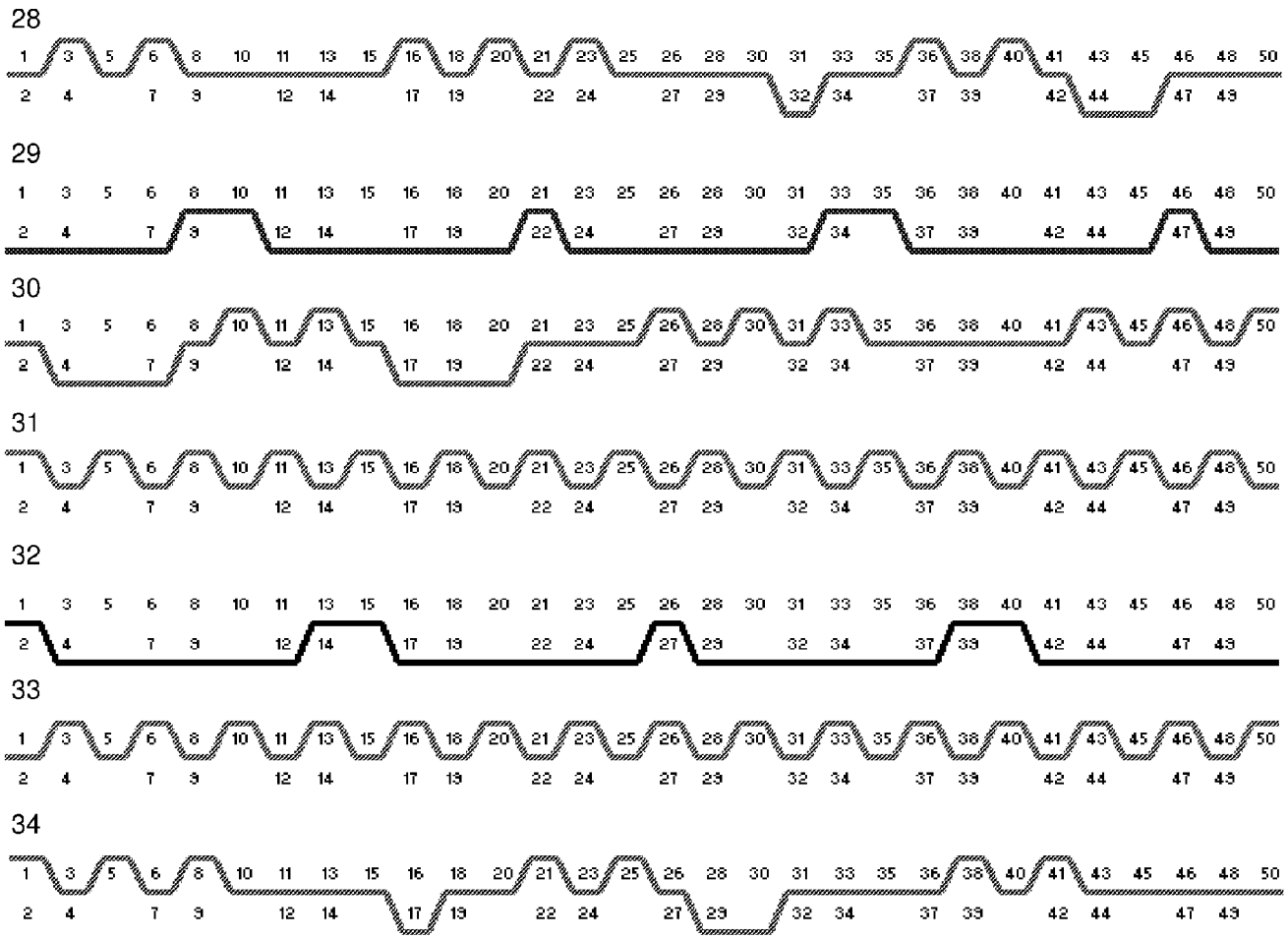
Figure 6F:
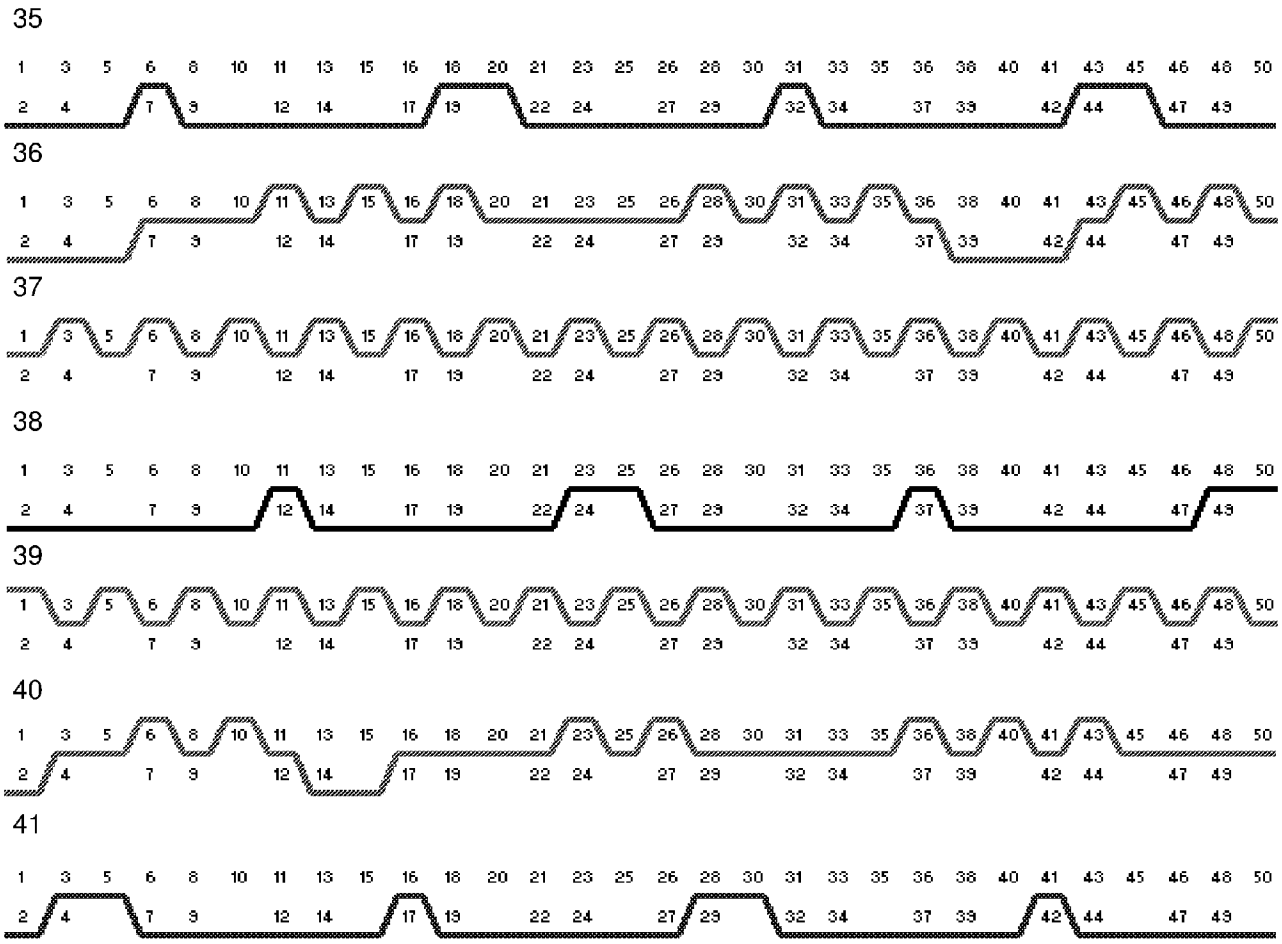
Figure 6G:
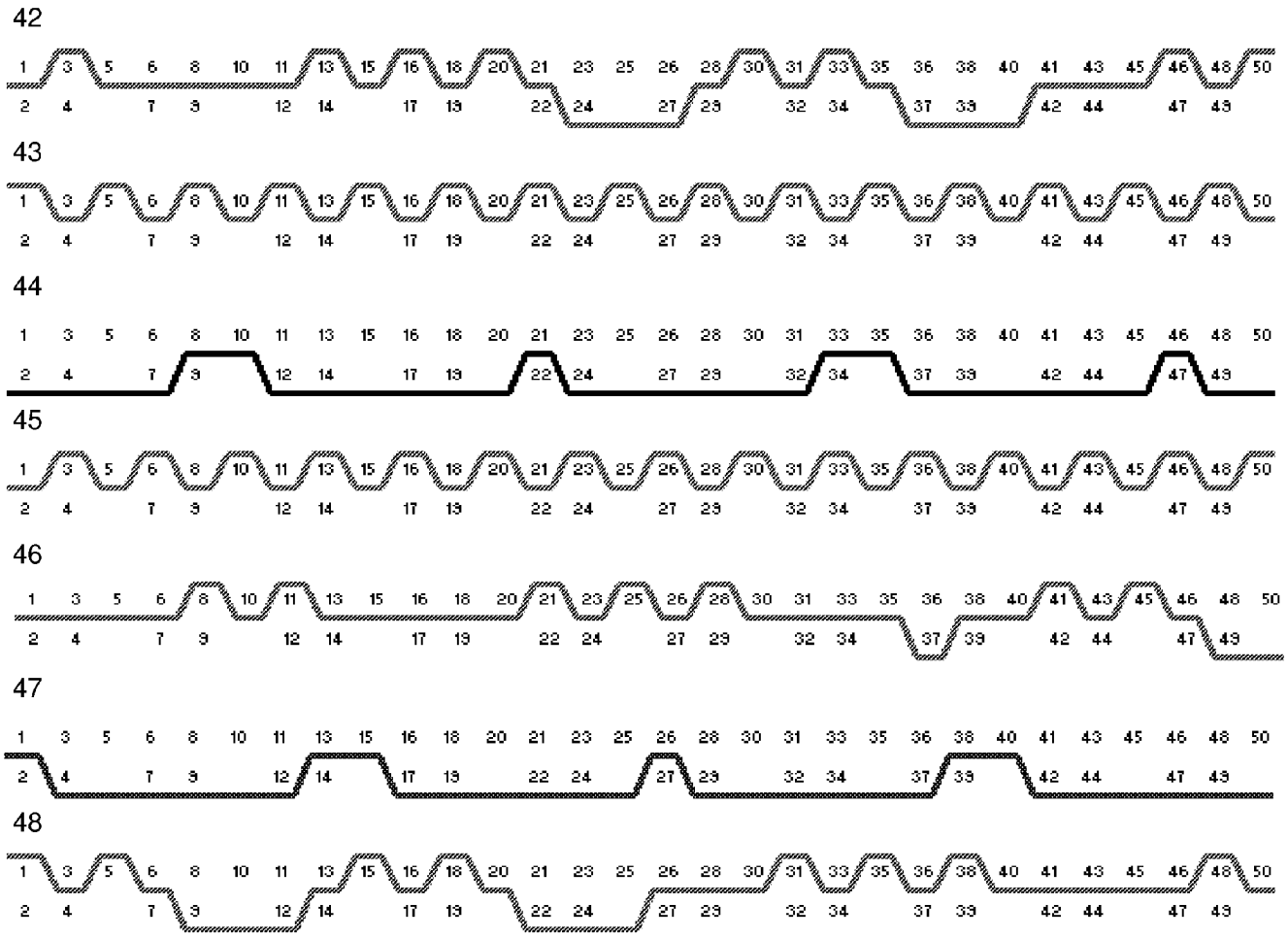
Figure 6H:
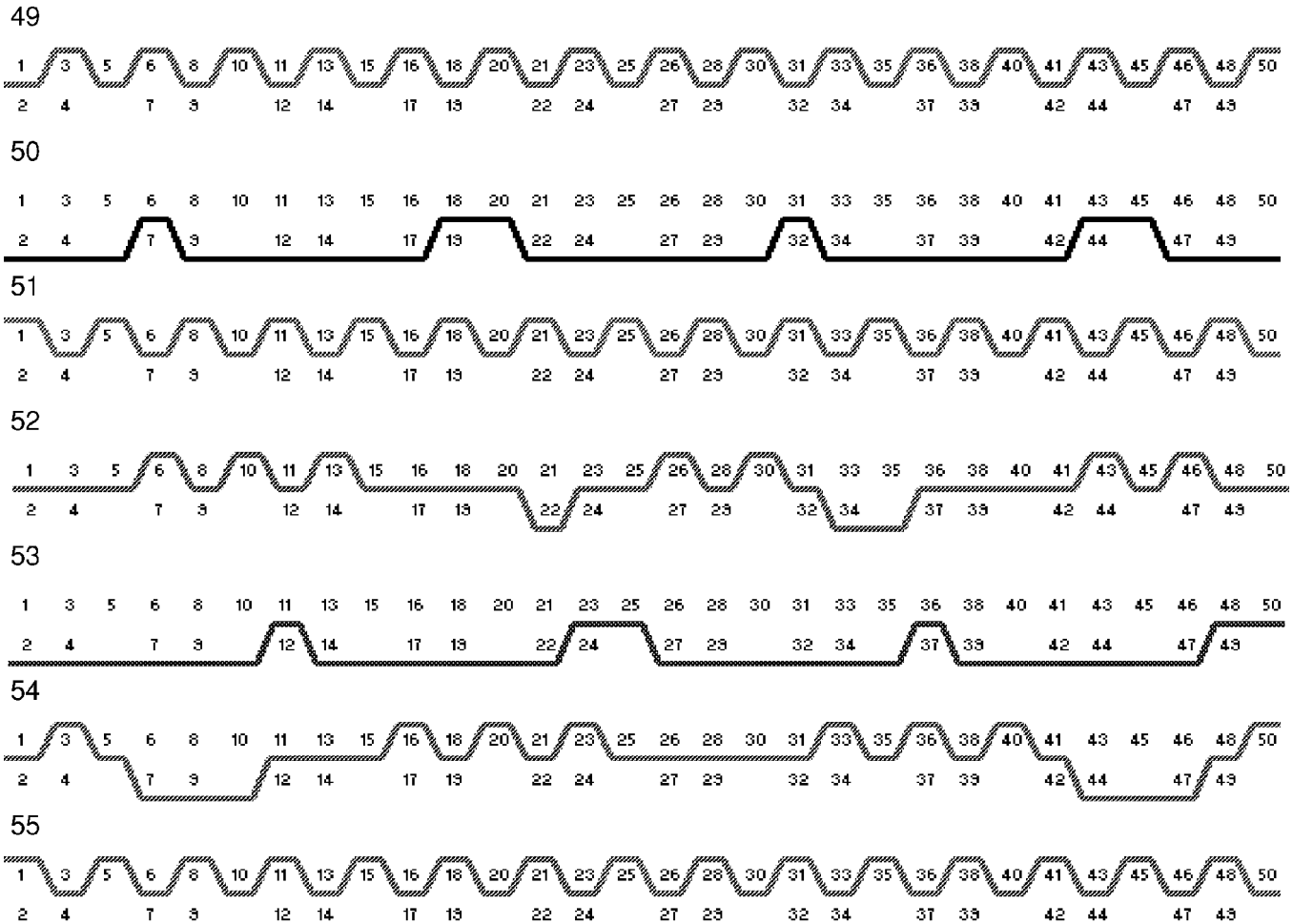
Figure 6I:
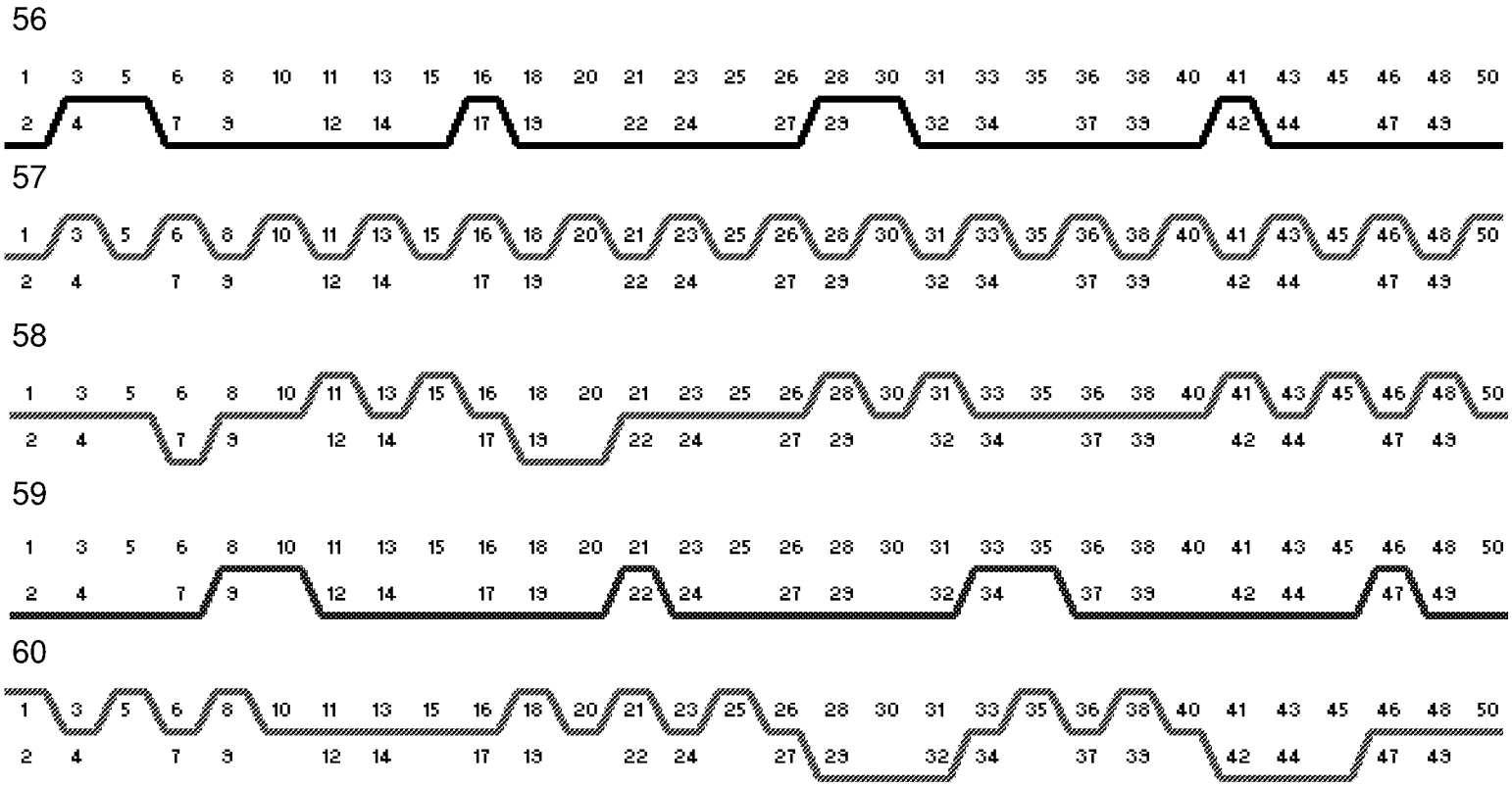

FIG. 3 illustrates the position of binding threads $S_1$ which create a particular binding thread pair i1, i2, . . . i19, i20 in the first fabric layer 114. One recognizes, for example, together with FIG. 1A-1D, that a binding segment $S_1$ is created on warp threads 3, 5, 6, 8 and 10 provided in first fabric layer 114 by the binding thread i1 which is highlighted in black in FIG. 3. This is followed by a changeover point W where the two binding threads of binding thread pair i1 and i2 cross each other, in this case under warp thread 11 of first fabric layer 114, whereby binding thread i2 which initially runs between the two fabric layers 114 and 116 then changes into first fabric layer 114 in order to form additional binding segments $S_1$ including warp threads 13, 15, and 16 of first fabric layer 114. At a changeover point W of this type which, in the aforementioned case is located underneath a warp thread which is integrated into first fabric layer 114, the two binding threads of a binding thread pair alternate in order to provide or respectively continue the weave pattern in the first fabric layer, whereby a binding thread which forms a binding segment $S_1$ in first fabric layer 114 terminates formation of a binding segment $S_1$ or respectively is drawn from first fabric layer 114 and is replaced by the other binding thread of the same binding thread pair crossing the initial binding thread and which then provides a binding segment $S_1$.

In FIG. 3 it can be seen that the changeover points W are arranged along changeover point diagonals $D_W$ or respectively $D_W'$. There are two different types of changeover point diagonals. Changeover point diagonals $D_W$ of a first type are formed by stringing together of changeover points W which do not interrupt the uniformity and extend in this great uniformity through the binding thread repeat illustrated in FIG. 3 or respectively continue over the adjacent binding thread repeats. The binding segment diagonals $D_W'$ of a second type feature strung together changeover points W, which are characterized by interruptions. In these diagonals $D_W'$ of the second type, changeover points are missing at changeover point-offset locations V. These are displaced in a longitudinal binding thread direction relative to offset changeover points $W_V$. Compared to the changeover point diagonals $D_W$ of the first type, formed by interruption-free sequence of changeover points W, changeover point diagonals $D_W'$ of the second type are provided here with a uniformity in the stringing together of changeover points W interrupted by changeover point offset locations V. In these changeover point diagonals $D_W'$ of the second type the changeover point offset locations V are hereby arranged in uniform sequence. The offset changeover points $W_V$ in a particular binding thread repeat are arranged in a uniform pattern—in the illustrated example also being sequential along a diagonal.

It is further shown in FIG. 3 that in one binding thread repeat several changeover point diagonals $D_W$ of the first type and $D_W'$ of the second type are provided and these different types of changeover point diagonals $D_W$ and $D_W'$ alternate with each other, in other words they also alternate in the uniform pattern.

Basically, with the sequence of changeover point diagonals $D_W$ and $D_W'$ illustrated in FIG. 3, a non-uniformity is overlaid in certain regions over a very uniform pattern which, in regard to the marking tendency of a thus produced fabric belt is advantageous. It is also advantageous—as can be clearly seen from a comparison with FIG. 2—that the changeover point diagonals $D_W$ and $D_W'$ in a particular binding thread repeat relative to the binding segment diagonals D extend in an angled fashion.

Figure 5:
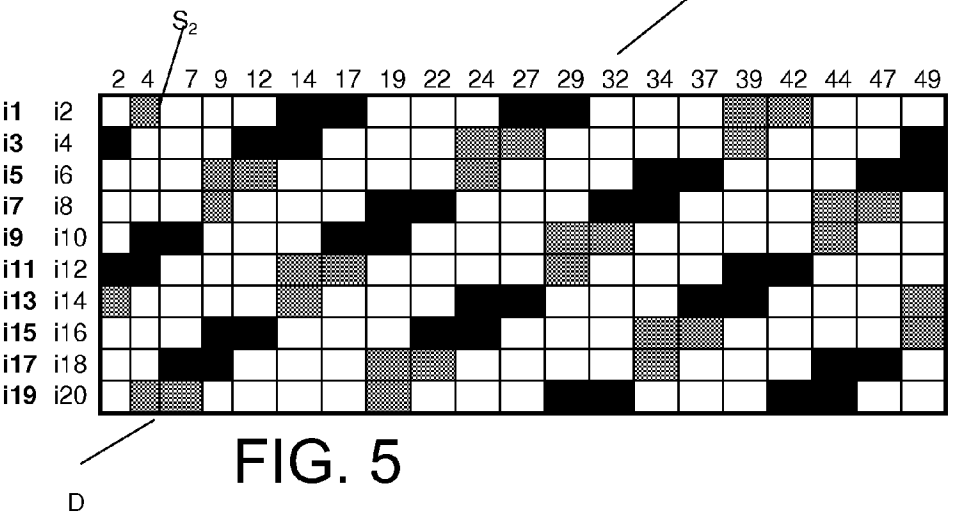
FIGS. 4A-4J and 5 illustrate an alternative design form of that shown according to FIGS. 1A-1D and 2.

A modified design form of a fabric belt or respectively a woven structure within a particular binding thread repeat is shown in FIGS. 4A-4J and 5. In regard to the basic design we refer to the above versions. In this case the binding threads of one particular binding thread pair which are allocated to each other and arranged adjacent to each other, for example binding threads i1 and i2 in first fabric layer 114 or second fabric layer 116 also create binding segments $S_1$ and $S_2$. In contrast to the previous design form it can be seen that, for example, with binding thread i1 on warp thread 4 binding threads $S_2$ are present which extend only over one single warp thread. This is also shown in FIG. 5 where it can be seen that on each binding thread pair in one binding thread repeat only always one binding segment $S_2$ comprising one warp thread is provided. Here, binding segments $S_2$ are also arranged along the binding segment diagonals. Since now also binding segments are present in these diagonals D which include only one warp thread, binding segments $S_2$ following each other in diagonals D do not always overlap around one warp thread. Nevertheless, a comparatively high uniformity is again created in that in the individual binding segment diagonals D, binding segments $S_2$ of various types alternate in uniform sequence. Binding segments of a different type are provided in this instance by binding segments which include a different number of warp threads. Binding segments of a different type could generally also differ from each other in the type and manner of connection to the warp threads. For example, binding segments of three warp threads could float above same, could however also tie off in accordance with a plain weave, over two warp threads which are separated by one of the warp threads.

FIGS. 6A-6I and 7 illustrate one design variation where in each binding thread pair the two binding threads, for example i1, and i2 are separated by one weft thread 20 in the basic weave of second fabric layer 116. In this design form, binding segments $S_2$ are also present in each binding thread pair in second fabric layer 116 which, in the illustrated binding thread repeat, includes only one warp thread. A total of two binding segments $S_2$ with one warp thread and two binding segments $S_2$ with two warp threads are present in each binding thread pair. Here, the binding thread of the one type always forms binding segments $S_2$ with two warp threads in one pair, whereas the binding thread of the other type forms binding segments $S_2$ with one warp thread.

Figure 7:
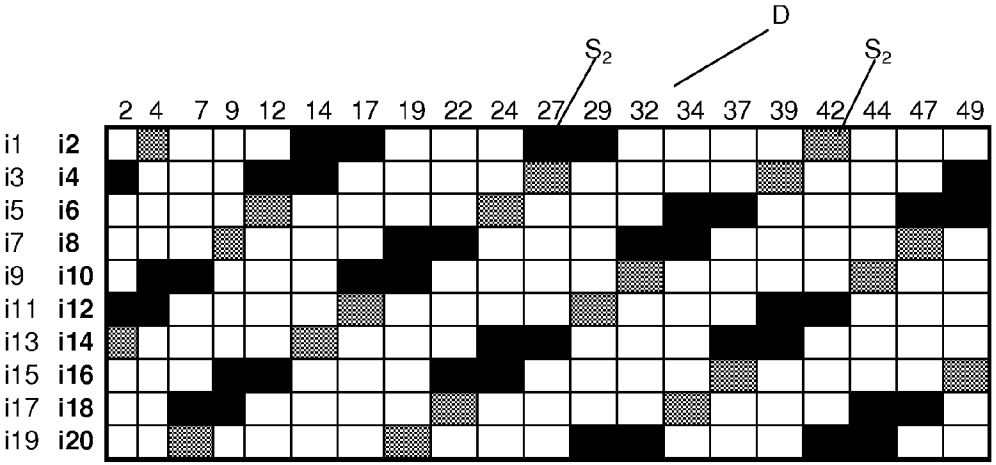
Figure 9:
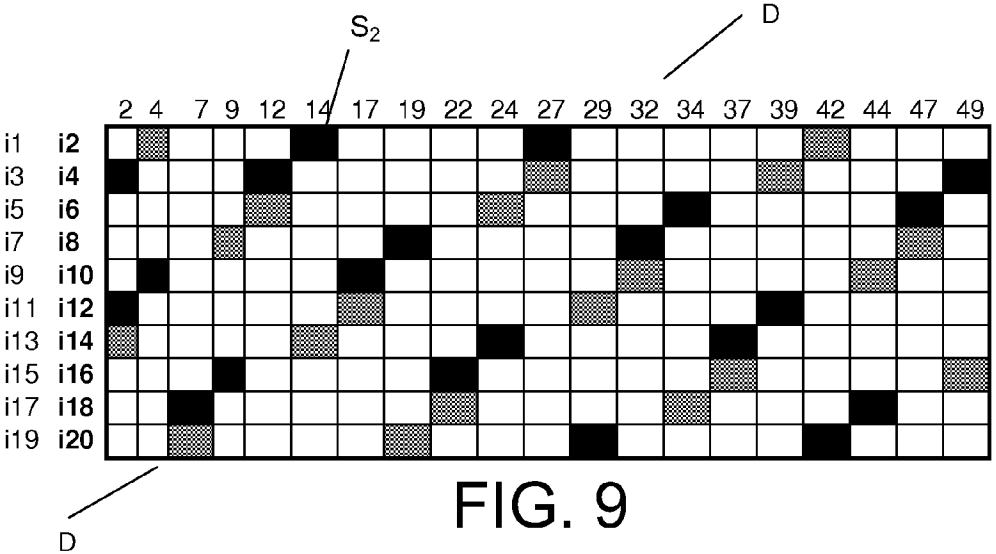
FIGS. 8A-8I and 9 illustrate an alternative design form of that shown according to FIGS. 1A-1D and 2.
Figure 8A:
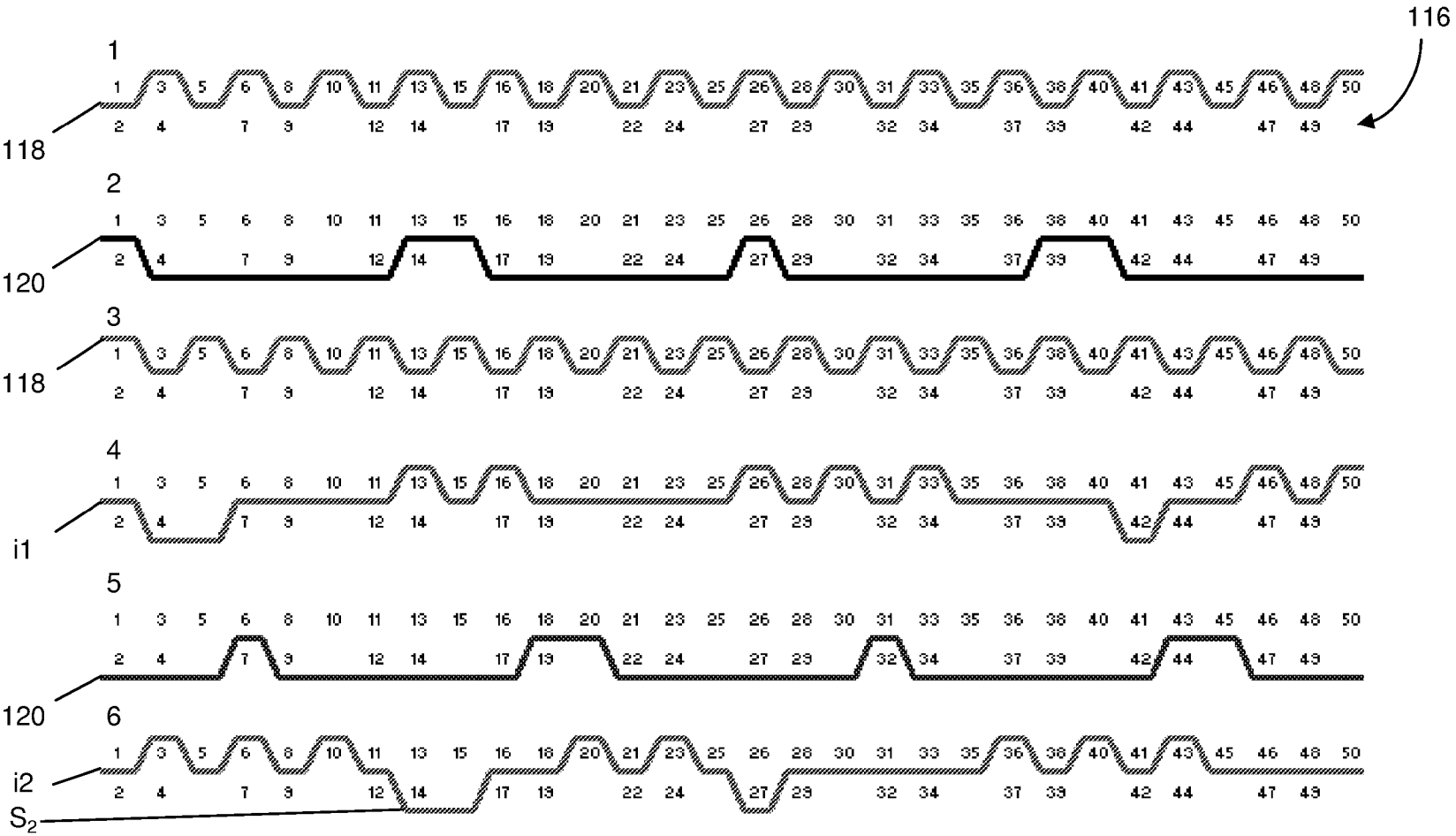
Figure 8B:
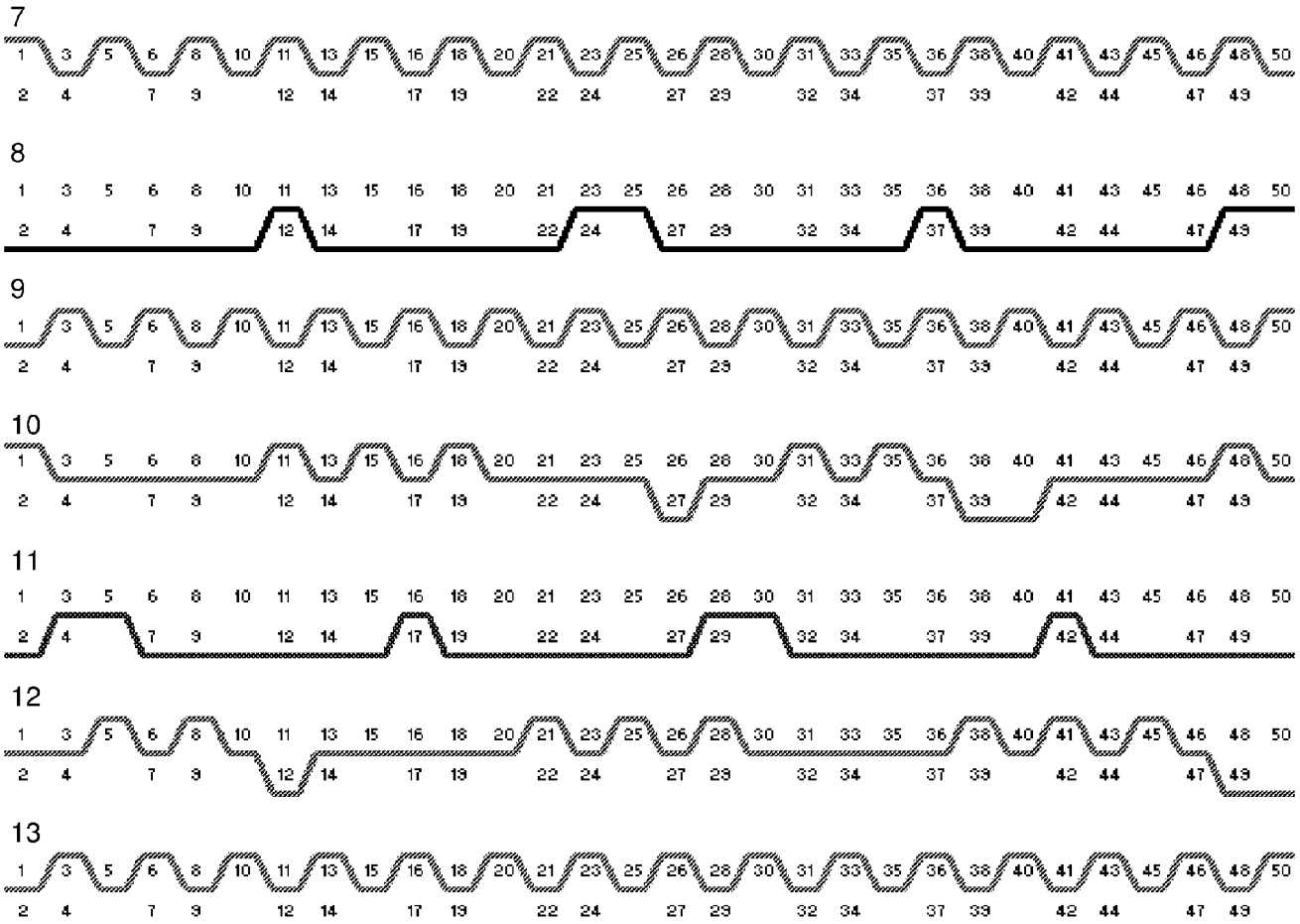
Figure 8C:
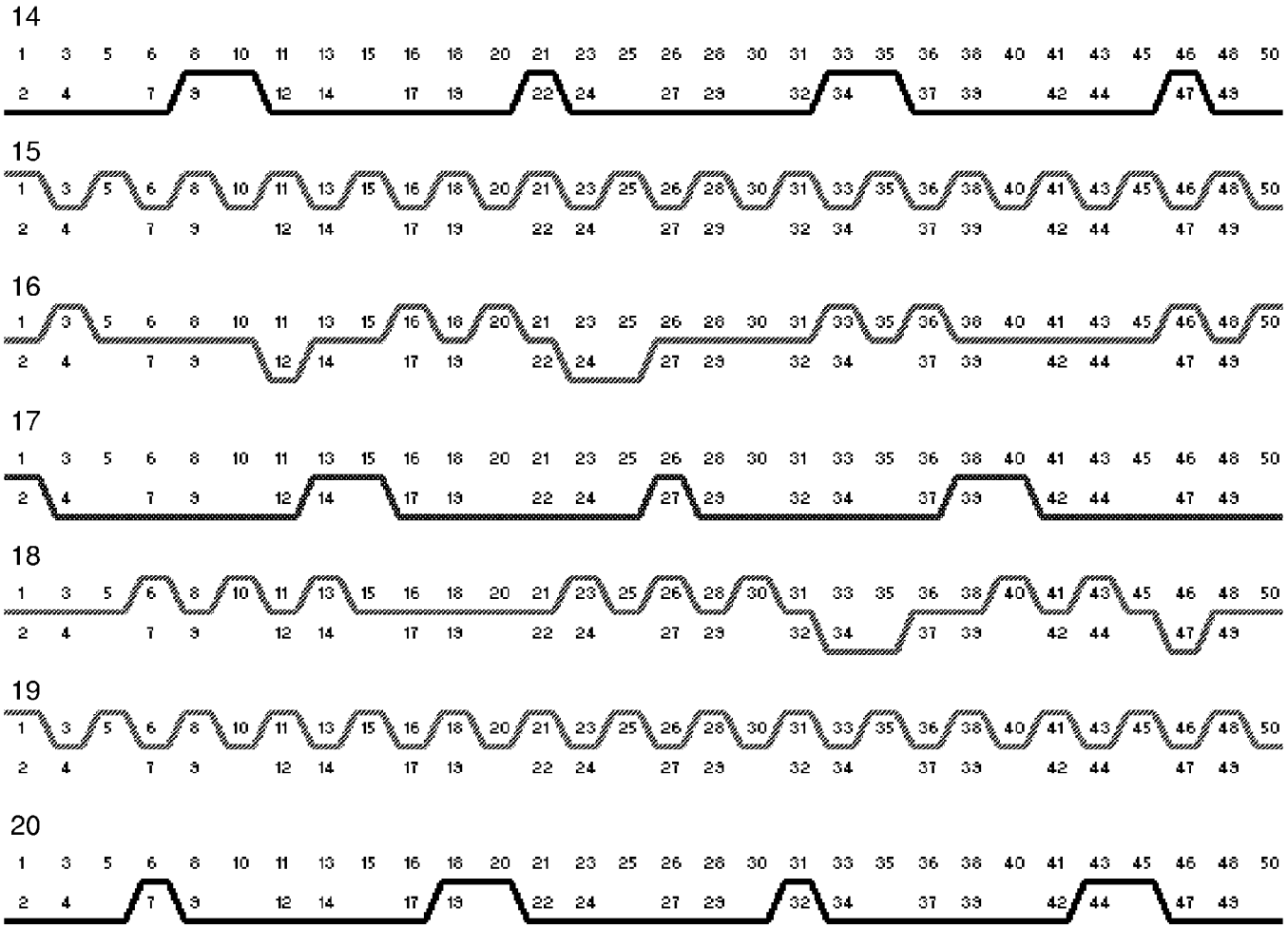
Figure 8D:
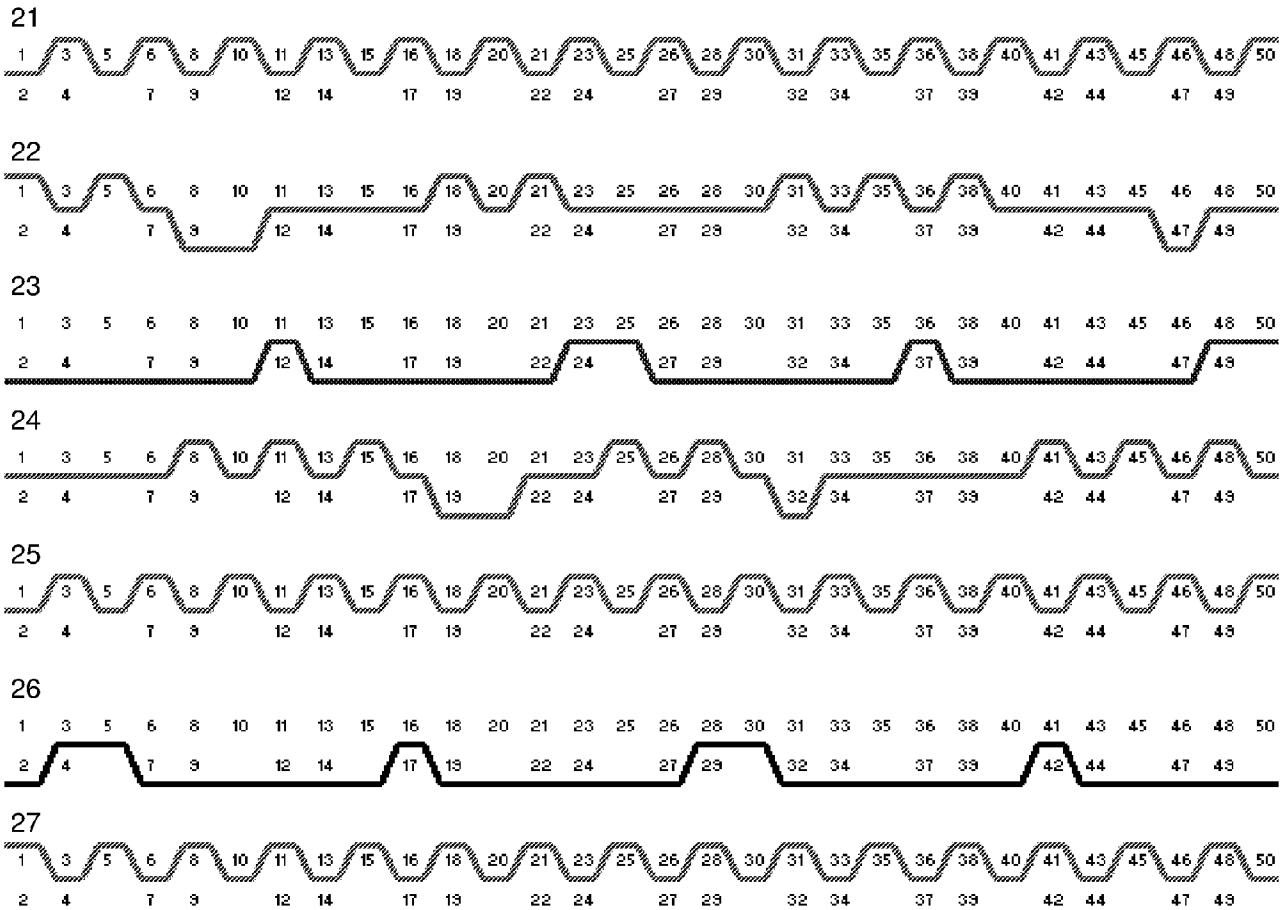
Figure 8E:
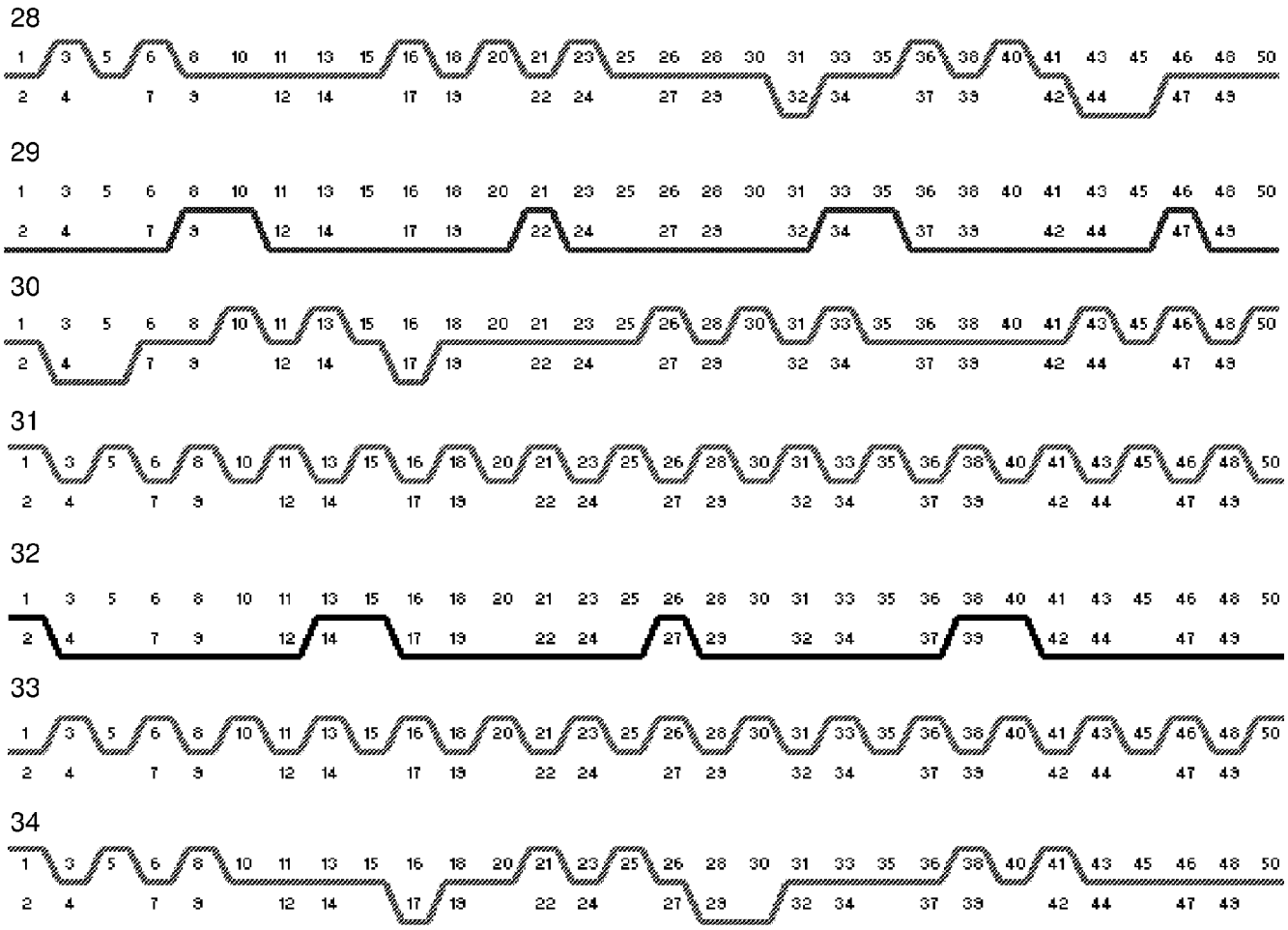
Figure 8F:
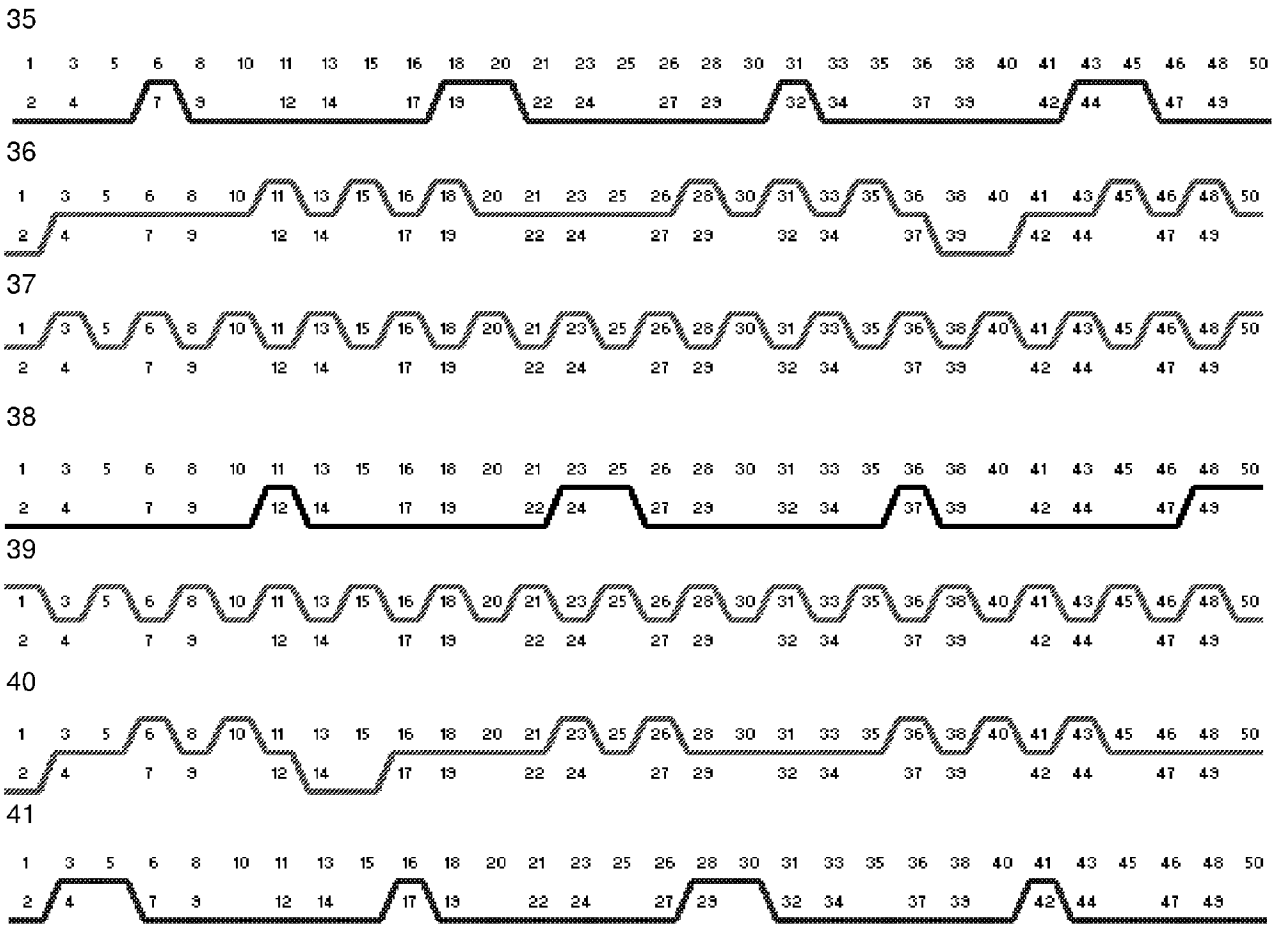
Figure 8G:
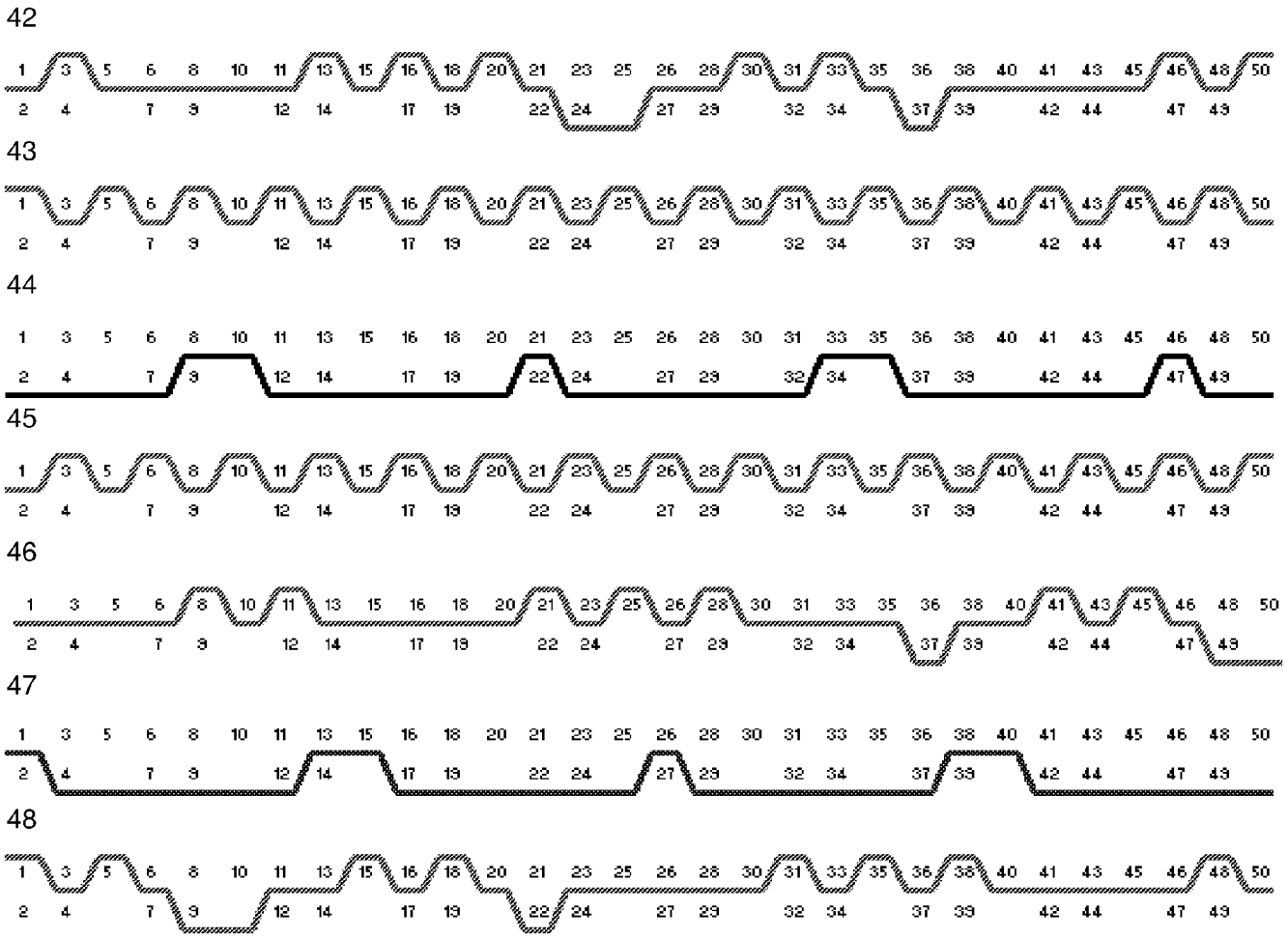
Figure 8H:
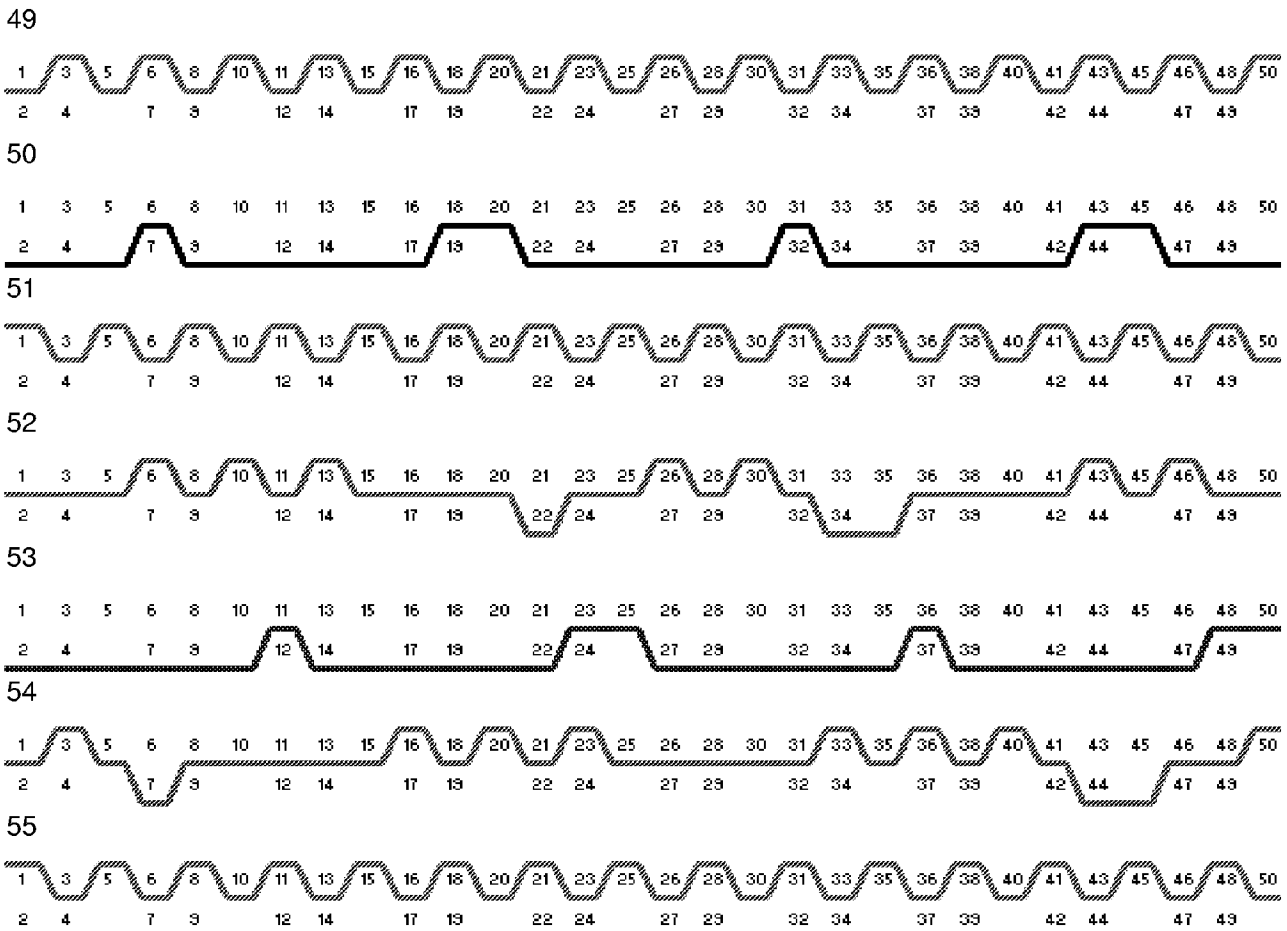
Figure 8I:
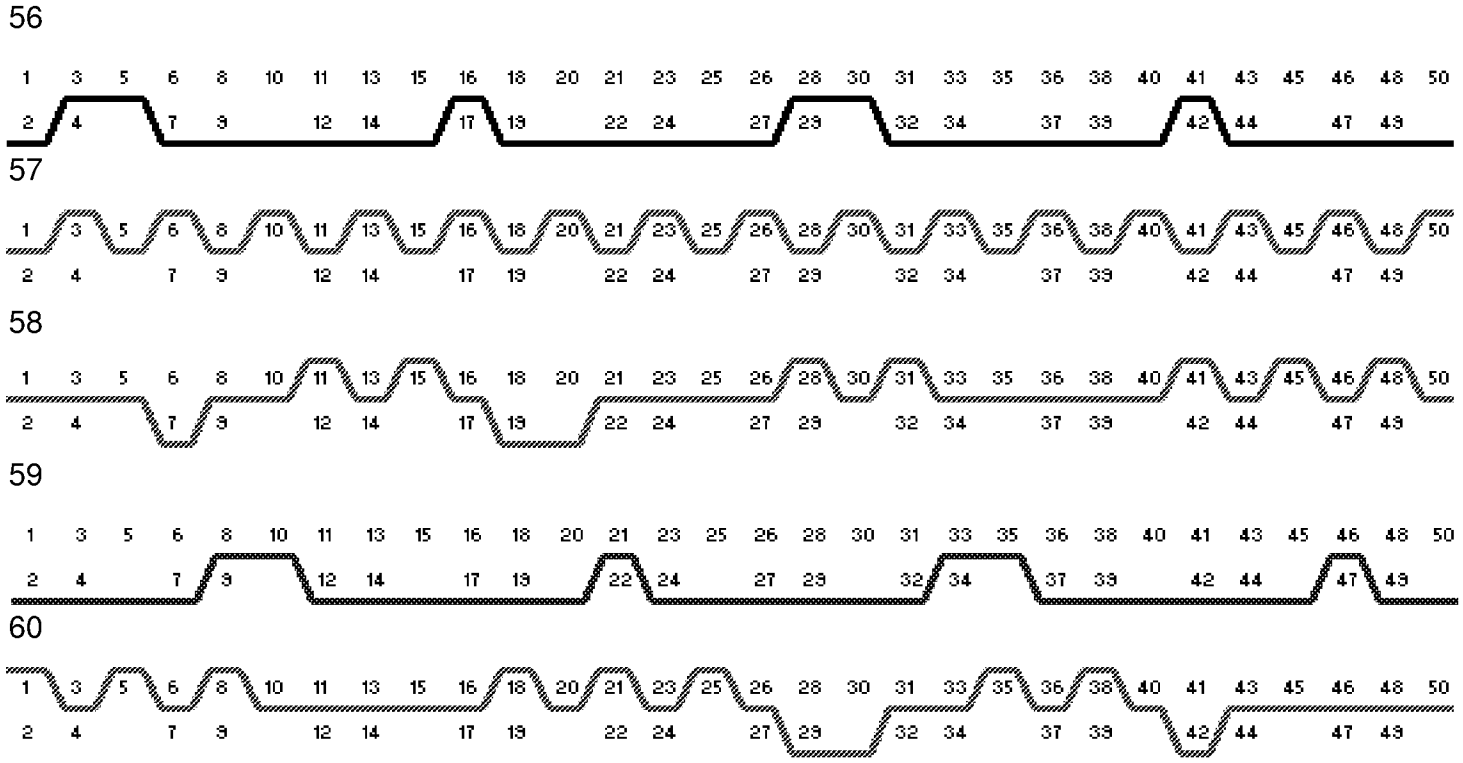
Figure 10A:
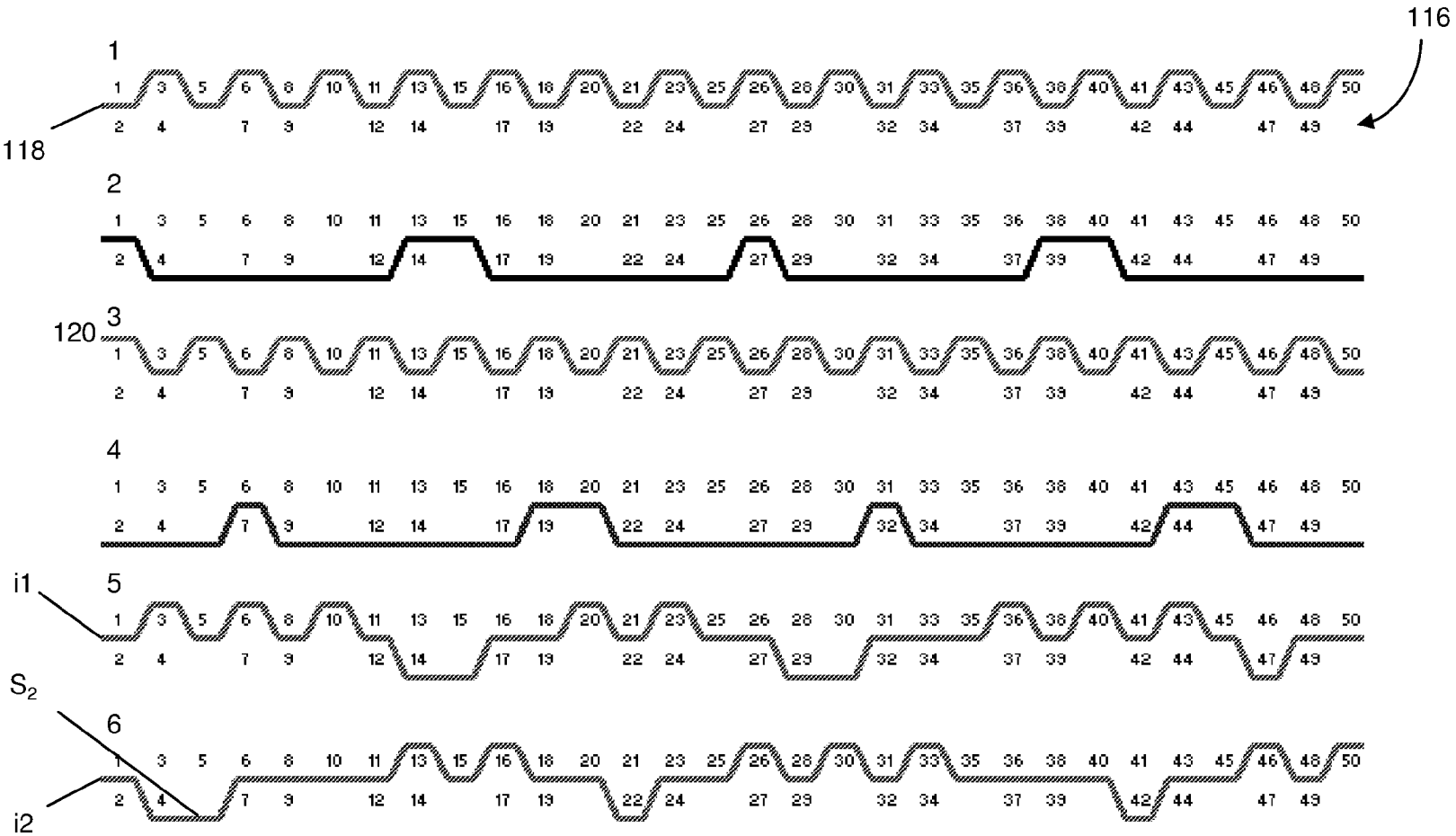
FIGS. 10A-10I and 11 illustrate an alternative design form of that shown according to FIGS. 1A-1D and 2.
Figure 10B:
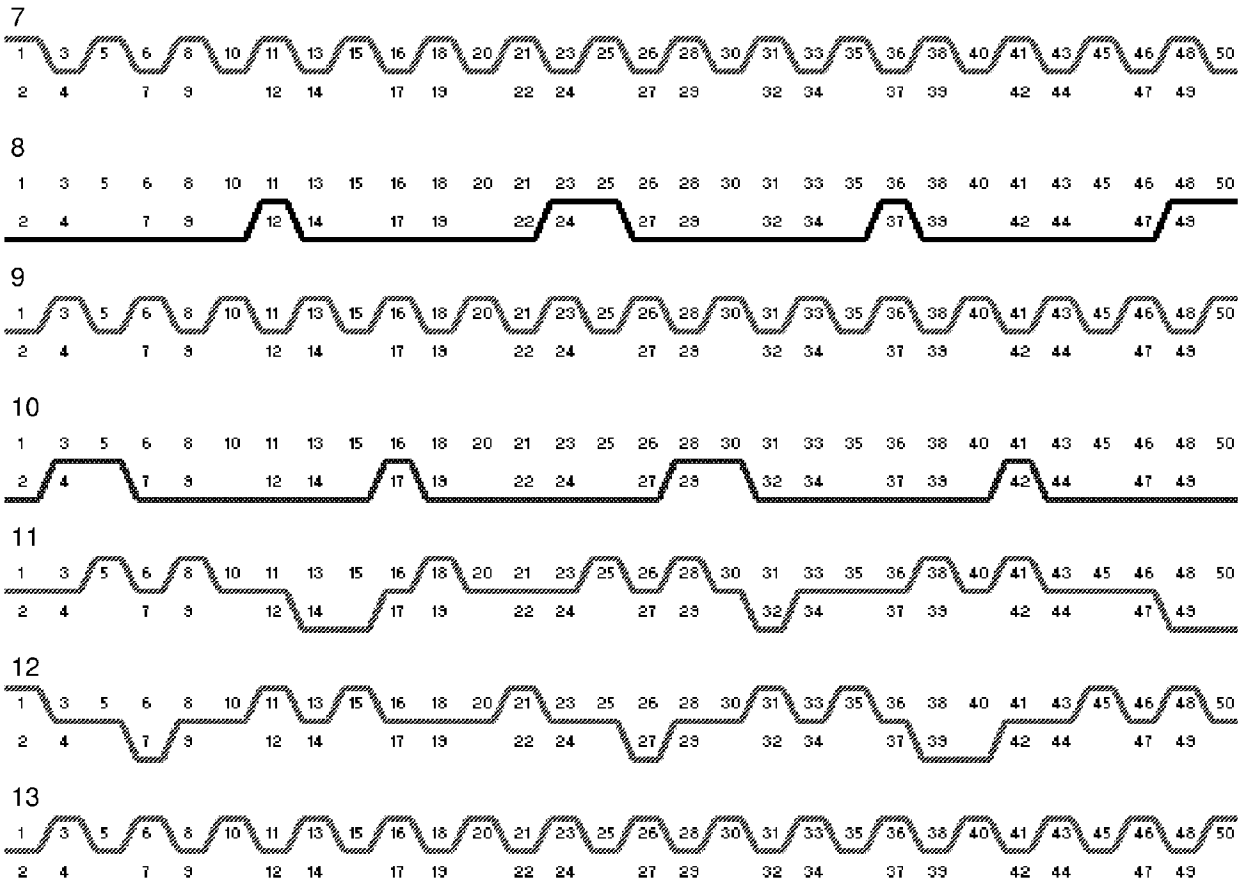
Figure 10C:
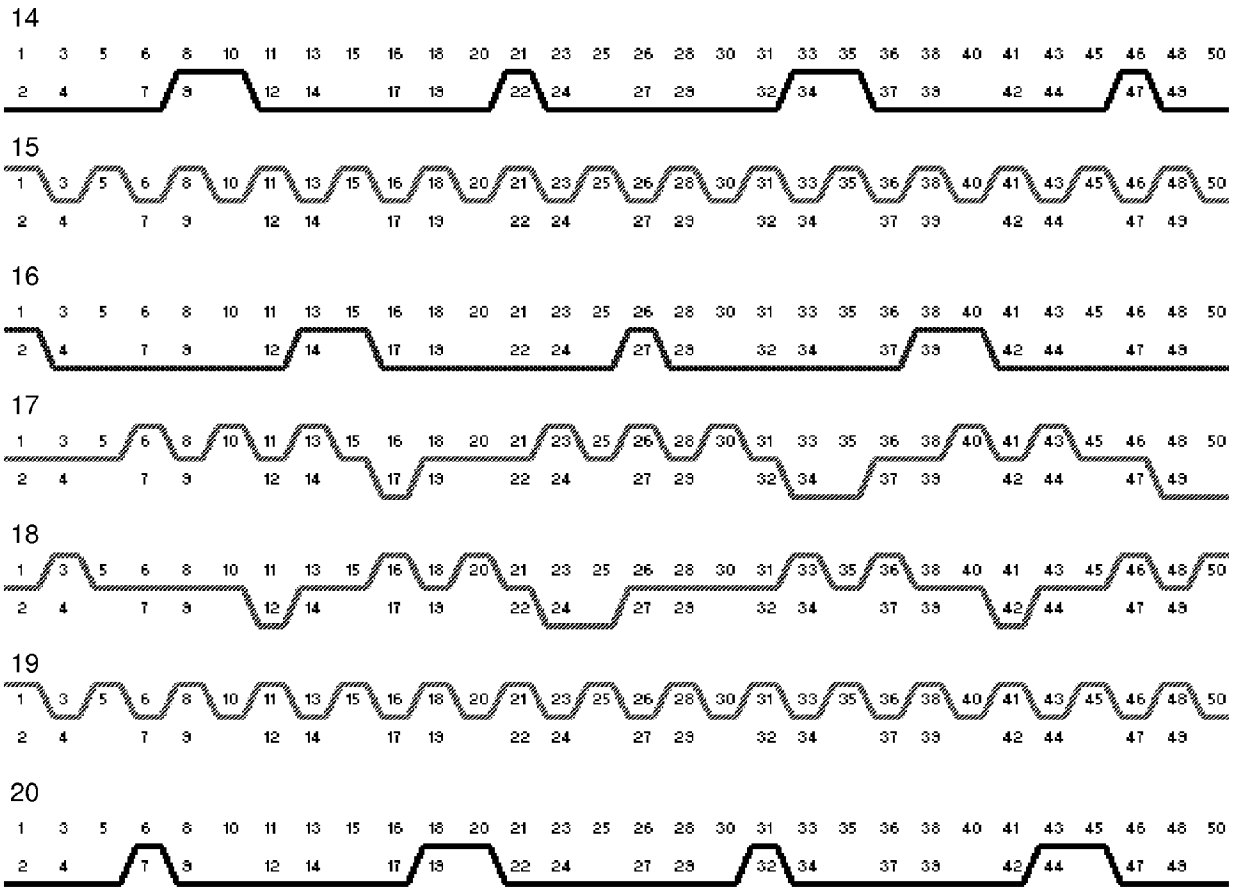
Figure 10D:
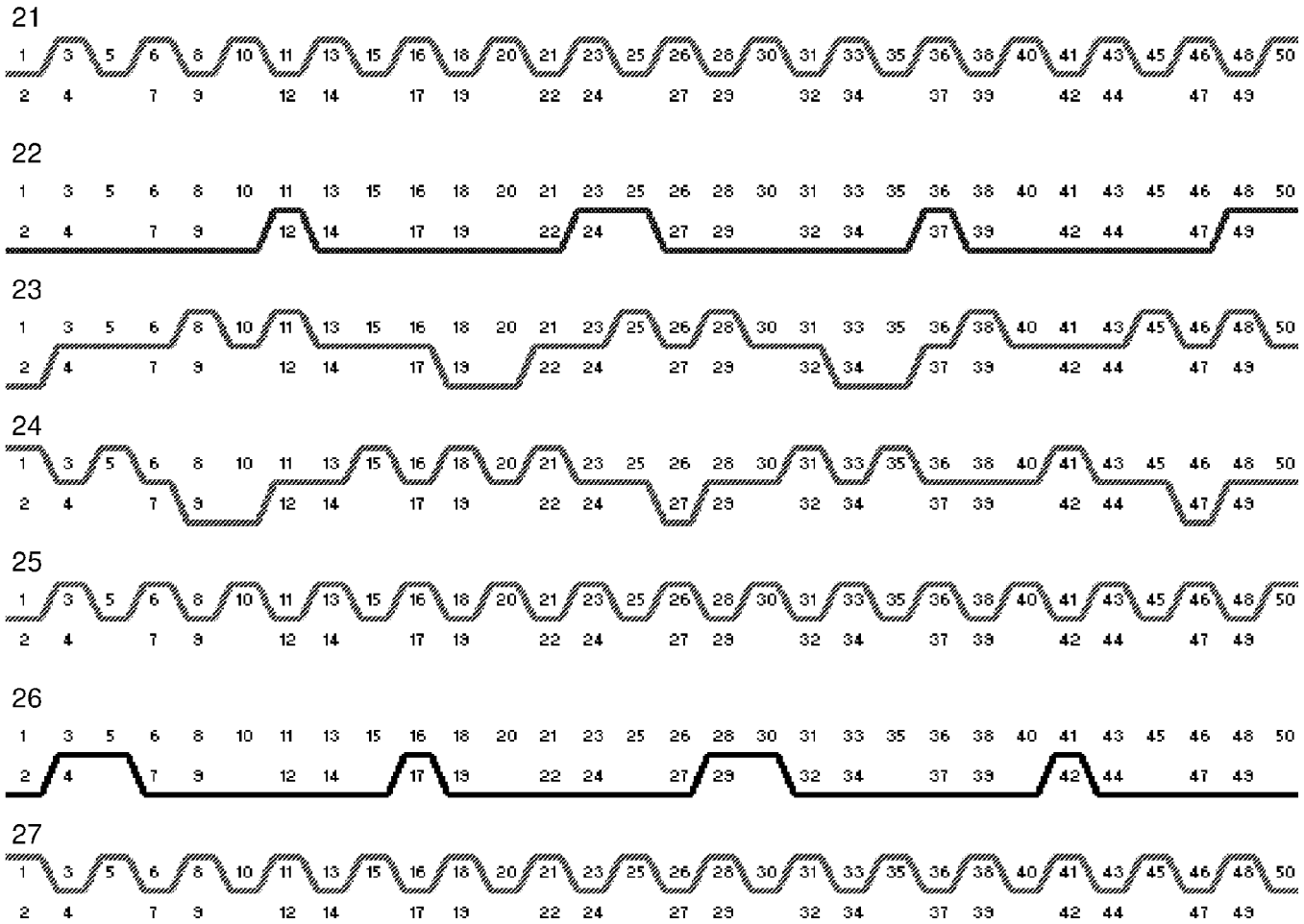
Figure 10E:
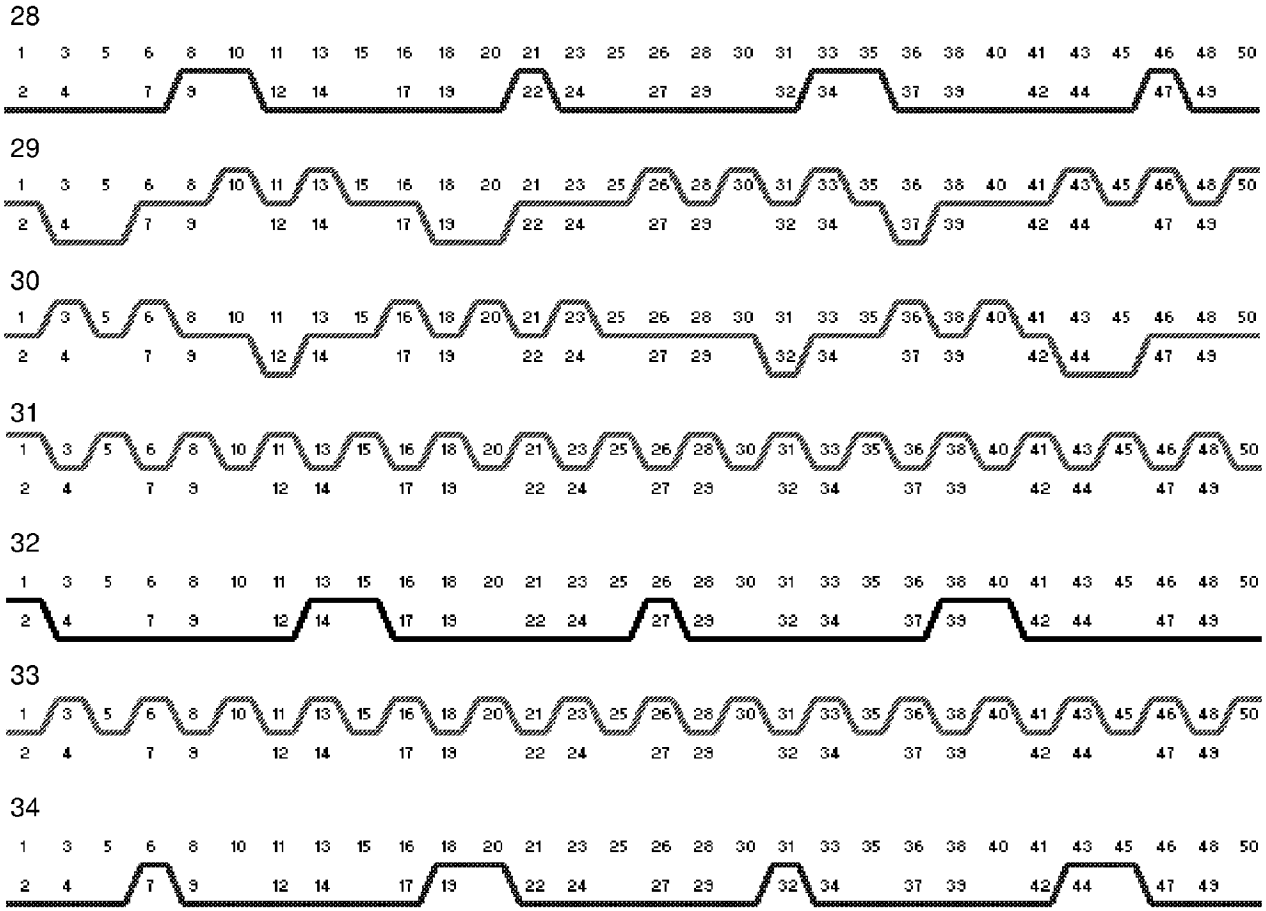
Figure 10F:
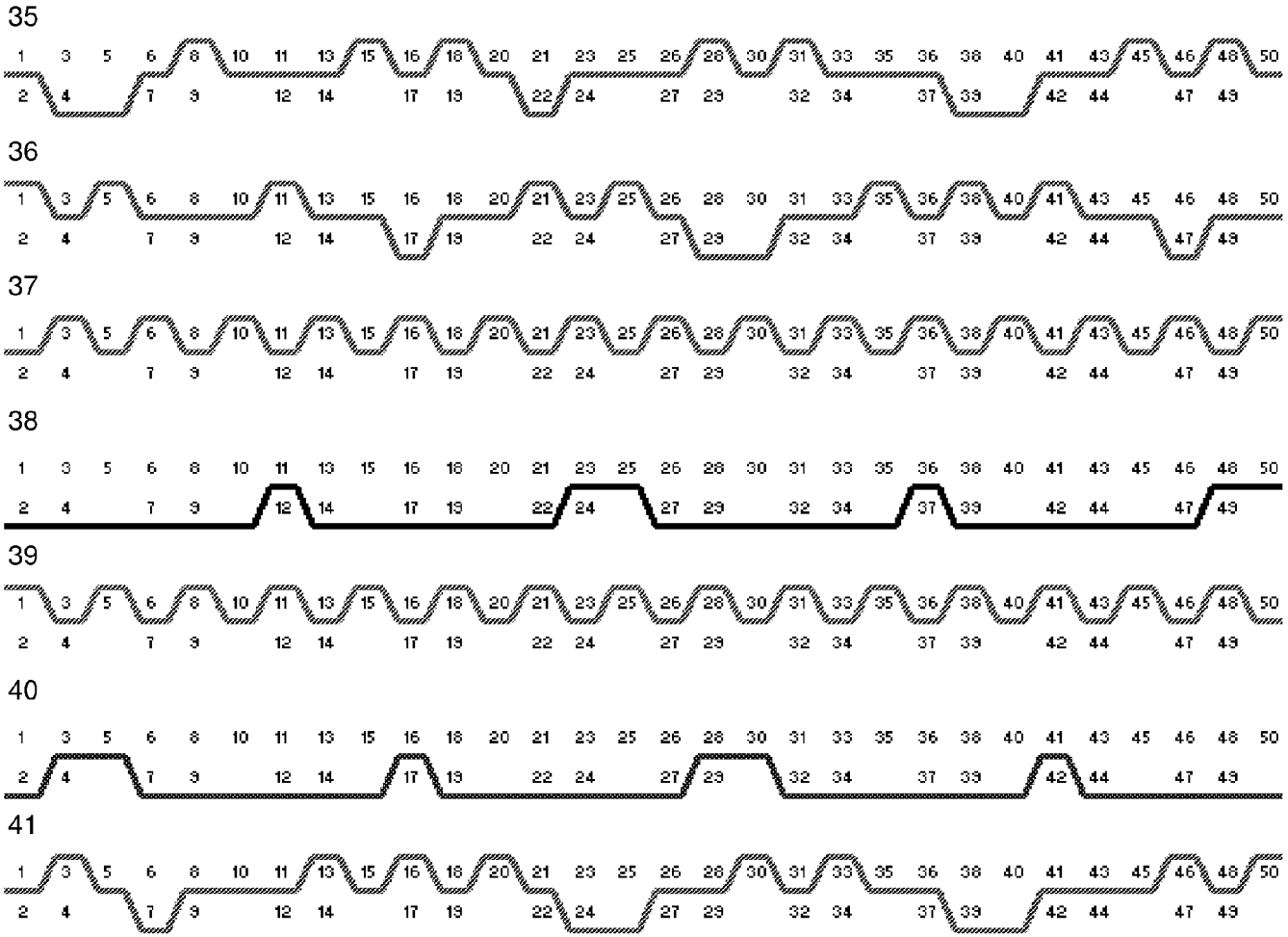
Figure 10G:
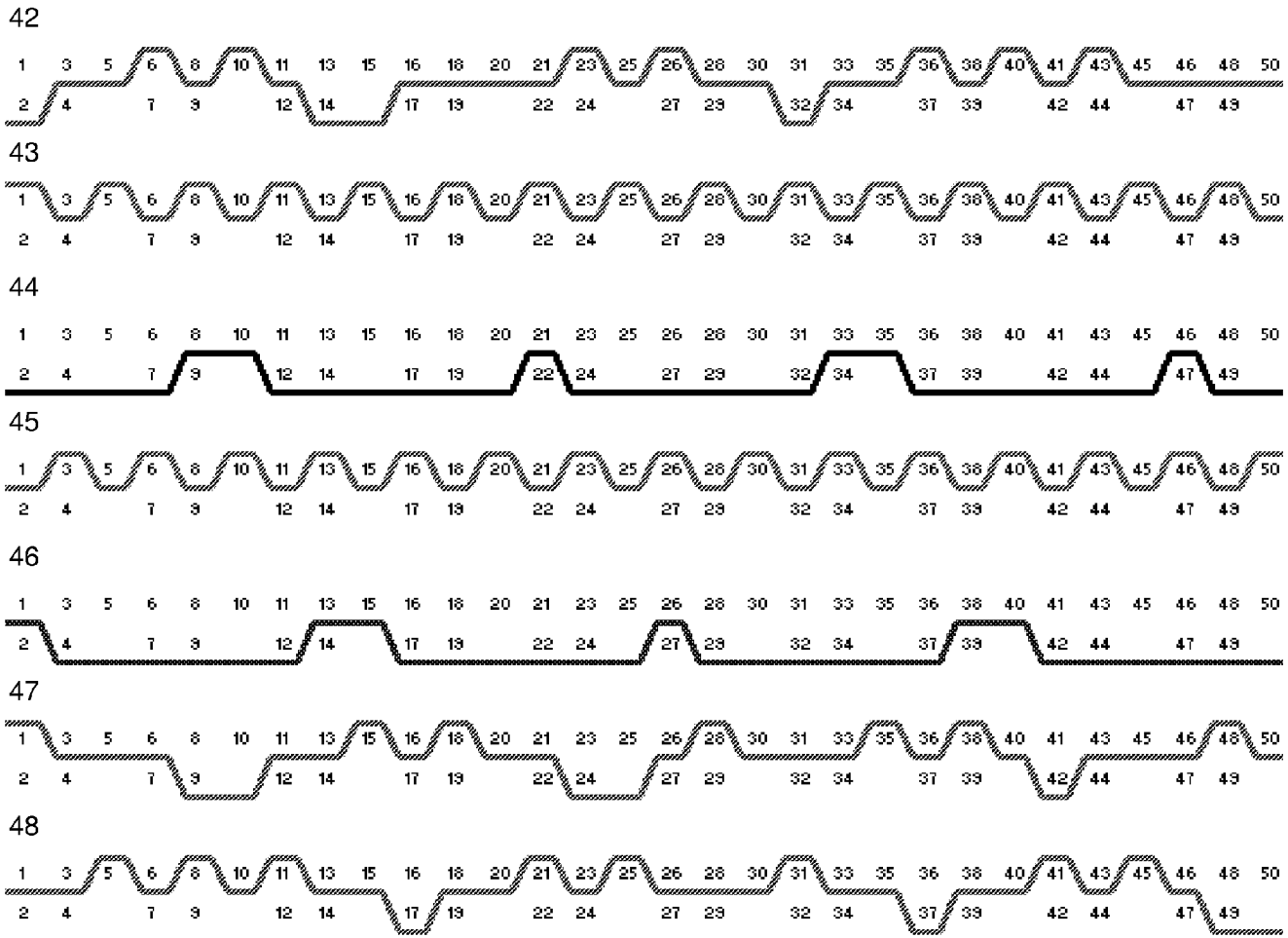
Figure 10H:
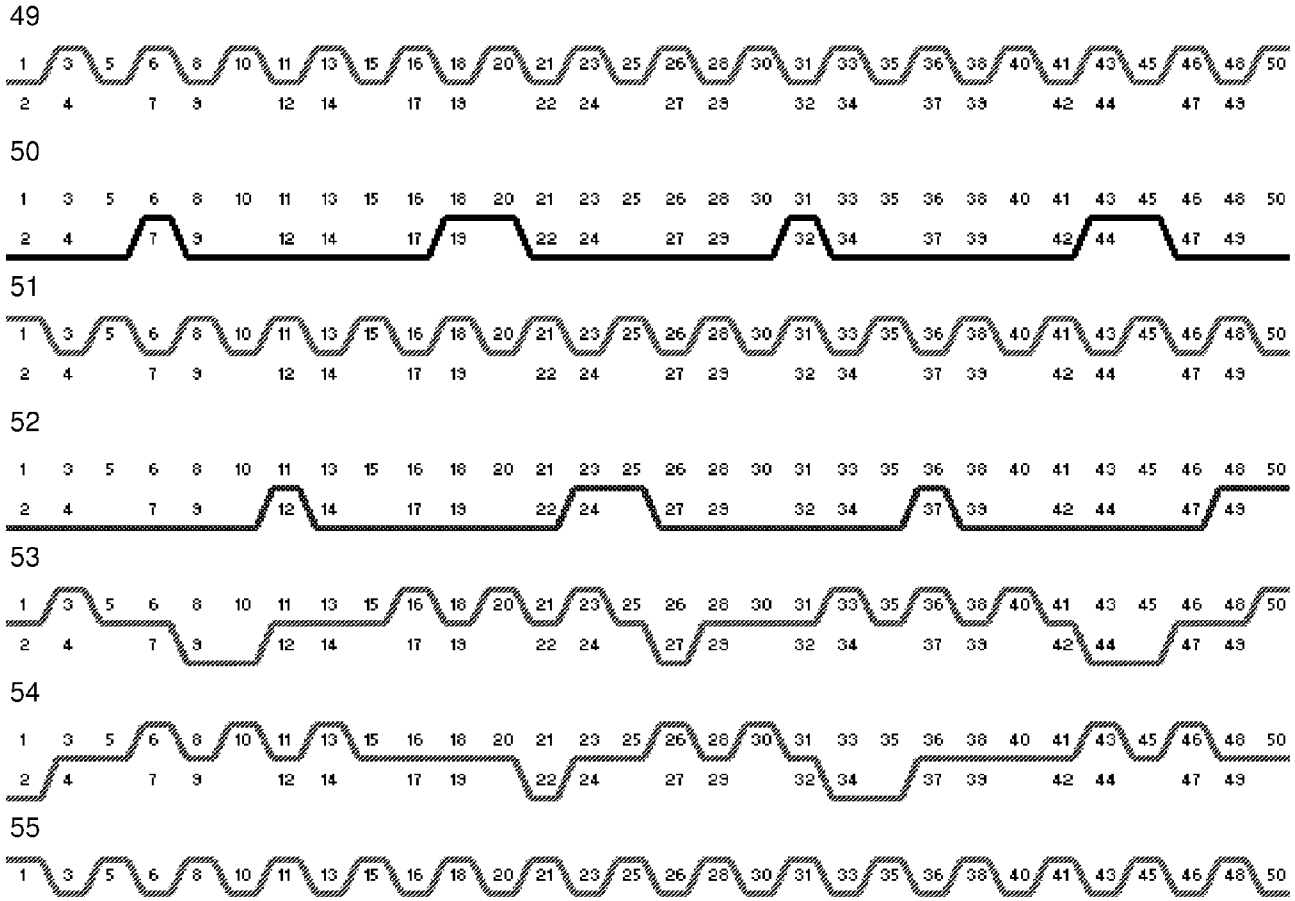
Figure 10I:
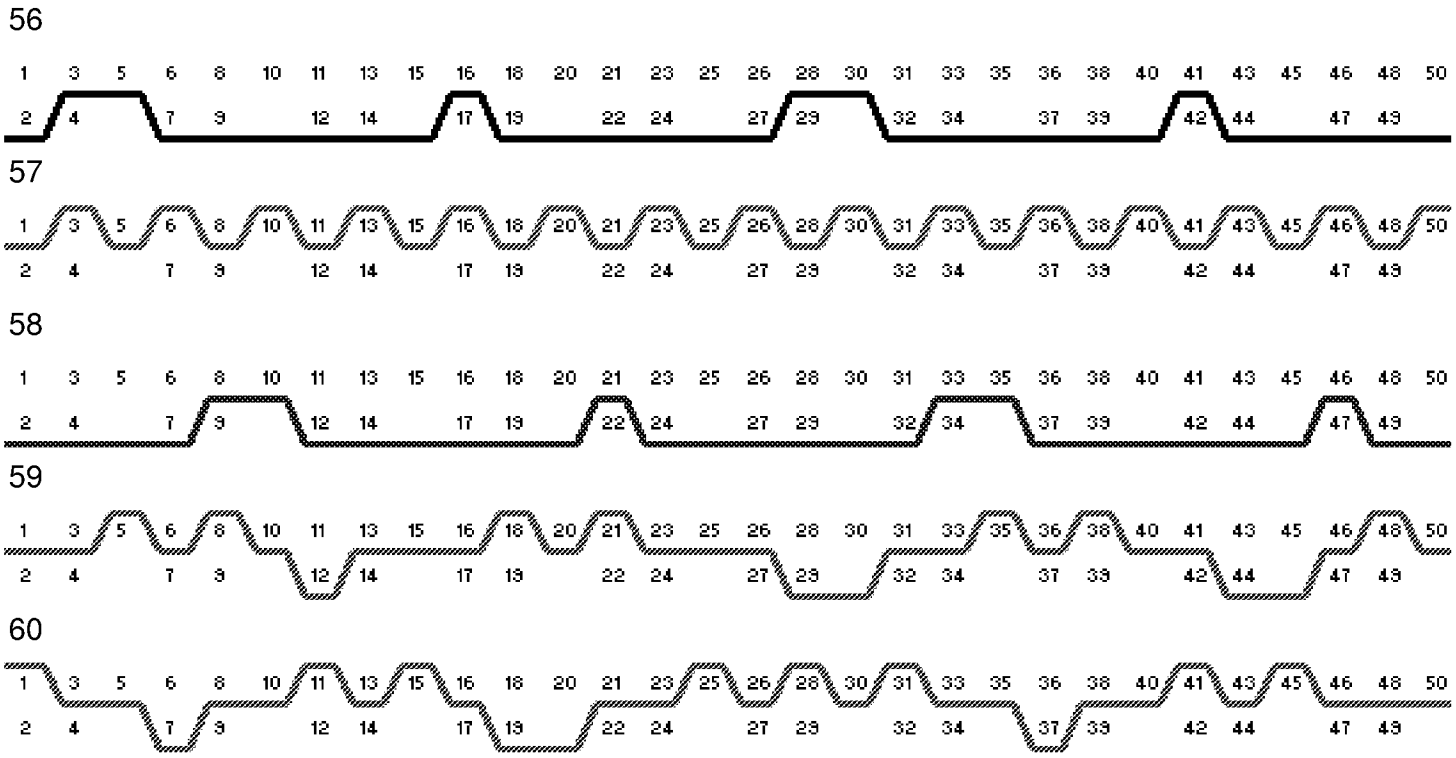
Figure 11:
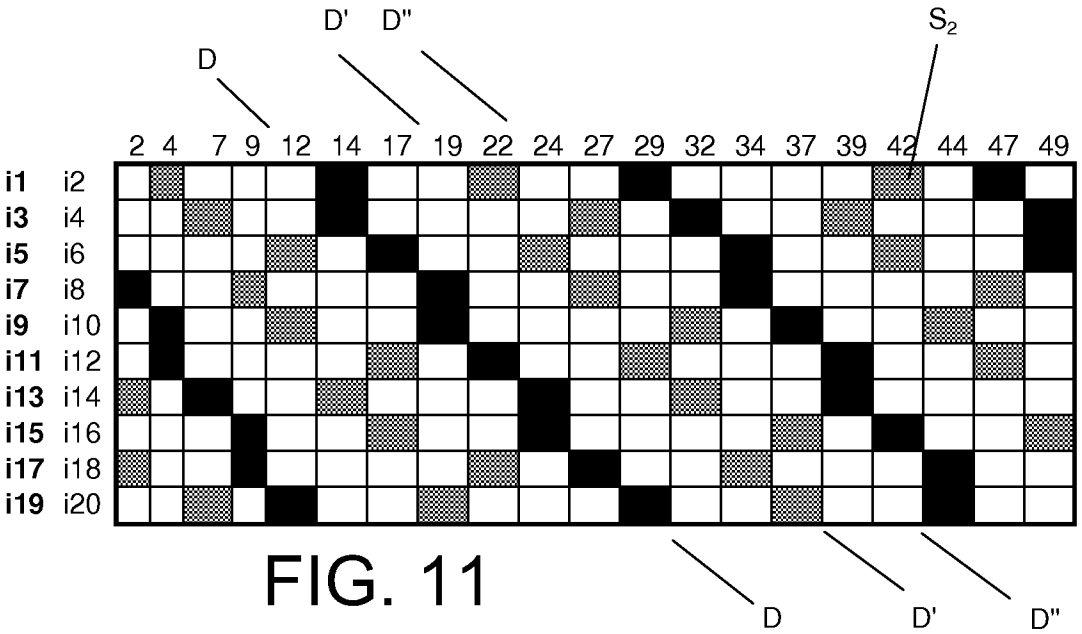

As can be clearly seen in FIG. 7 a uniform sequence of the binding segments of a different type is again provided in the individual binding segment diagonals D, whereby always two binding segments of the one type, in other words two binding segments having two warp threads follow two binding segments of the other type, in other words two binding segments having one warp thread.

In the design variation illustrated in FIGS. 8A-8I and 9 the two binding threads of a particular binding thread pair are again separated by a weft thread 20 in the basic weave of the second fabric layer. Here, binding segments $S_2$ formed in second fabric layer 116 always include only one single warp thread which can also be seen clearly in FIG. 9. Binding segments $S_2$ are arranged along the binding segment diagonal D, whereby in this case always groups of four binding segments $S_2$ are present in diagonals D, whereby the binding segments are respectively separated from each other by a warp thread on which then, on a respective diagonal, no binding segment is formed. The individual groups of four respectively extend over three warp threads, whereby the two center binding segments in a particular group of four are formed on the same warp thread. Here too, a comparatively high uniformity is therefore ensured within the binding segment diagonals due to a distribution pattern continuing along diagonals D Like in the previously addressed embodiments, the progression of the binding segments $S_2$ in the individual diagonal is always the same, so that also the individual diagonals D resemble each other in regard to the arrangement or distribution of binding segments $S_2$ therein.

In the embodiments illustrated in FIGS. 4A-4J, 5 through 8A-8I, 9 the progression or arrangement of binding segments $S_1$ in the first, paper side fabric layer 114 is consistent with the arrangement as illustrated previously in regard to FIG. 3. Here too, the changeover points of the paired binding threads are arranged along the changeover point diagonals of a different type, as can also be seen in FIG. 3.

FIGS. 10A-10I and 11 illustrate an embodiment of the present invention in which the directly adjacently located binding threads of a particular binding thread pair form segments $S_2$, always with one warp thread, in second fabric layer 116. Binding segments $S_2$ are arranged along binding segment diagonal D, whereby there are three diagonals D, D' and D" of a different type in this case. A uniform distribution of binding segments $S_2$ exists in the respective diagonals D, D' and D". For example, in diagonal D a sequence of respectively individually arranged binding segments and two binding segments arranged immediately adjacent to each other in the warp direction exists. In diagonal D' there are always groups of two binding segments $S_2$ which are separated respectively in the warp direction by another binding thread pair. In diagonal D" individually arranged binding segments $S_2$ are present which are respectively separated by one warp thread and two binding thread pairs. Even though a somewhat greater non-uniformity exists here since there are several different types of diagonals in one binding thread repeat, a comparatively great uniformity within the individual diagonals D, D' and D" is again ensured.

Figure 12:
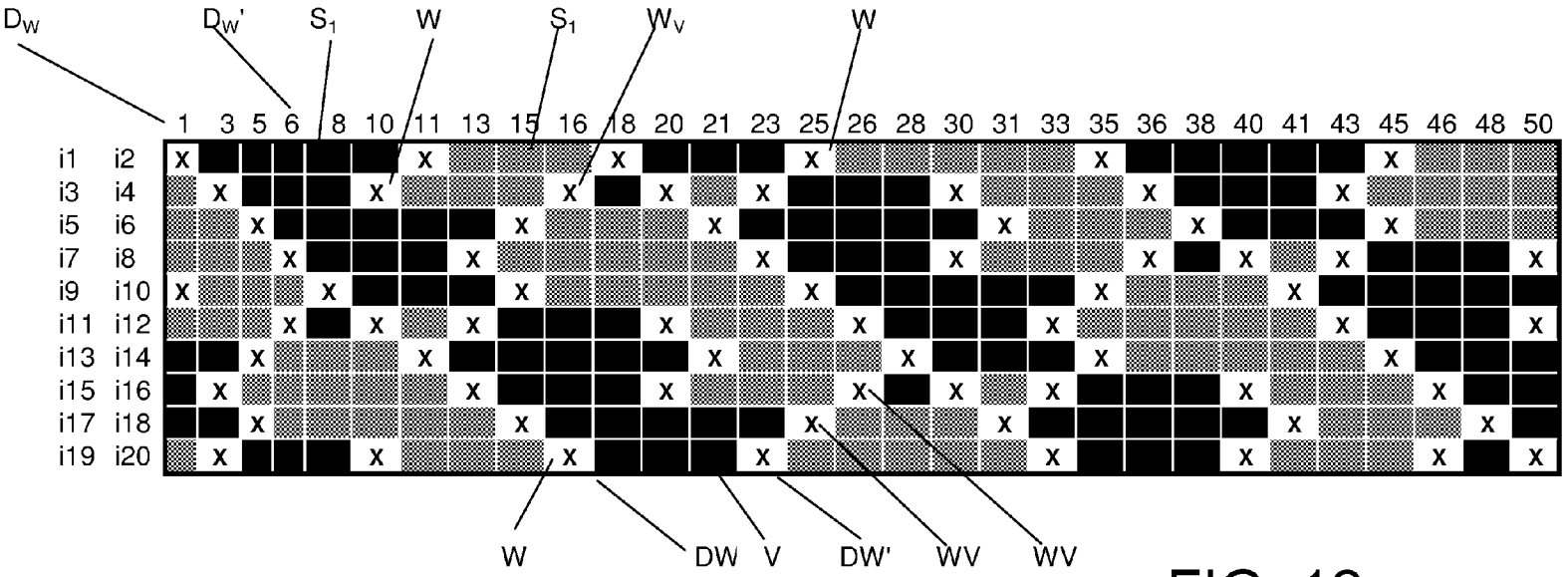
FIG. 12 illustrates the arrangement of binding segments in a paper side fabric layer and the changeover points created between such binding segments for the binding pattern illustrated in FIGS. 10A-10I and 11.
Figure 13A:
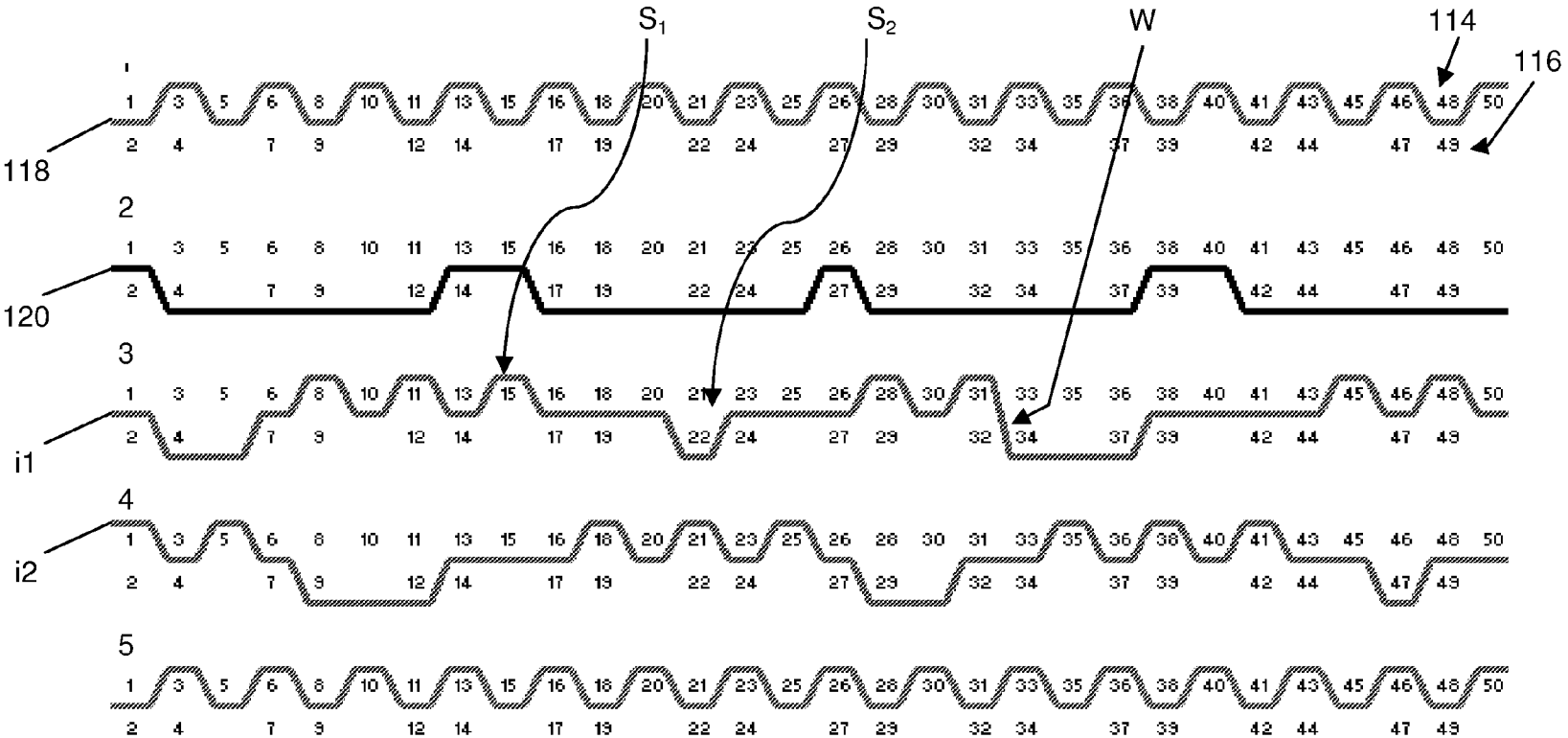
FIGS. 13A-13G and 14 illustrate an alternative design form of that shown according to FIGS. 1A-1D and 2.
Figure 13B:
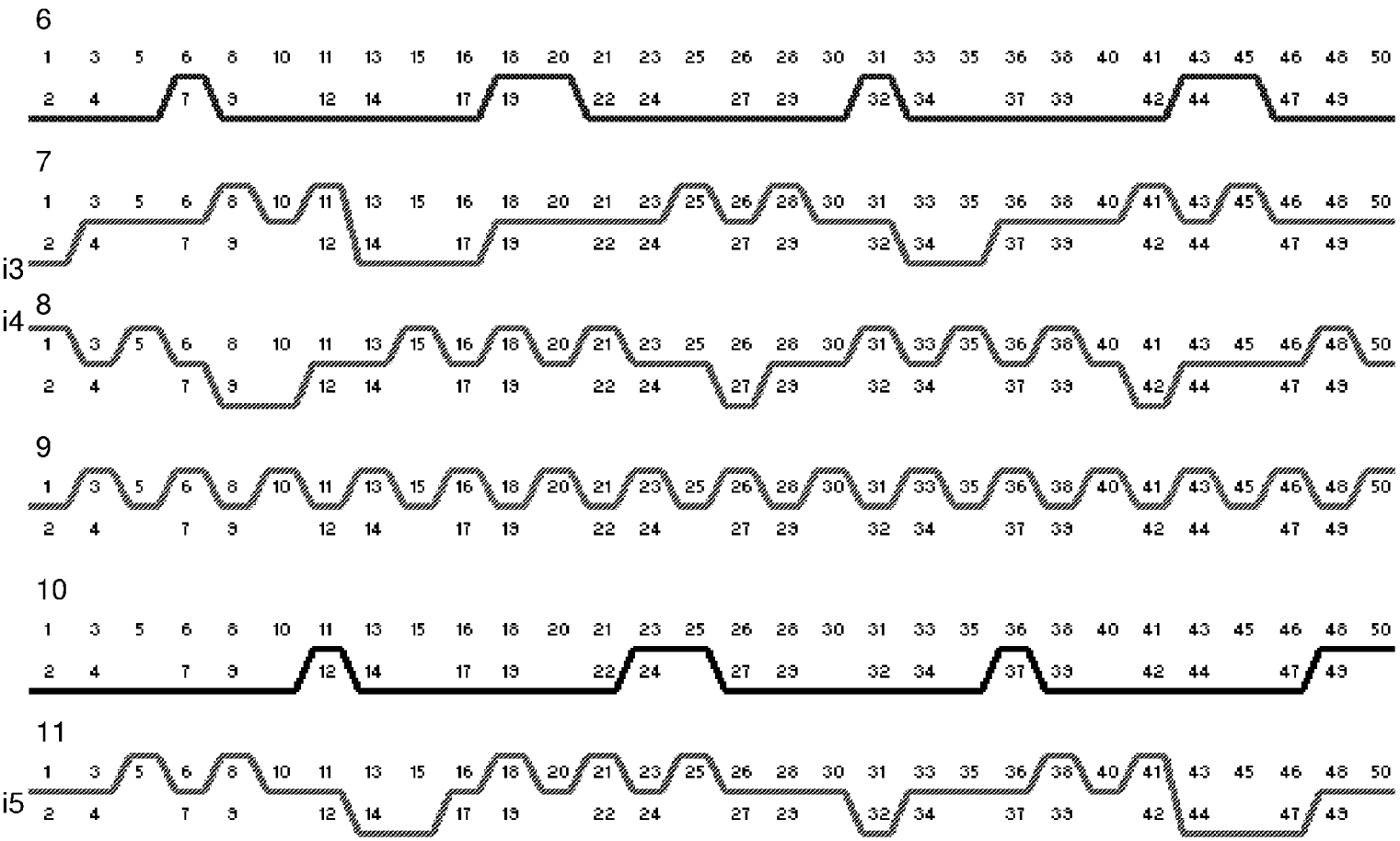
Figure 13C:
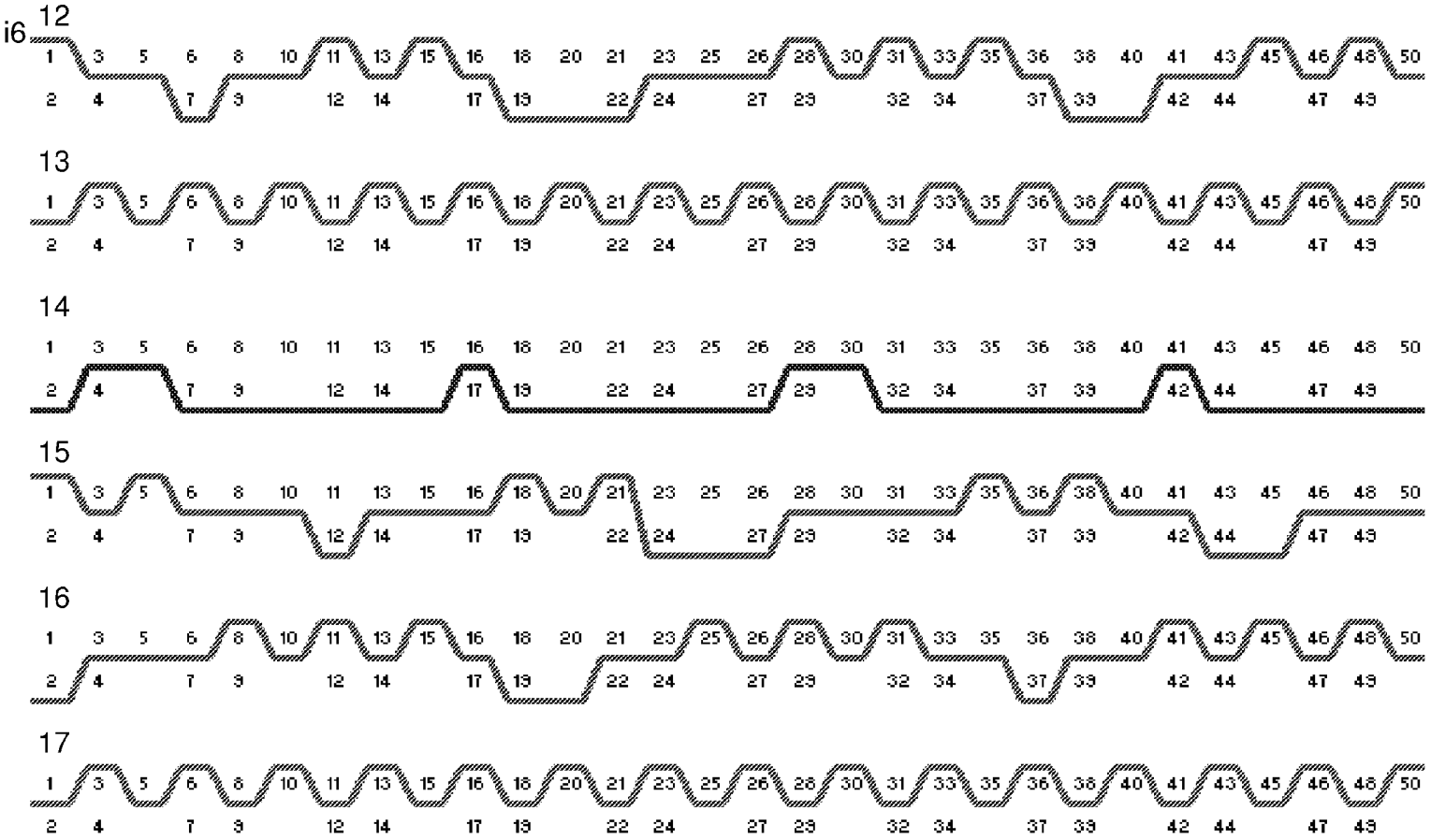
Figure 13D:
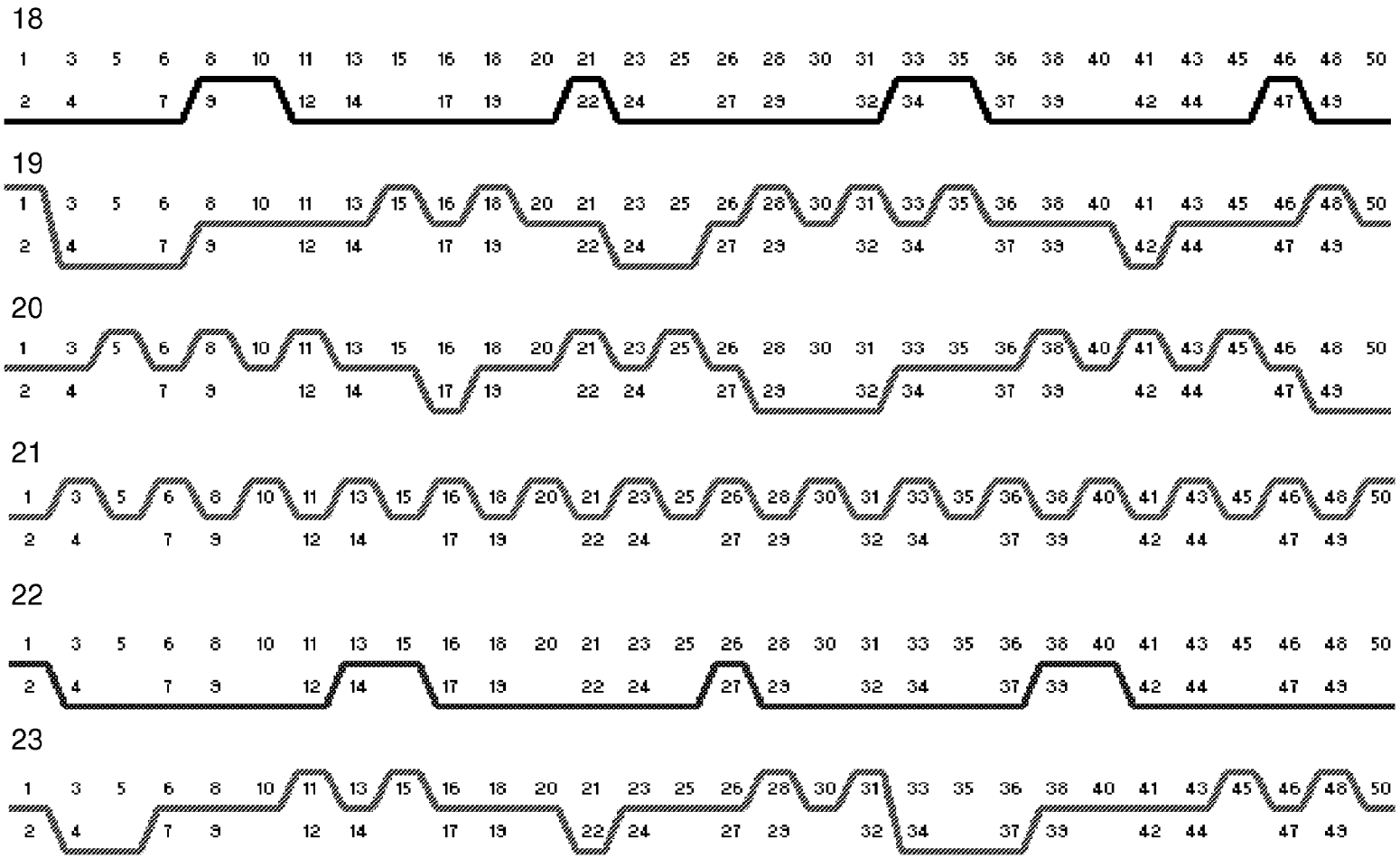
Figure 13E:
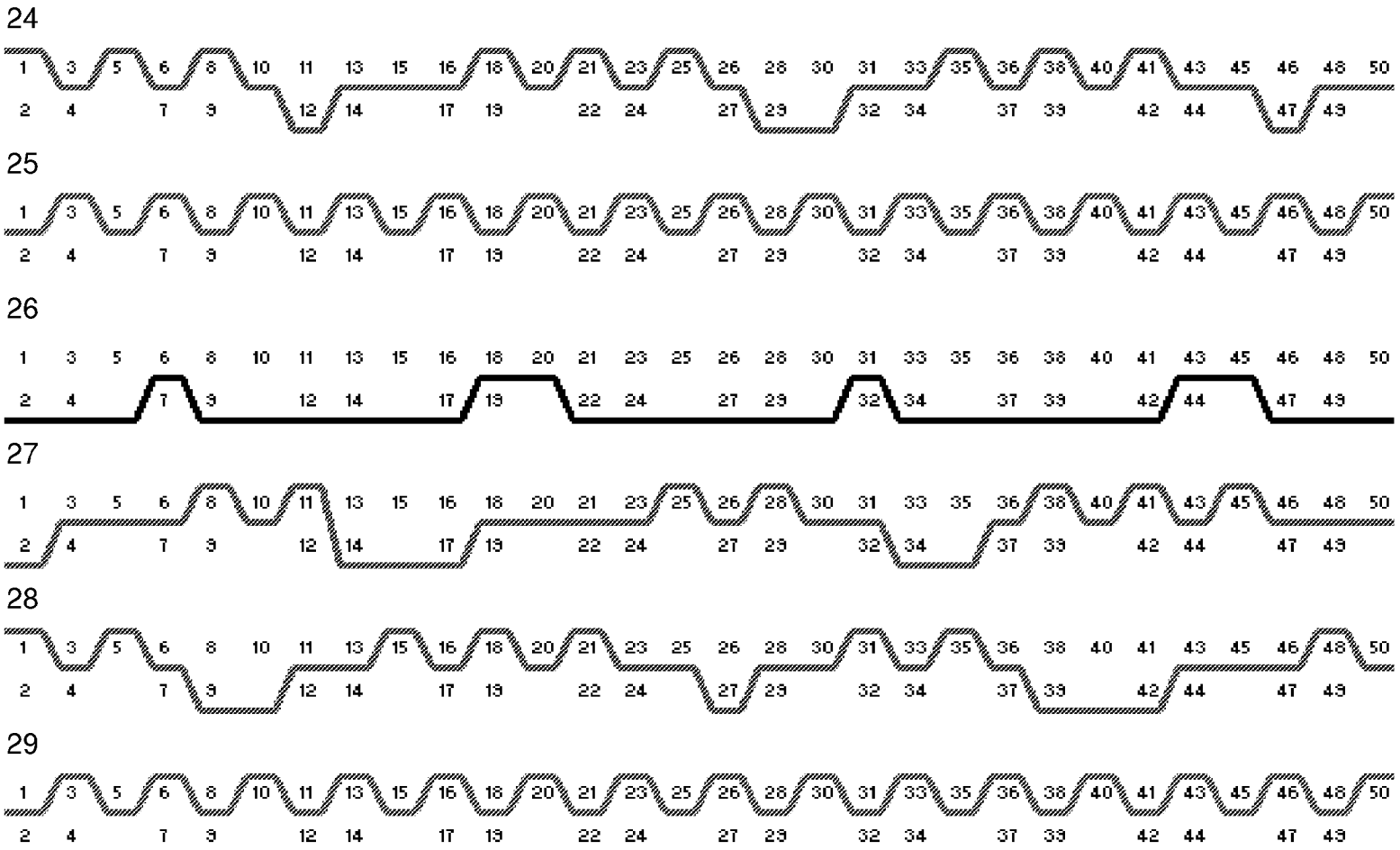
Figure 13F:
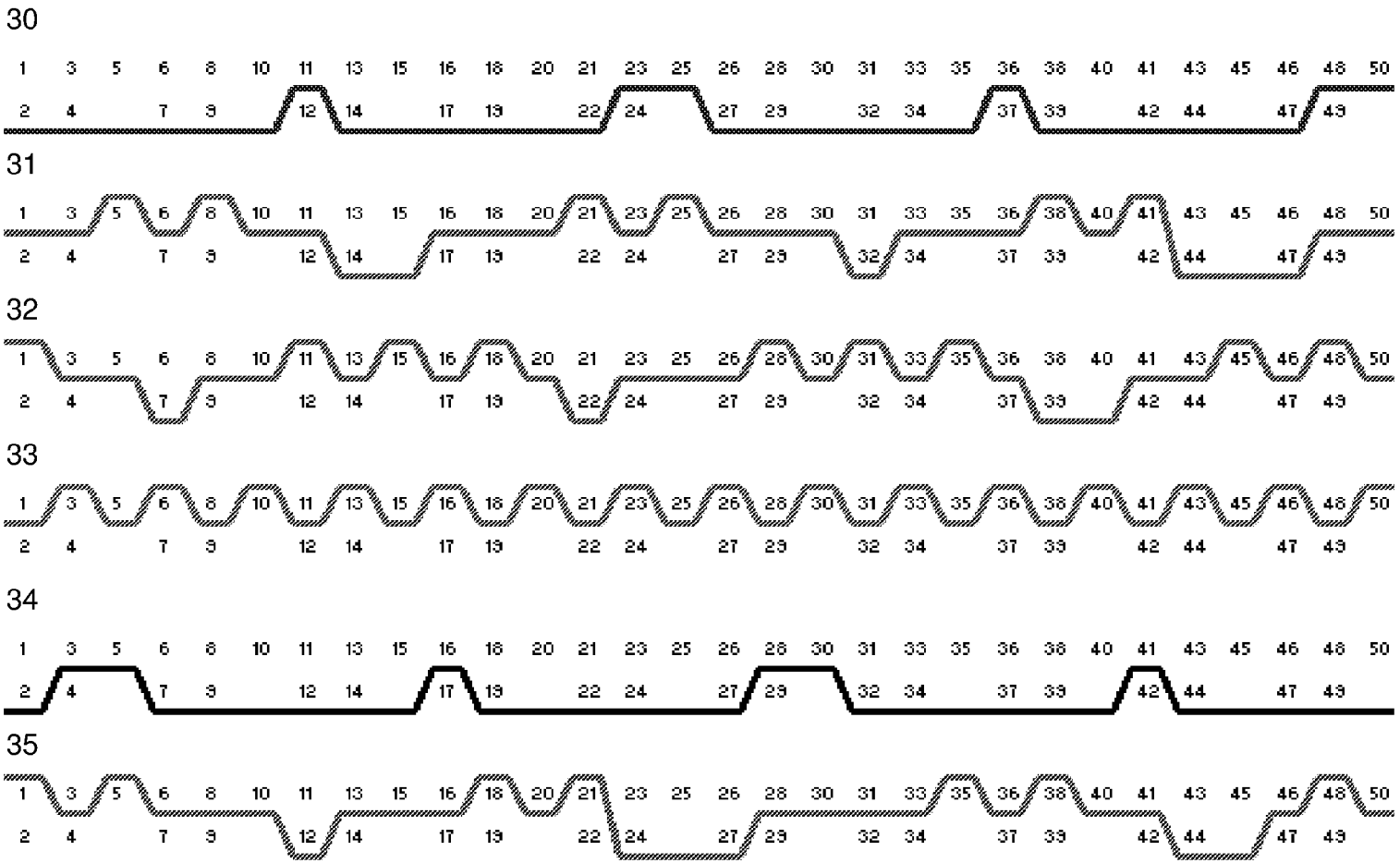
Figure 13G:
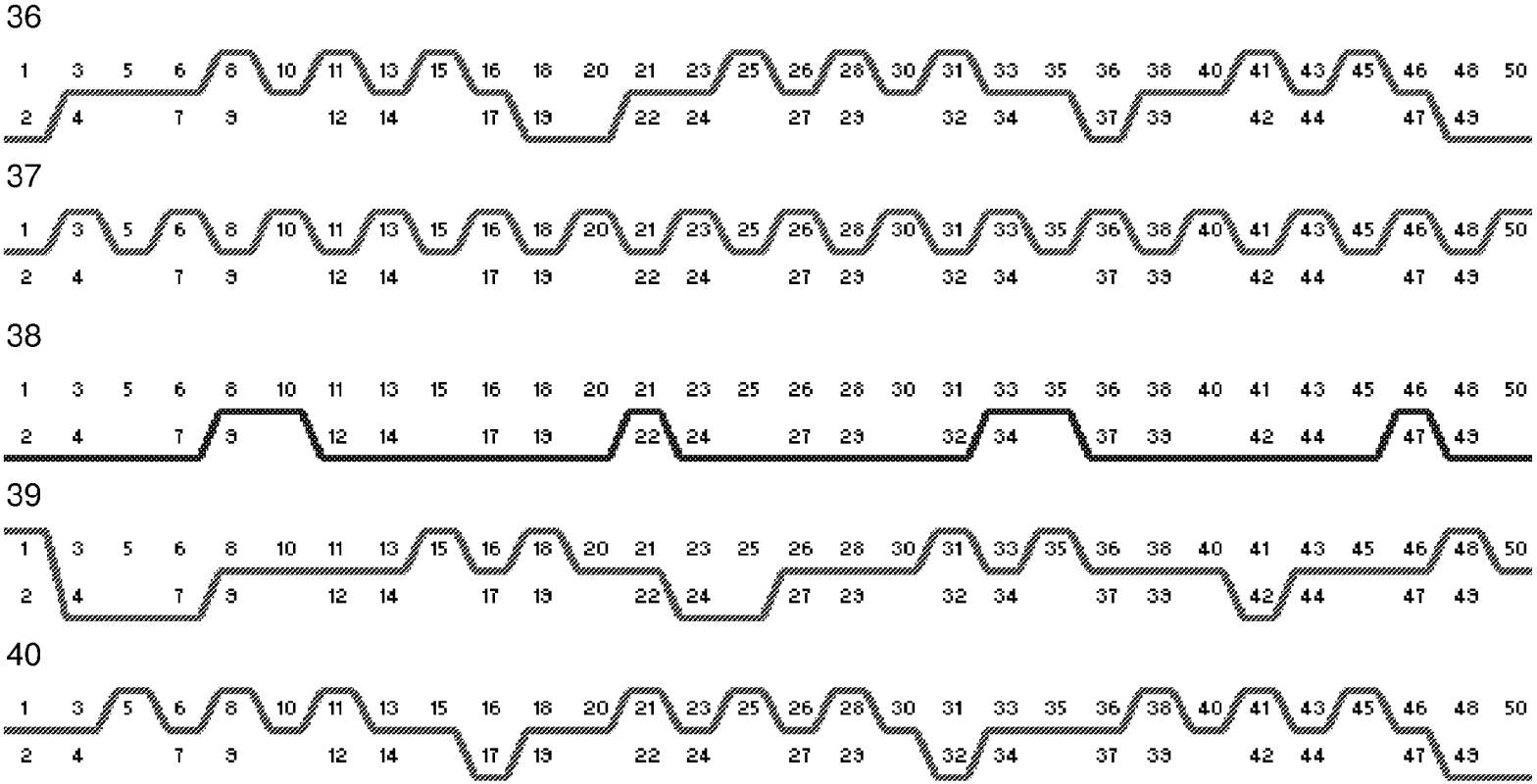

FIG. 12, in conjunction with the embodiment of the fabric belt illustrated in FIGS. 10A-10I and 11 shows again the location of the changeover points of binding threads i1, i2, . . . i19, i20 which are allocated to each other in pairs, as well as binding segments $S_1$ respectively formed in first fabric layer 114. As in FIG. 3 it can also be seen here that the sequence of binding segments $S_1$ created through a respective binding thread pair always consists of one binding segment $S_1$ of the one binding thread of one binding thread pair alternating with one binding segment $S_1$ of the other binding thread of same binding thread pair.

Changeover points W are again arranged along changeover point diagonals $D_W$ or respectively $D_W'$. In changeover point diagonals $D_W$ of the first type there is again a uniform and non-interrupted sequence of changeover points W. In changeover point diagonals $D_W'$ of the second type there are again offset points V or respectively offset changeover points $W_V$ which interrupt the sequence of changeover points in diagonal $D_W'$. In particular one can see that on one and the same binding thread pair—for example binding threads i3 and i4—between two changeover point diagonals $D_W$ of the first type, two changeover points W, $W_V$ may be located, whereby one of which is positioned, for example, on changeover point diagonal $D_W'$ of the second type, for example on changeover point W created on warp thread 10. Another changeover point in the form of an offset changeover point WV is located for example offset on warp thread 16. These additional changeover points or respectively offset changeover points $W_V$ could finally also be regarded as changeover points defining an additional diagonal of the second type. In fact, in the embodiment illustrated in FIG. 12 several changeover point diagonals $D_W'$ of the second type may be drawn in between two changeover point diagonals $D_W$ of the first type, which distinguish themselves in that compared with the changeover point diagonals $D_W$ of the first type they feature one, or respectively a plurality, of interruptions which compensate for the interruption-free sequence of changeover points.

Previously described are fabric structures in reference to FIGS. 1A-1D, 2 through 10A-10I, 11, in which in one binding thread repeat, in addition to the always present binding thread pairs—in this instance always ten binding thread pairs—double the number of non-binding weft threads, in other words weft threads which contribute only to the basic weave of the individual fabric layers, are present. In addition to the 20 weft threads representing the binding threads there are also a total of 40 basic weave weft threads here which do not change fabric layers and which are exclusively integrated into the first fabric layer 114 or the second fabric layer 116. In other words, there is a ratio of 1:2 of binding weft threads to non-binding weft threads. Below, and with reference to FIGS. 13A-13G, 14 through 22A-22F, 23 design variations are described in which this ratio is 1:1. In this case there are exactly the same number of non-binding weft threads as there are weft threads binding the respective binding thread pairs.

In the embodiment of the present invention illustrated in FIG. 13A-13G there are a total of ten pairs of binding threads respectively allocated to each other, whereby fundamentally in regard to the thread progression different binding thread pairs exist. It can be seen for example that binding thread i5 relative to the different warp threads with which it forms binding segments $S_1$ or respectively $S_2$ has the same progression as binding thread i1, but is however offset relative to same in the weft direction. However, binding threads i1 and i3 or respectively binding threads i2 and i4 distinguish themselves in regard to their connection to the warp threads. This leads, for example, to one binding thread pair containing binding threads i1, i2 in the first fabric layer 114 having a sequence of 2-3-3-2-3-2 of binding segments $S_1$ whereby the respectively stated number describes the number of warp threads in a particular binding segment $S_1$ in first fabric layer 114 which are surrounded on the outside by a binding thread i1 or i2. In binding thread pair i3-i4 the sequence is 3-2-3-2-3-2. This sequence of binding segments $S_1$ of a different type, in other words a respectively different number of included warp threads alternates within a particular binding thread repeat.

In the embodiment illustrated in FIGS. 13A-13G and 14 the binding segments $S_2$ of second fabric layer 116 are oriented along binding segment diagonals D. Since each binding thread forms binding segments of a different type, in other words on the one hand binding segments which include one warp thread and on the other hand binding segment which include two warp threads, a sequence of binding segments of a different type exists in each binding thread pair. This results in two different diagonals D and D' that develop. Each diagonal D or respectively D' contains binding segments $S_2$ of a different type, which are distributed uniformly in sequence along the diagonals D or respectively D'.

Figure 15:
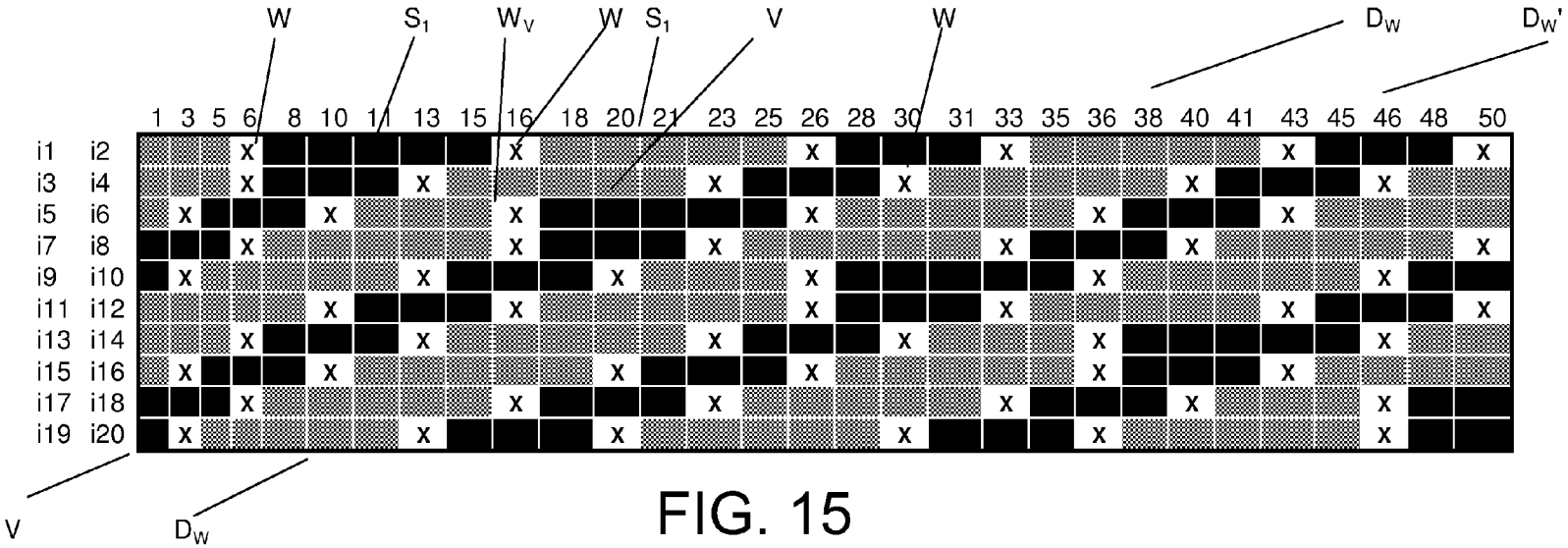
FIG. 15 illustrates the arrangement of binding segments in a paper side fabric layer and the changeover points created between such binding segments for the binding pattern illustrated in FIGS. 13A-13G and 14.
Figure 16A:
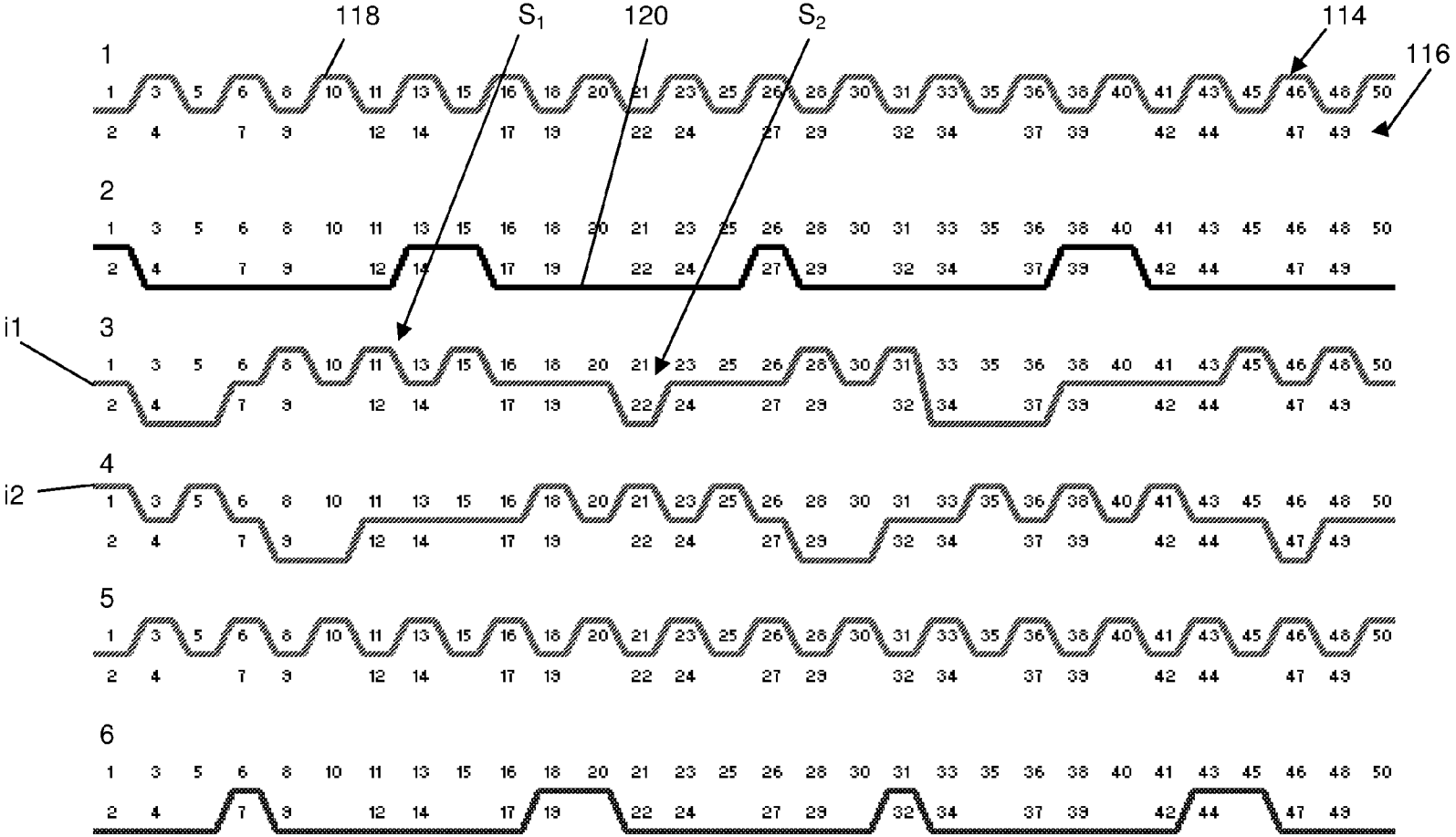
Figure 16B:
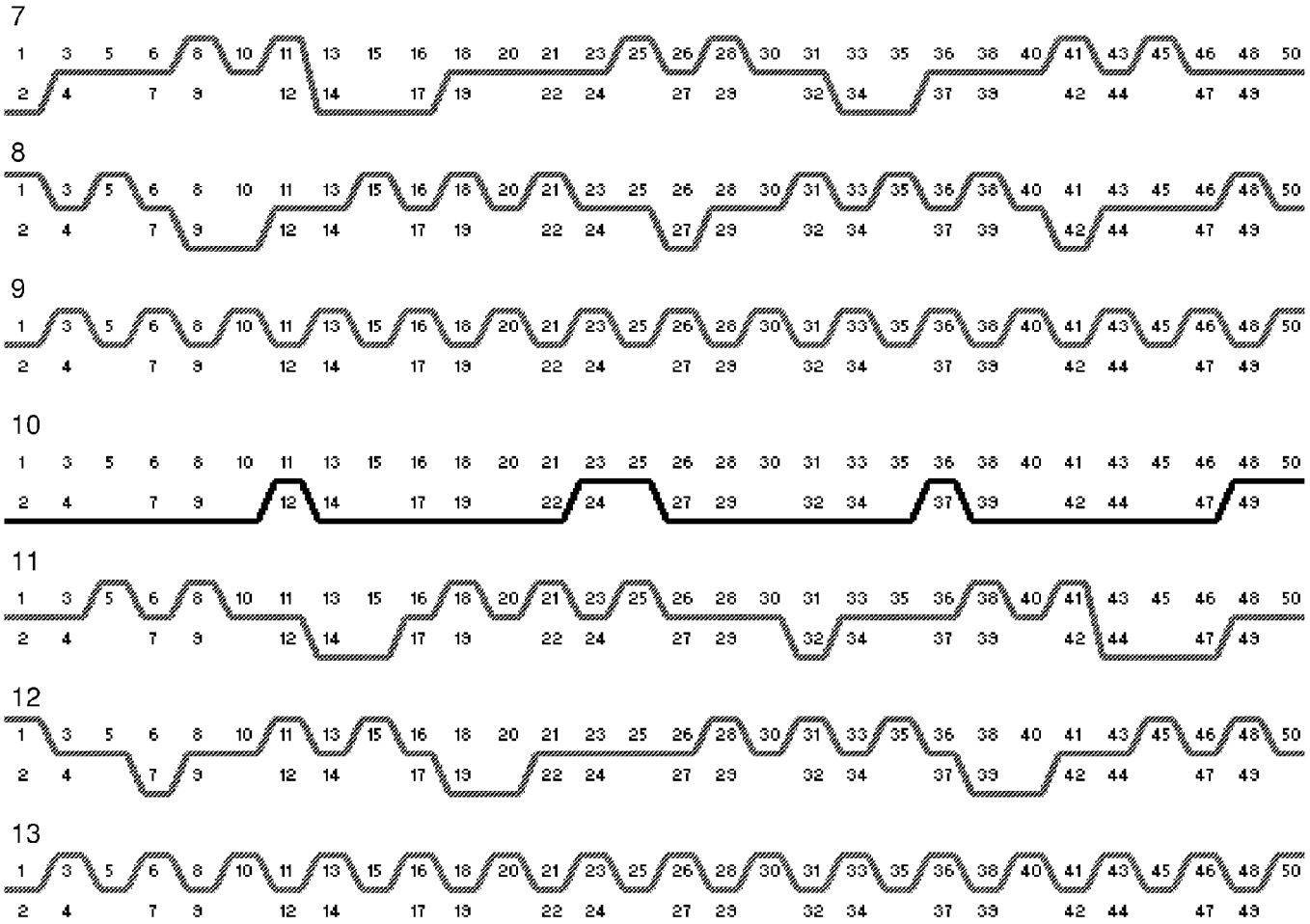
Figure 16C:
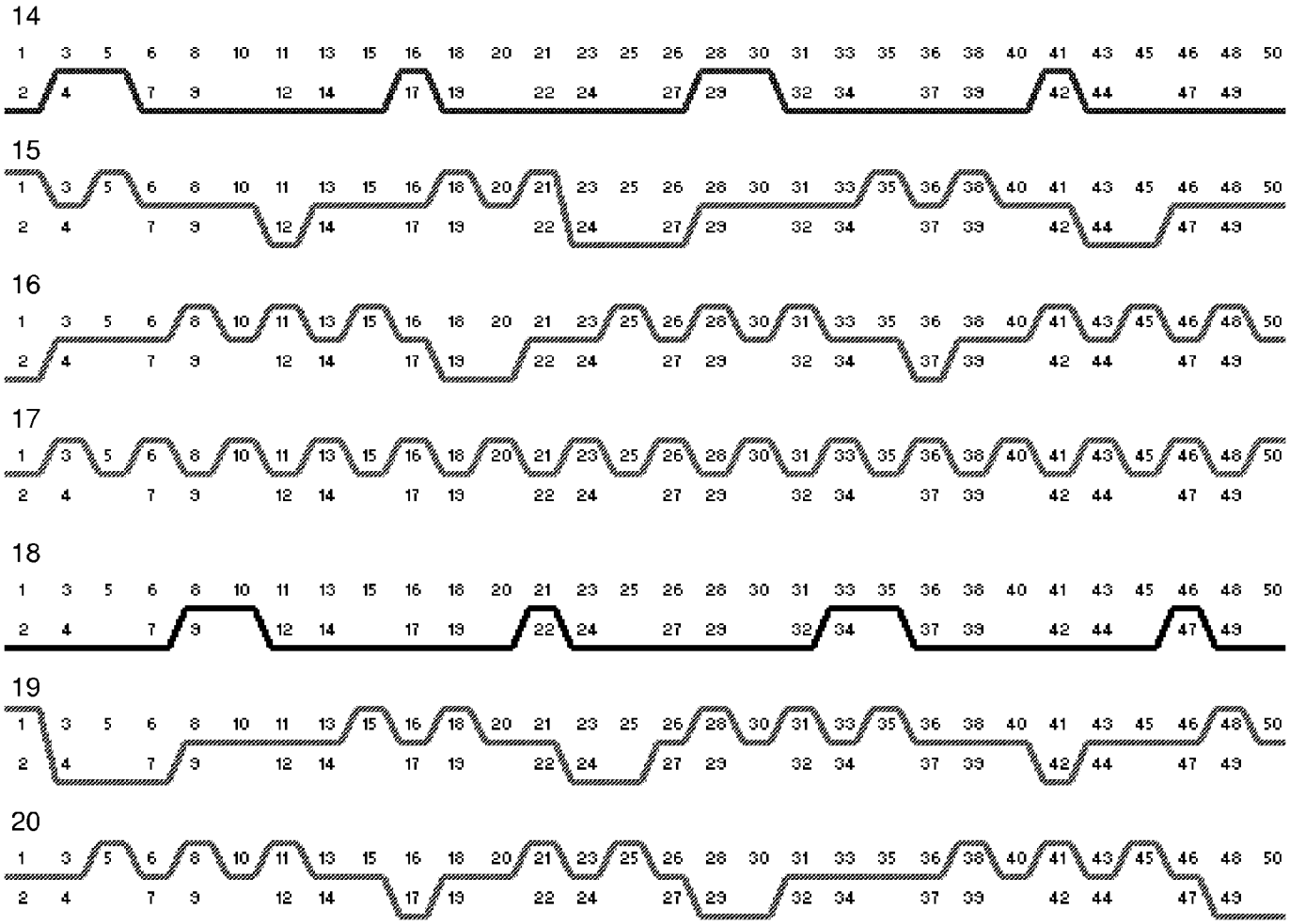
Figure 16D:
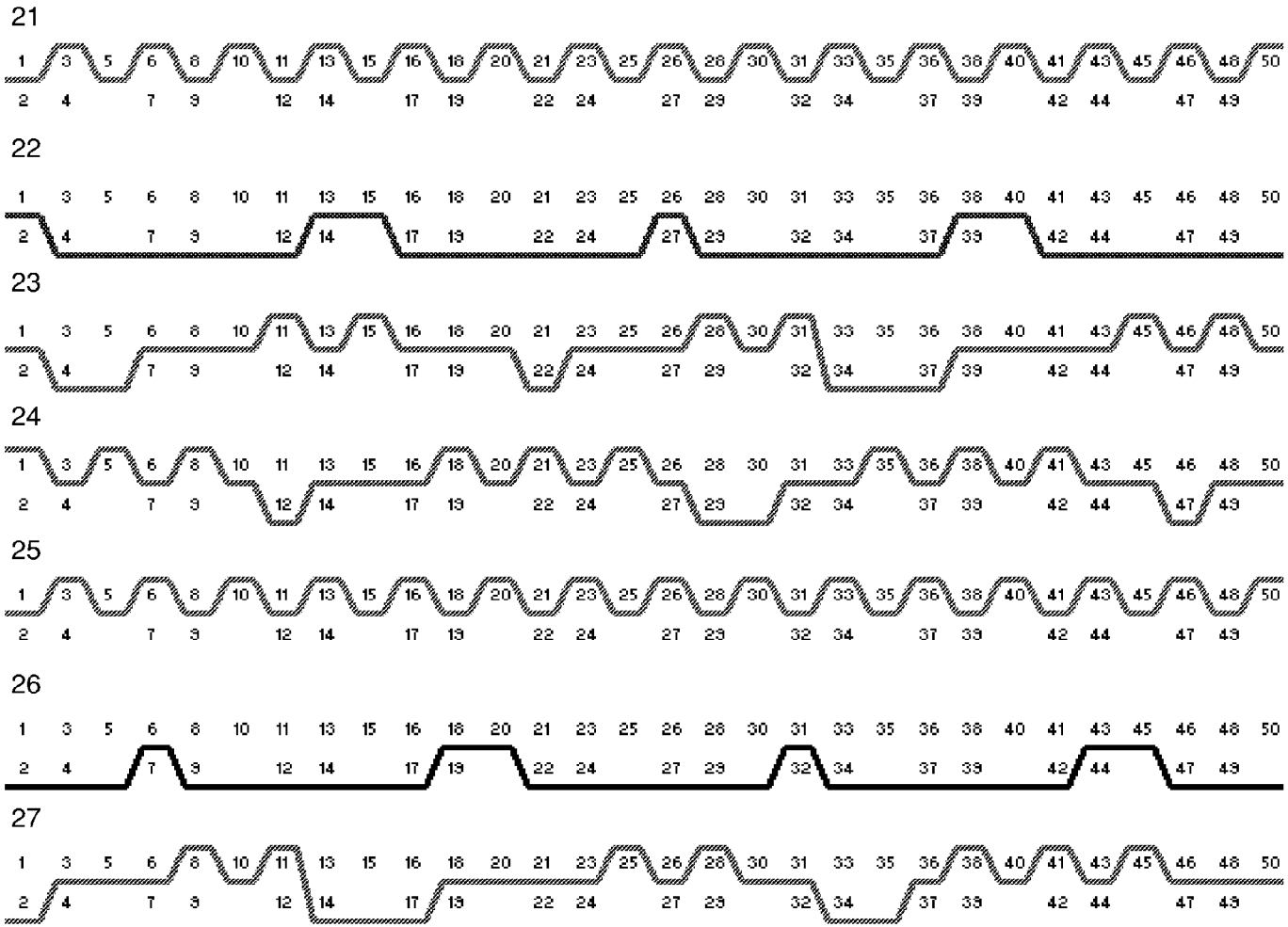
Figure 16E:
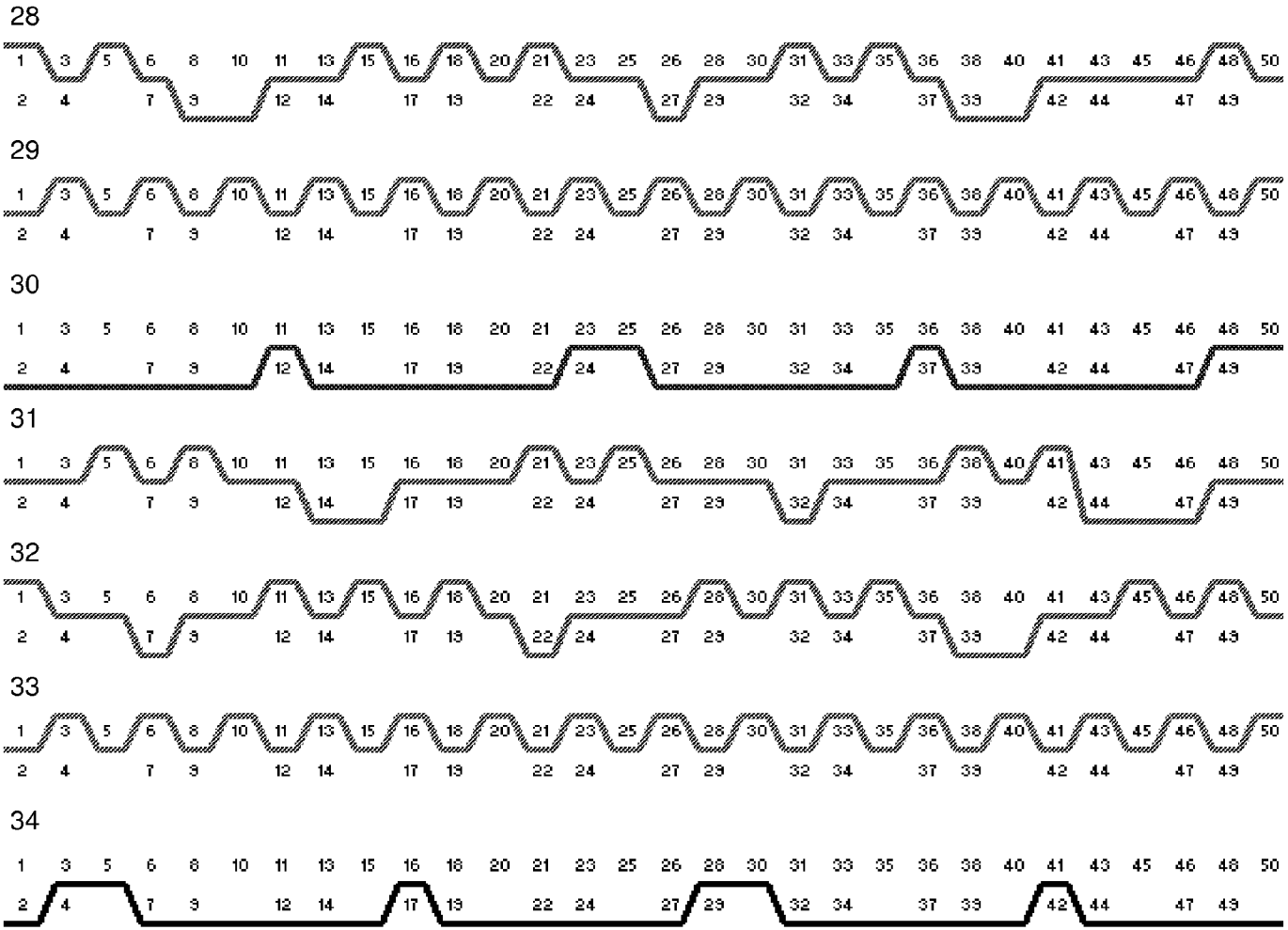
Figure 16F:
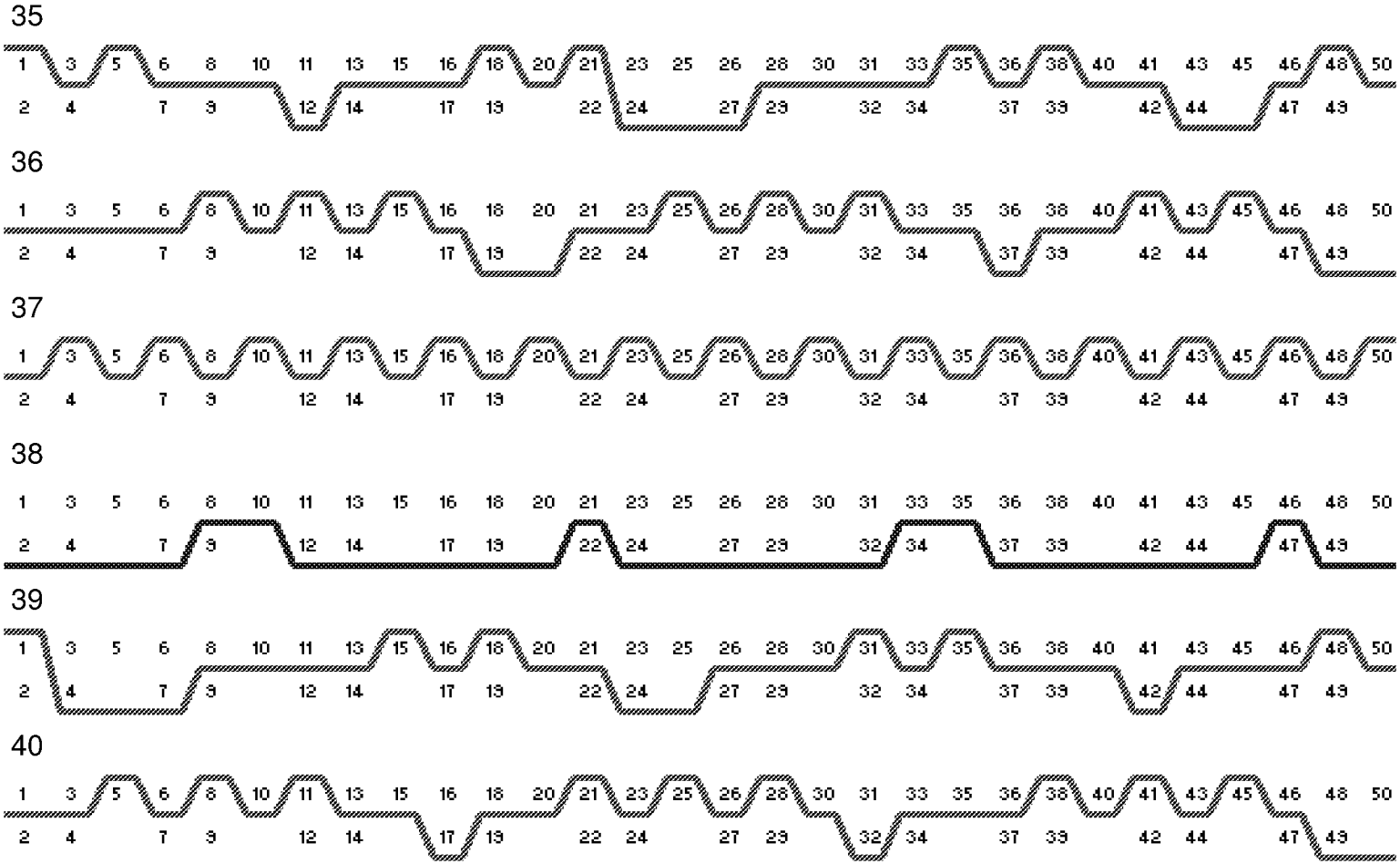
Figure 18A:
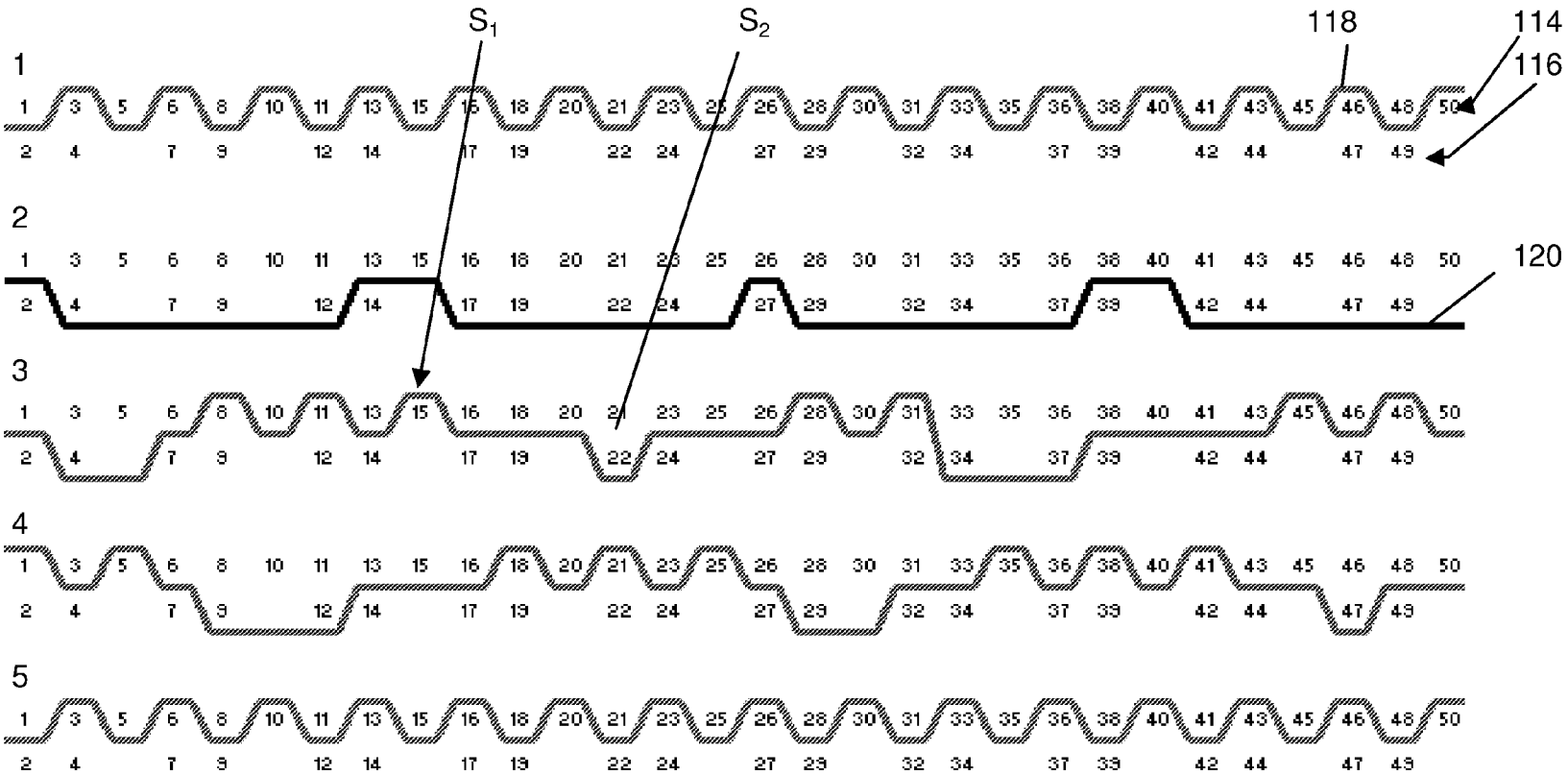
FIGS. 18A-18G and 19 illustrate an alternative design form of that shown according to FIGS. 1A-1D and 2.
Figure 18B:
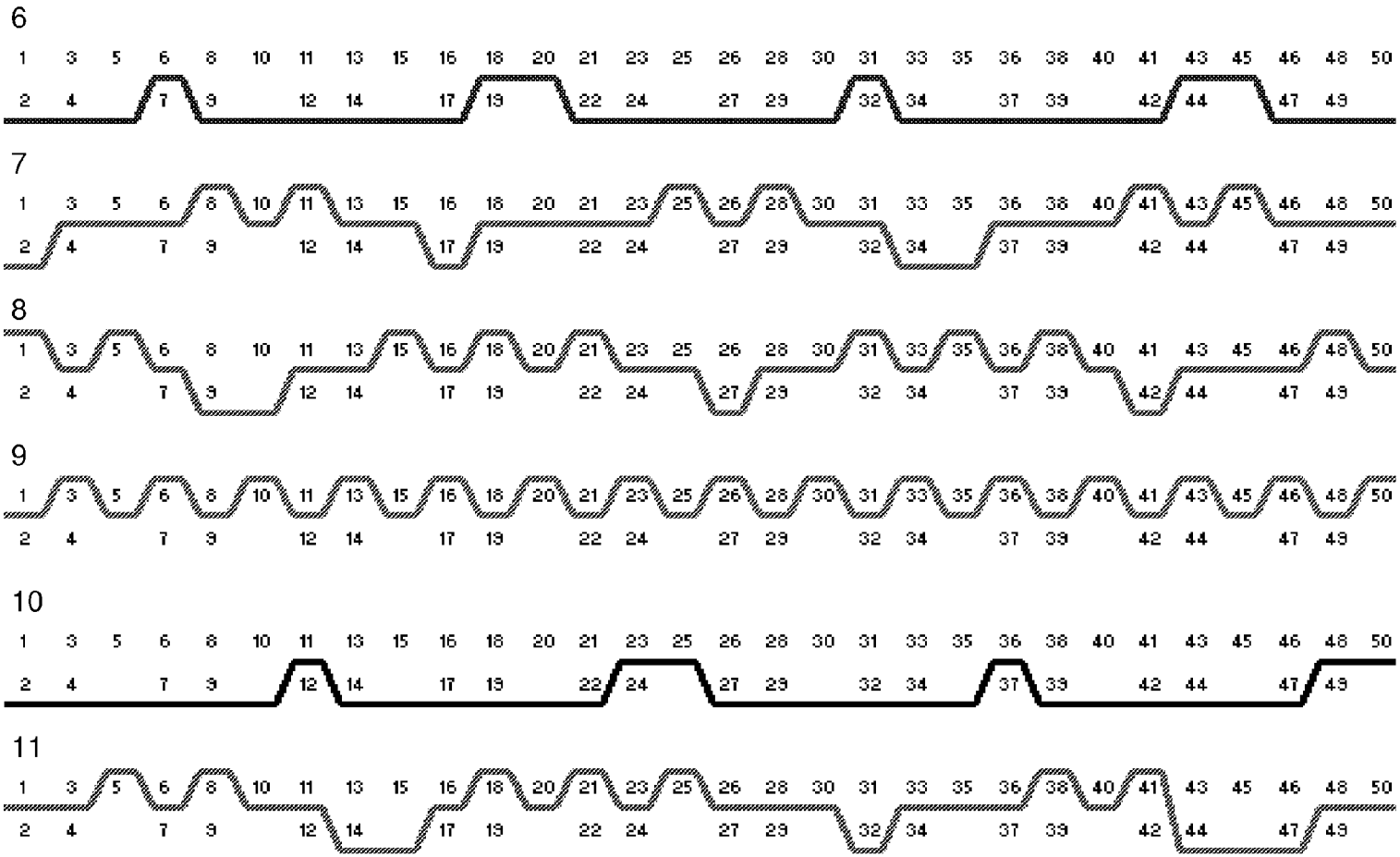
Figure 18C:
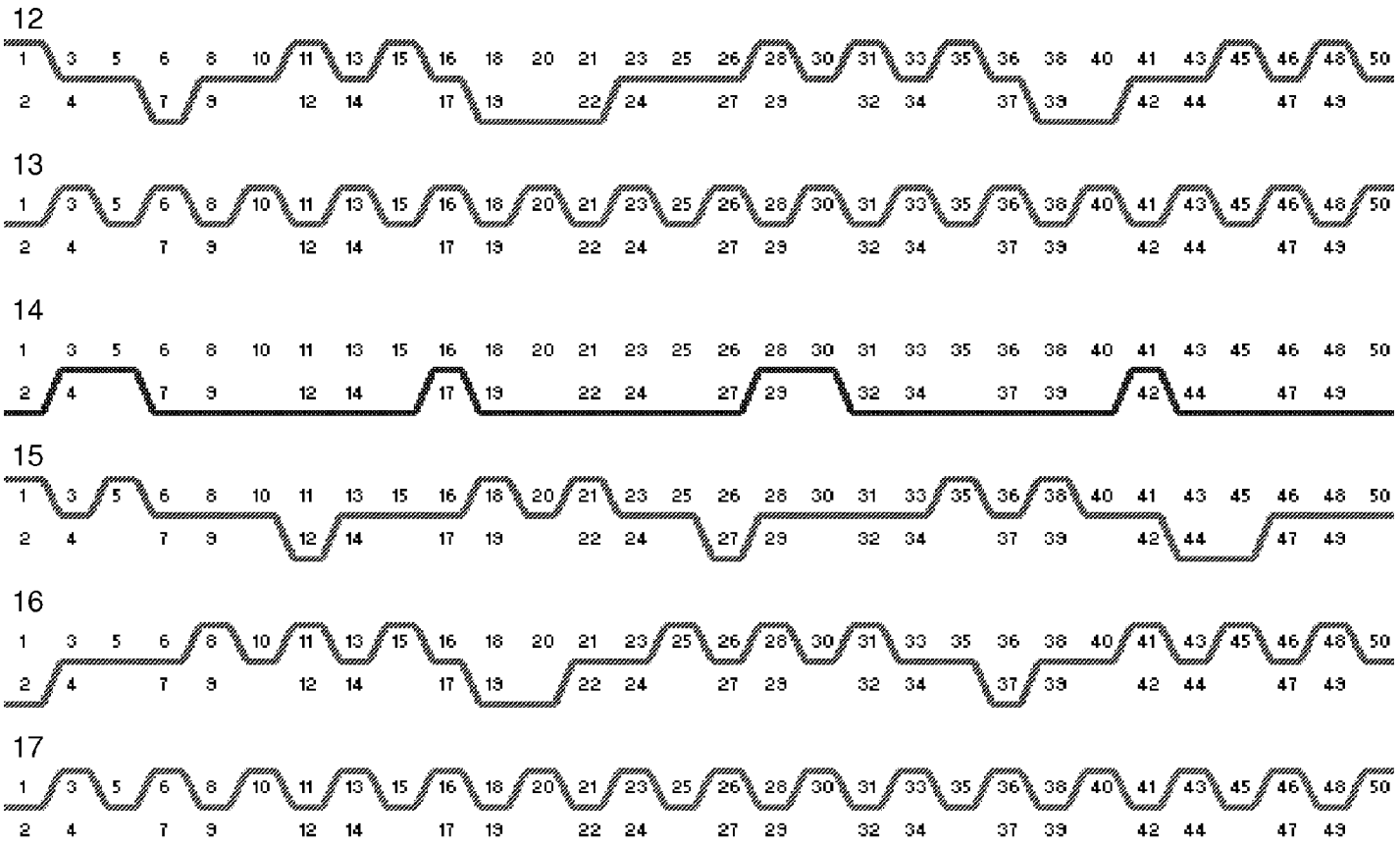
Figure 18D:
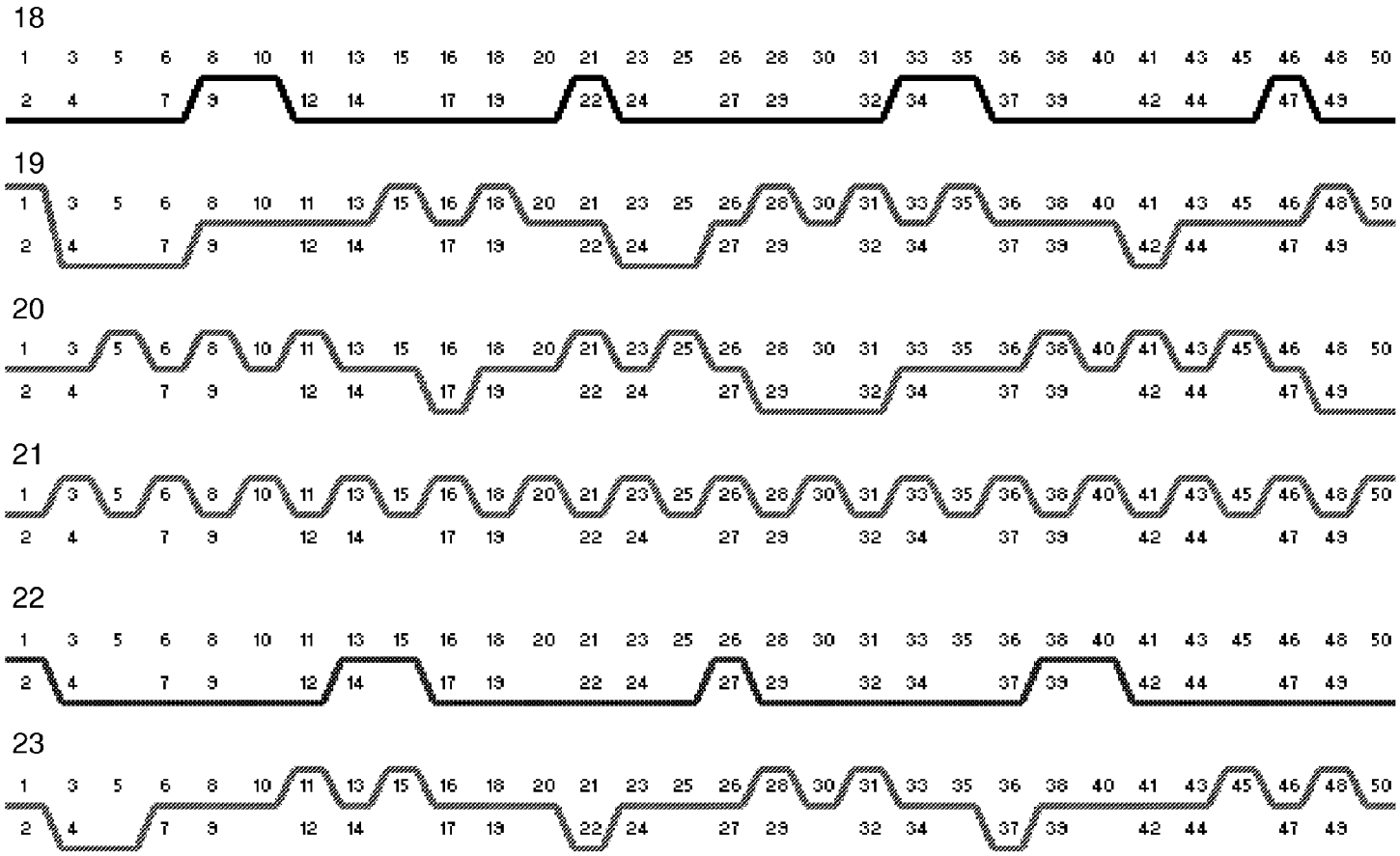
Figure 18E:
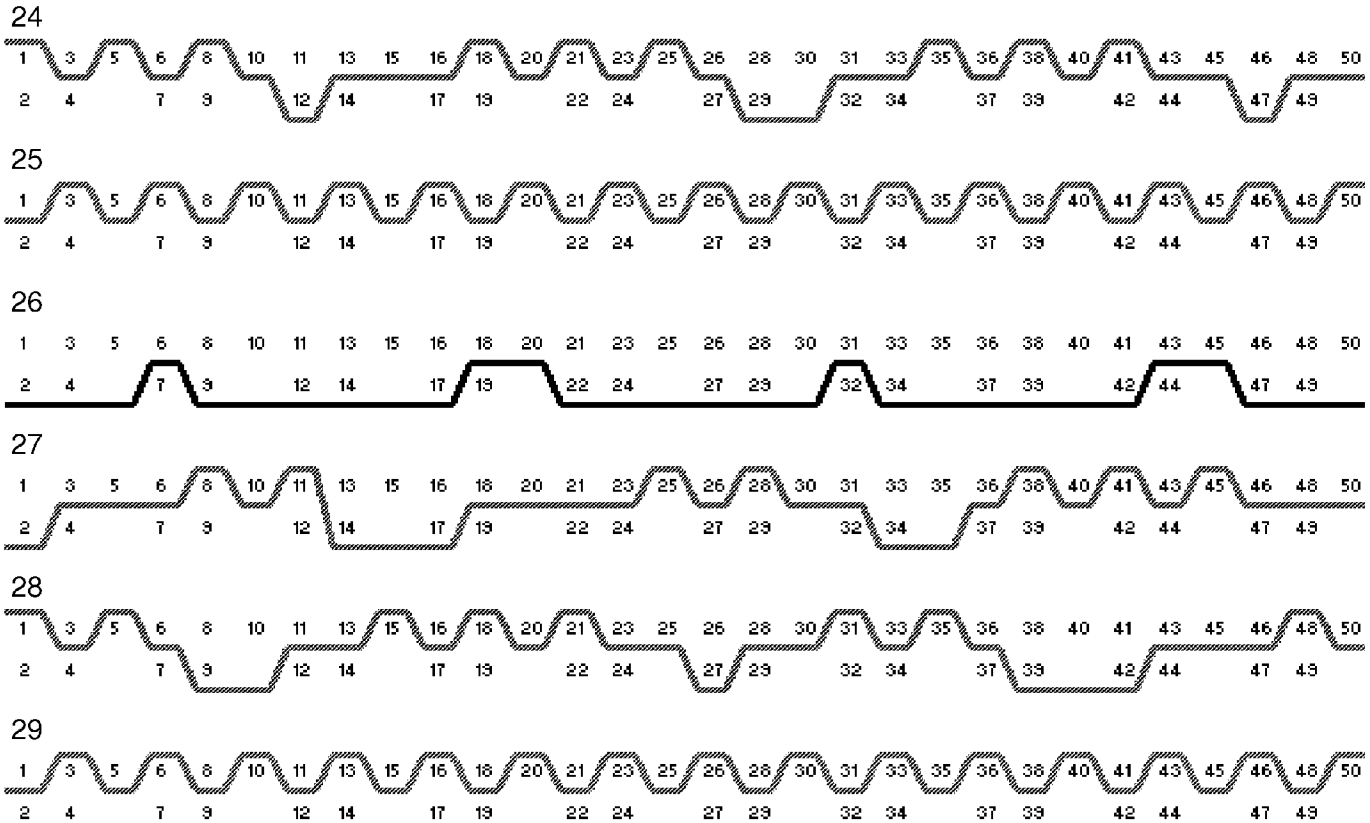
Figure 18F:
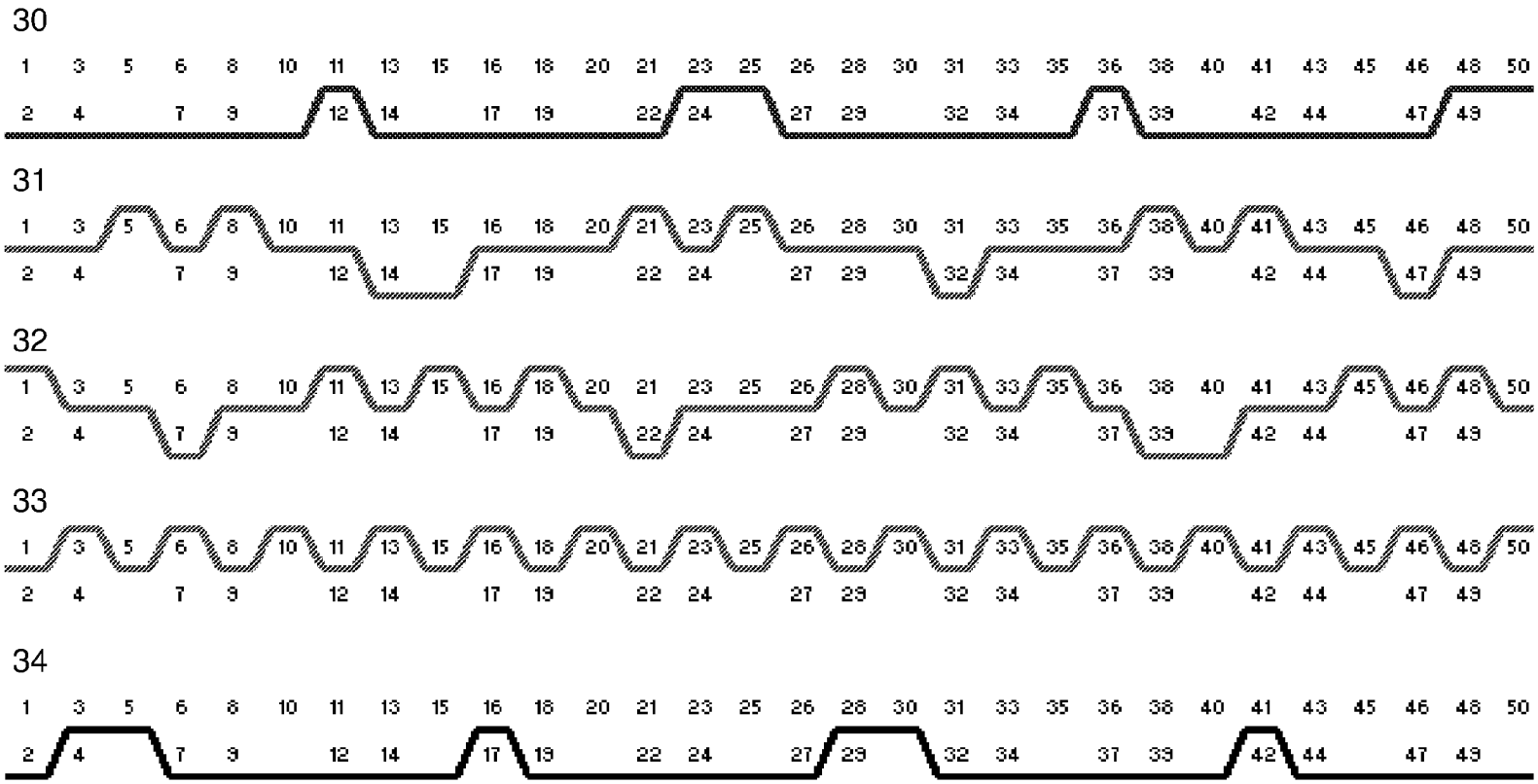
Figure 18G:
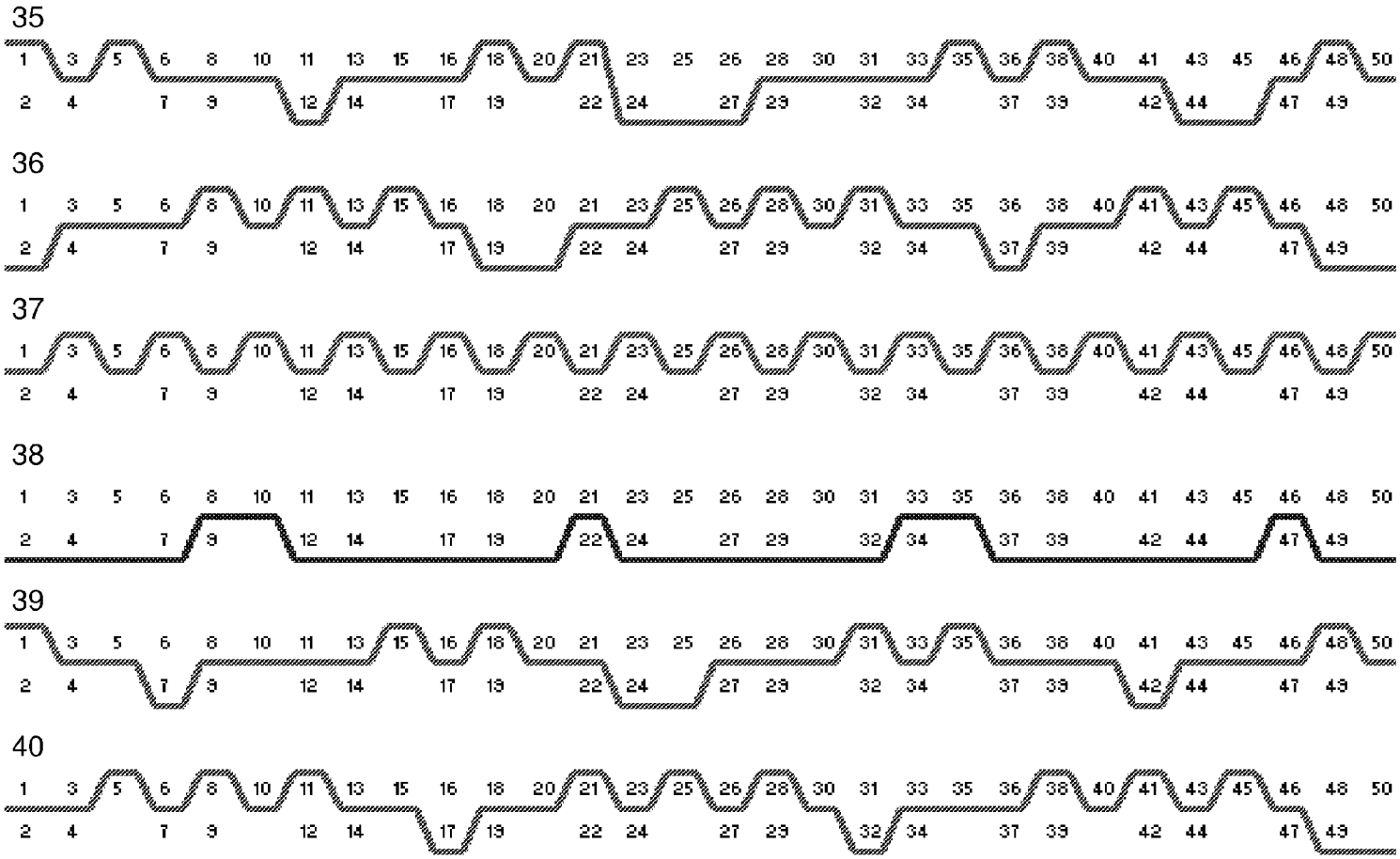
Figure 19:
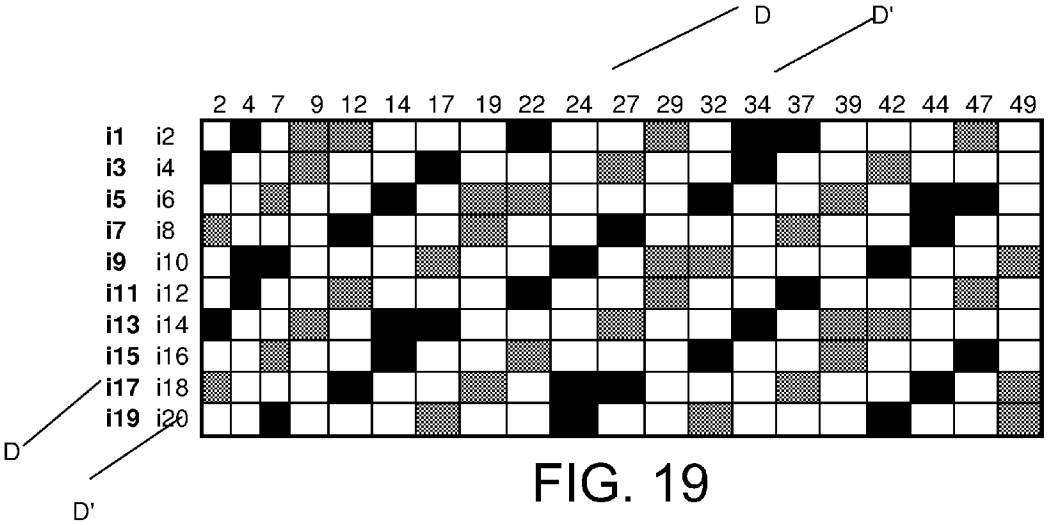
Figure 21:
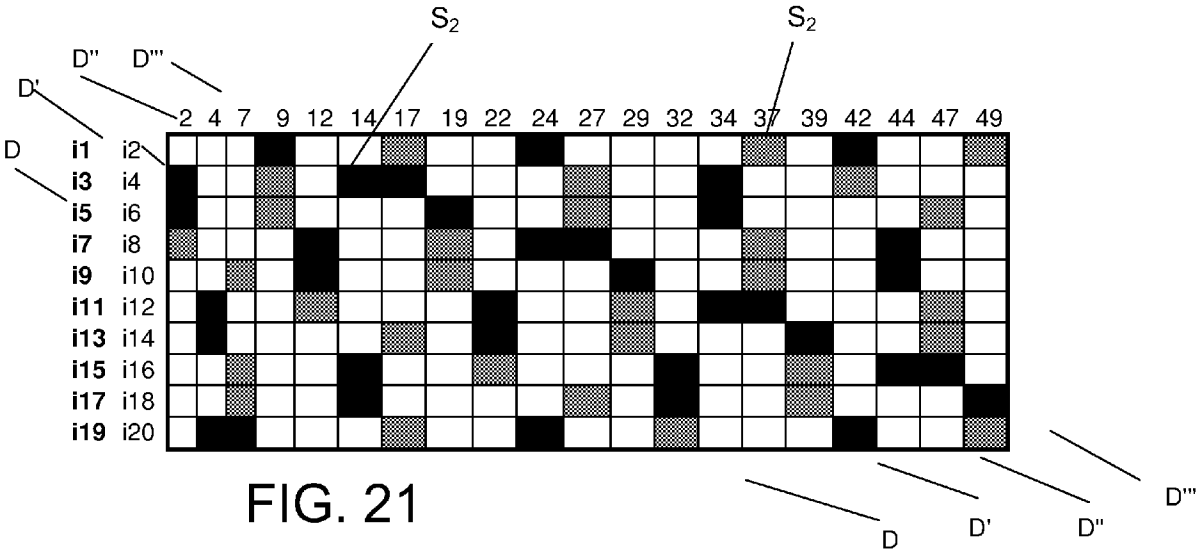
FIGS. 20A-20G and 21 illustrate an alternative design form of that shown according to FIGS. 1A-1D and 2.
Figure 20A:
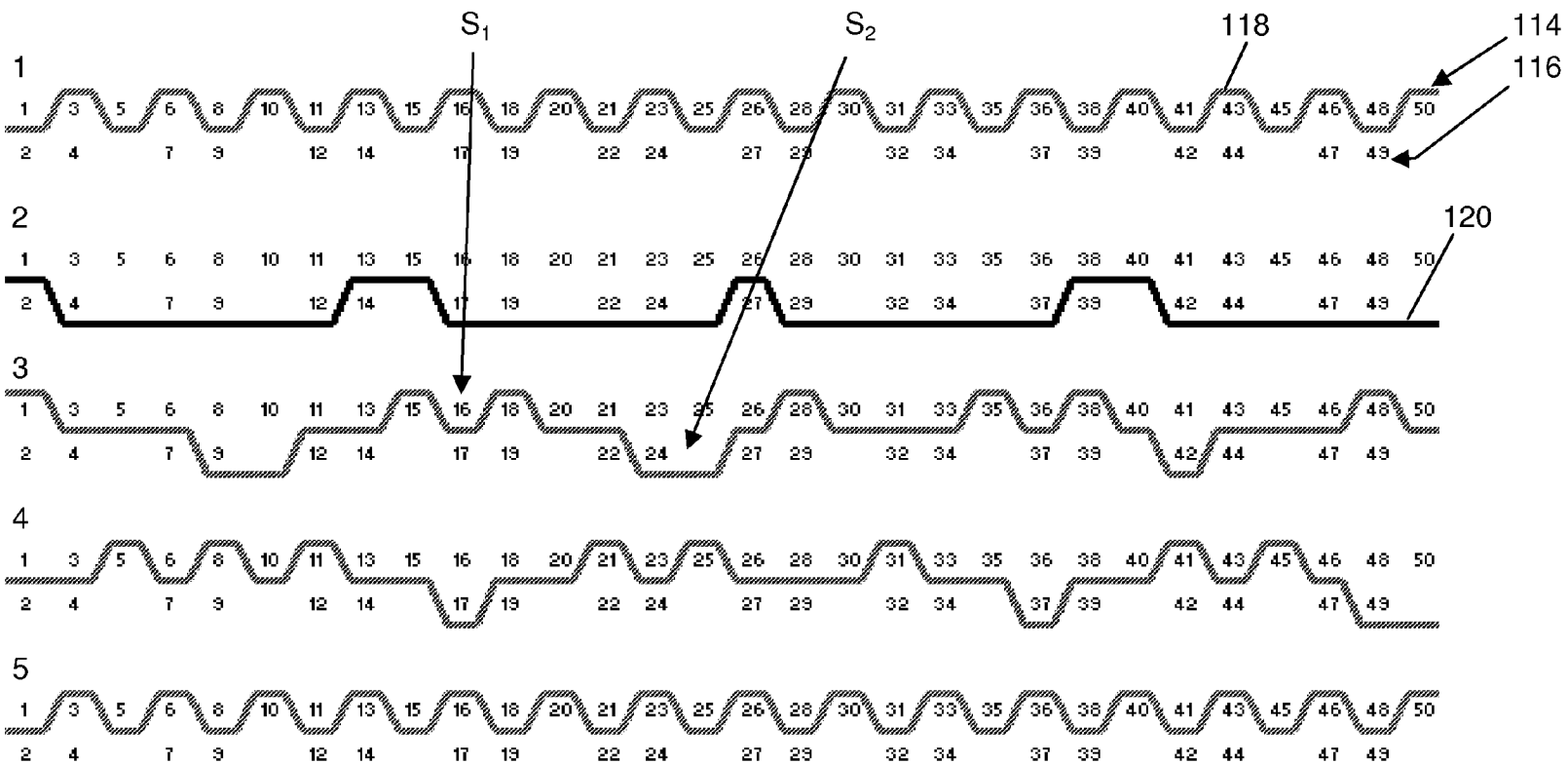
Figure 20B:
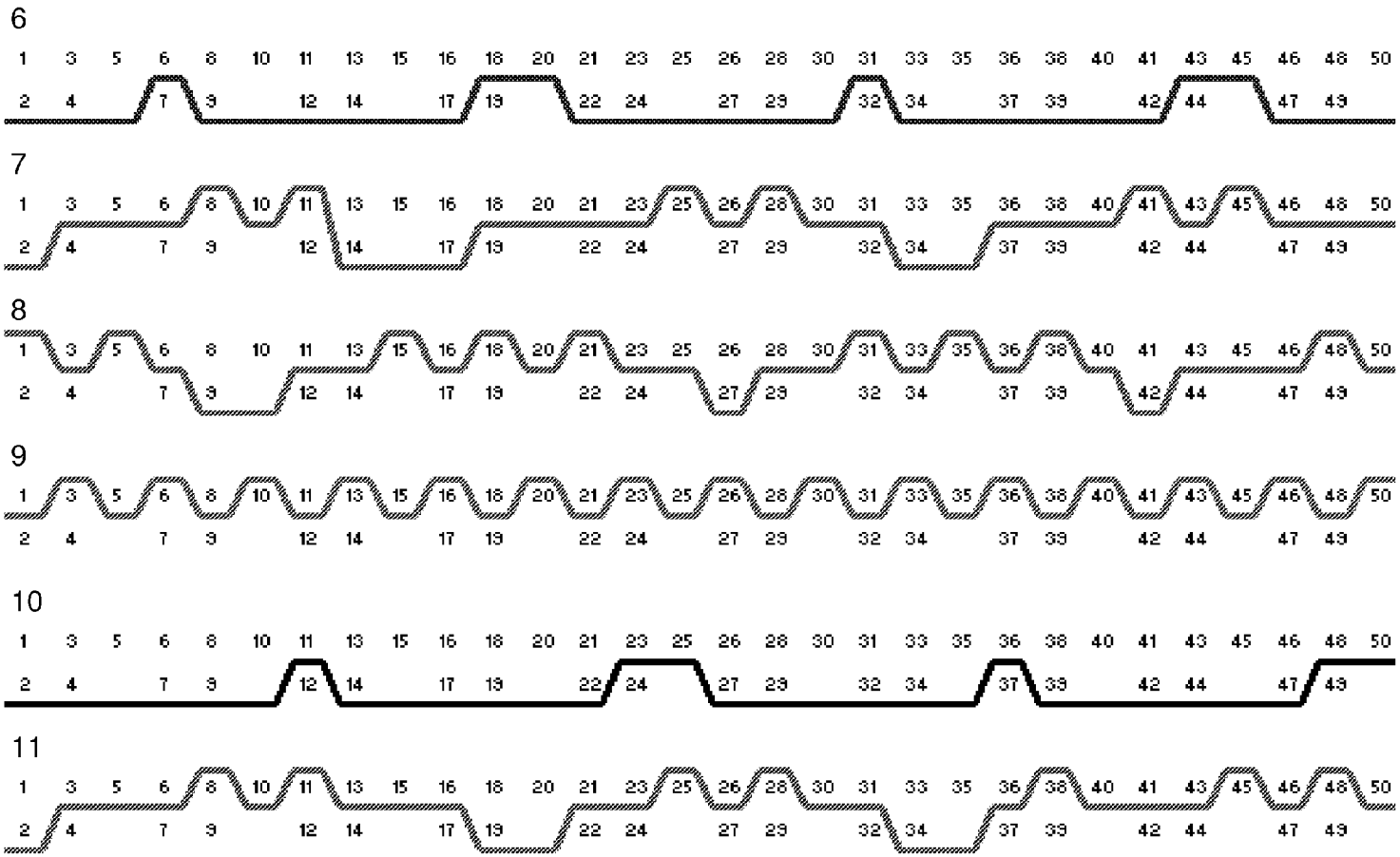
Figure 20C:
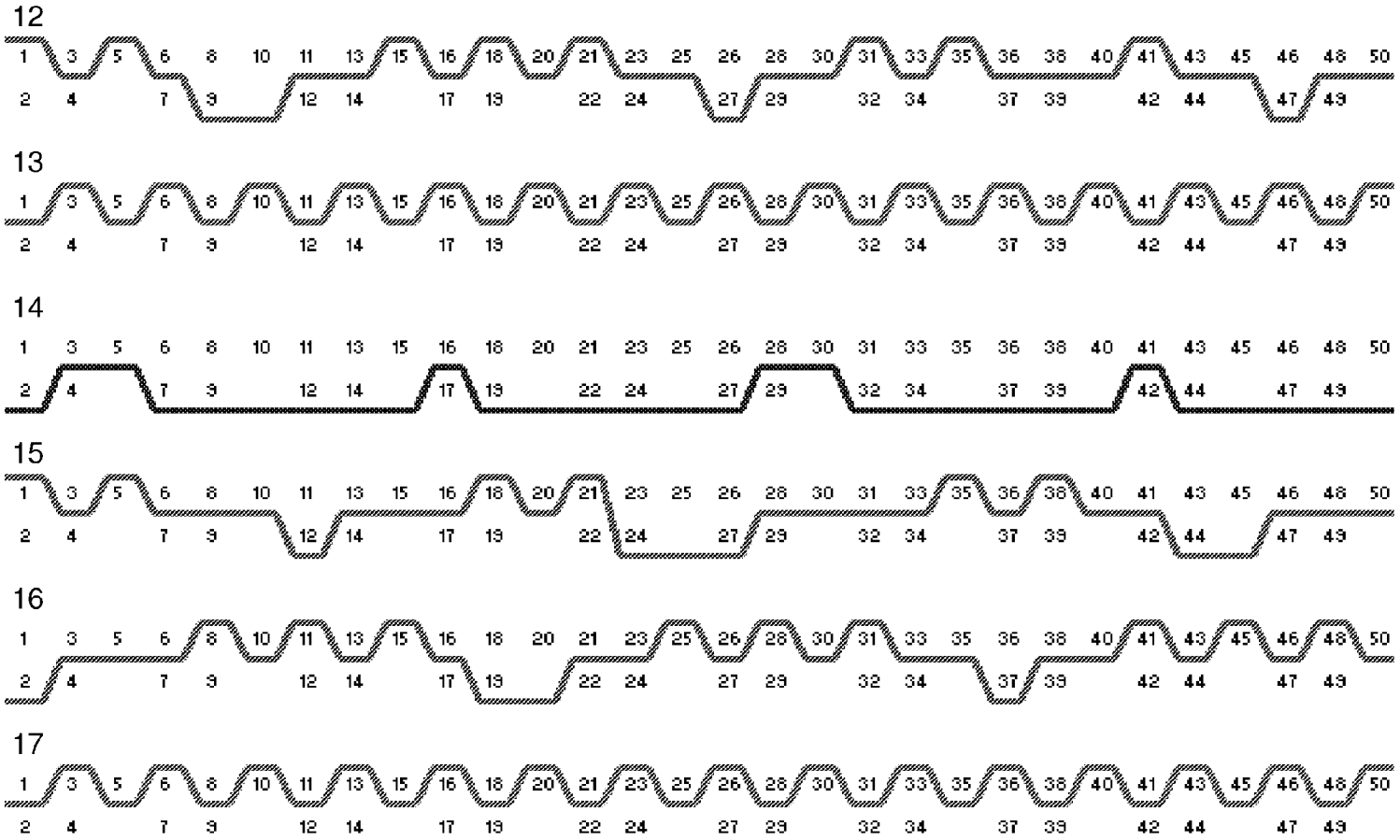
Figure 20D:
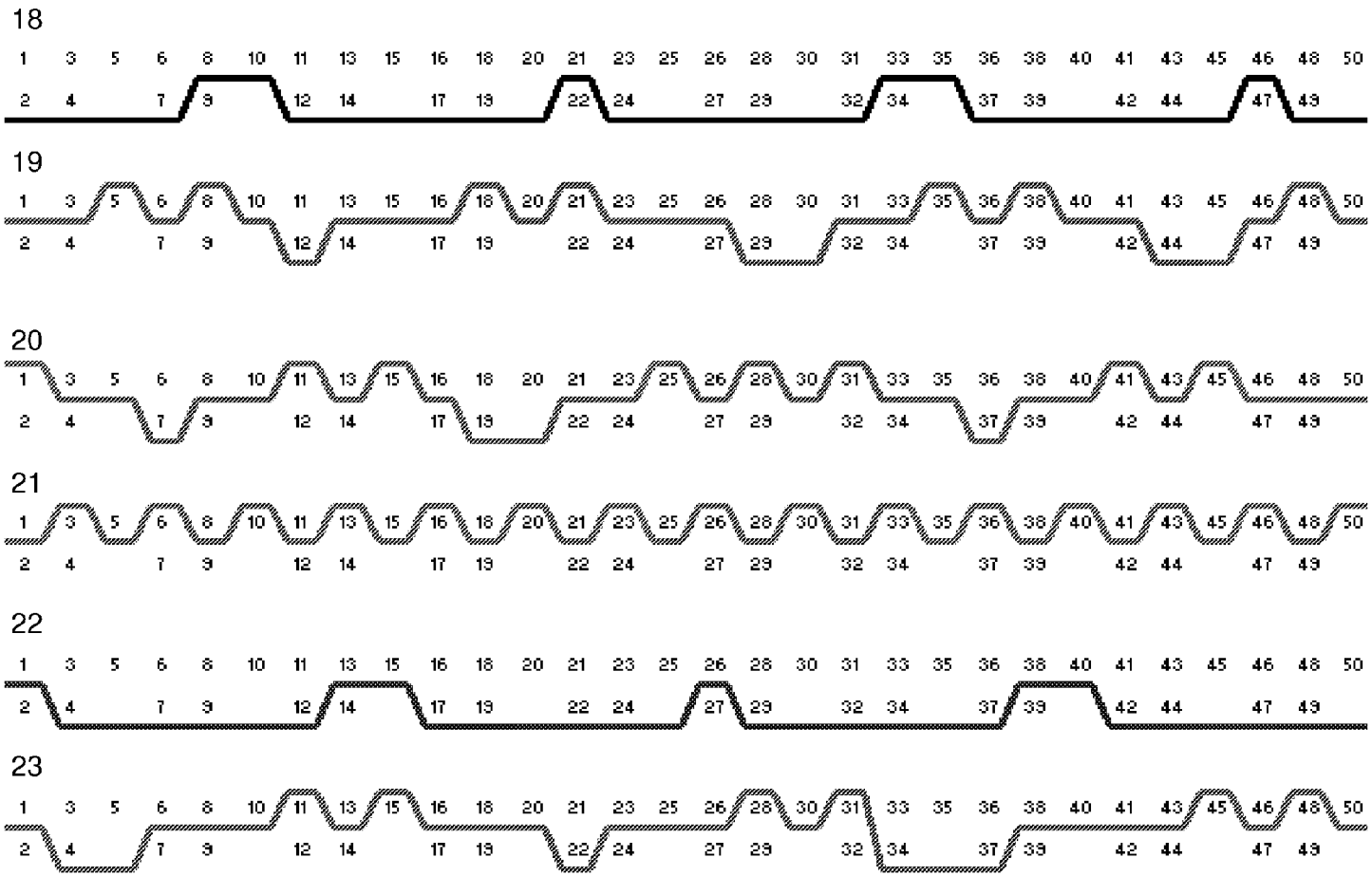
Figure 20E:
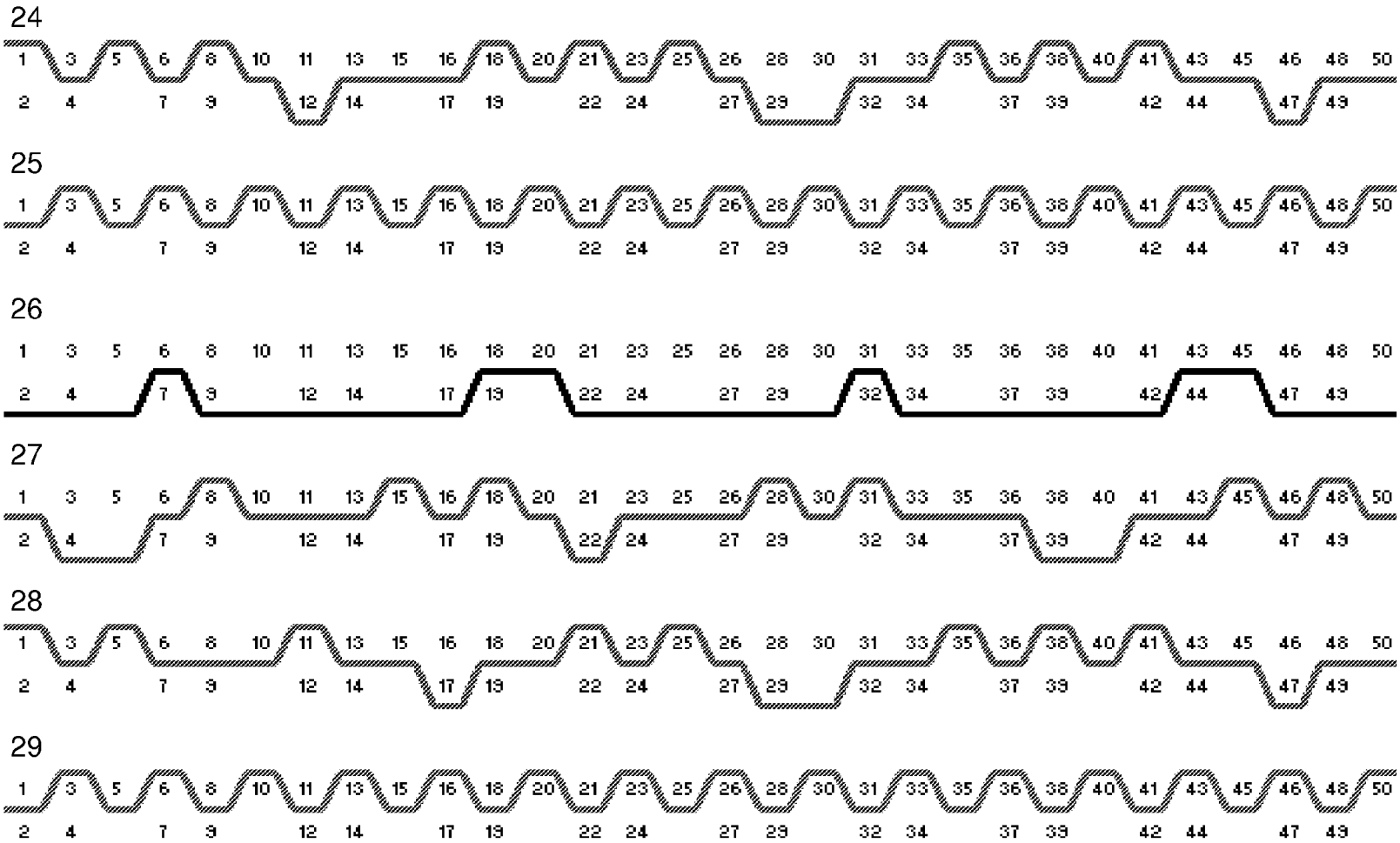
Figure 20F:
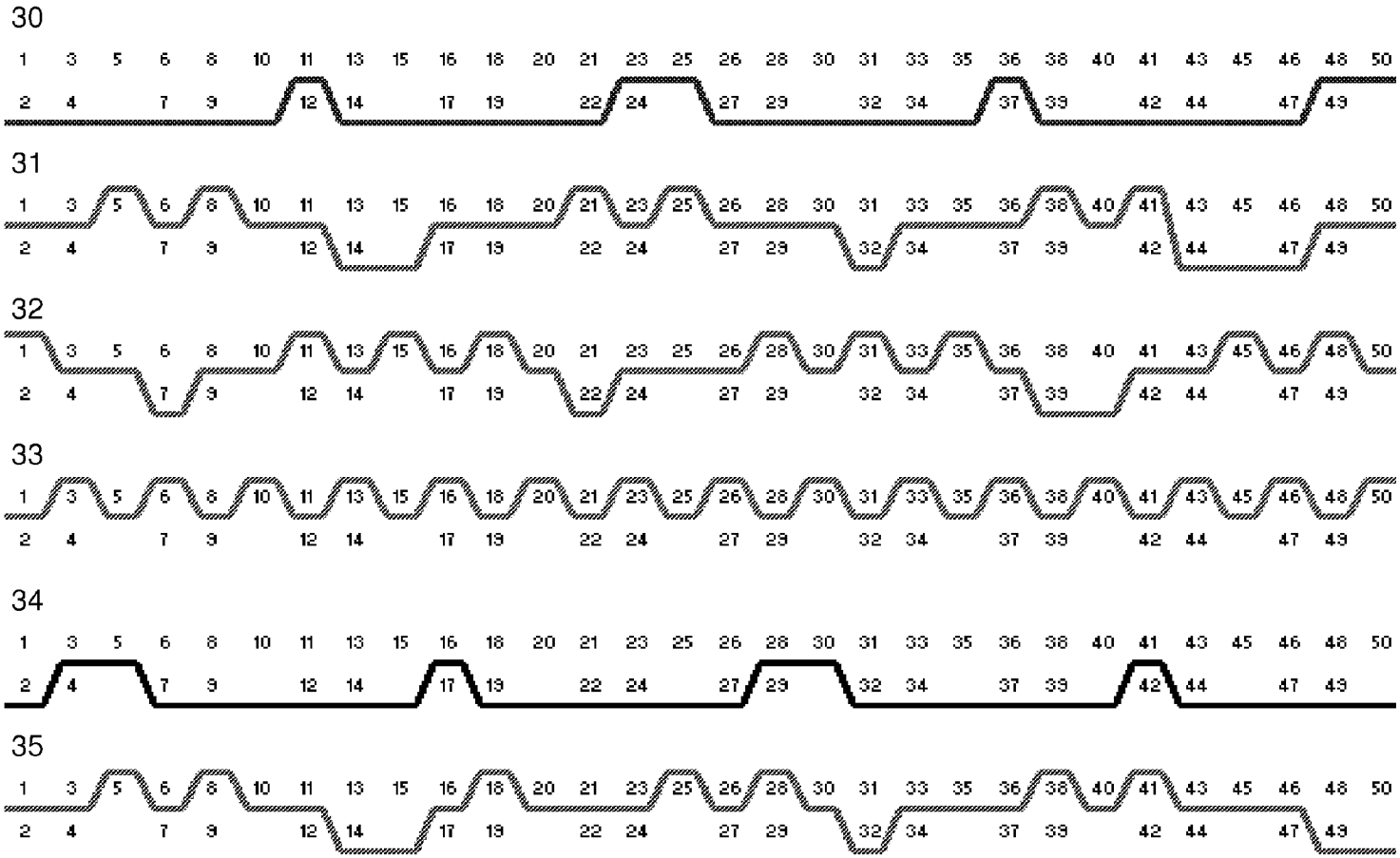
Figure 20G:
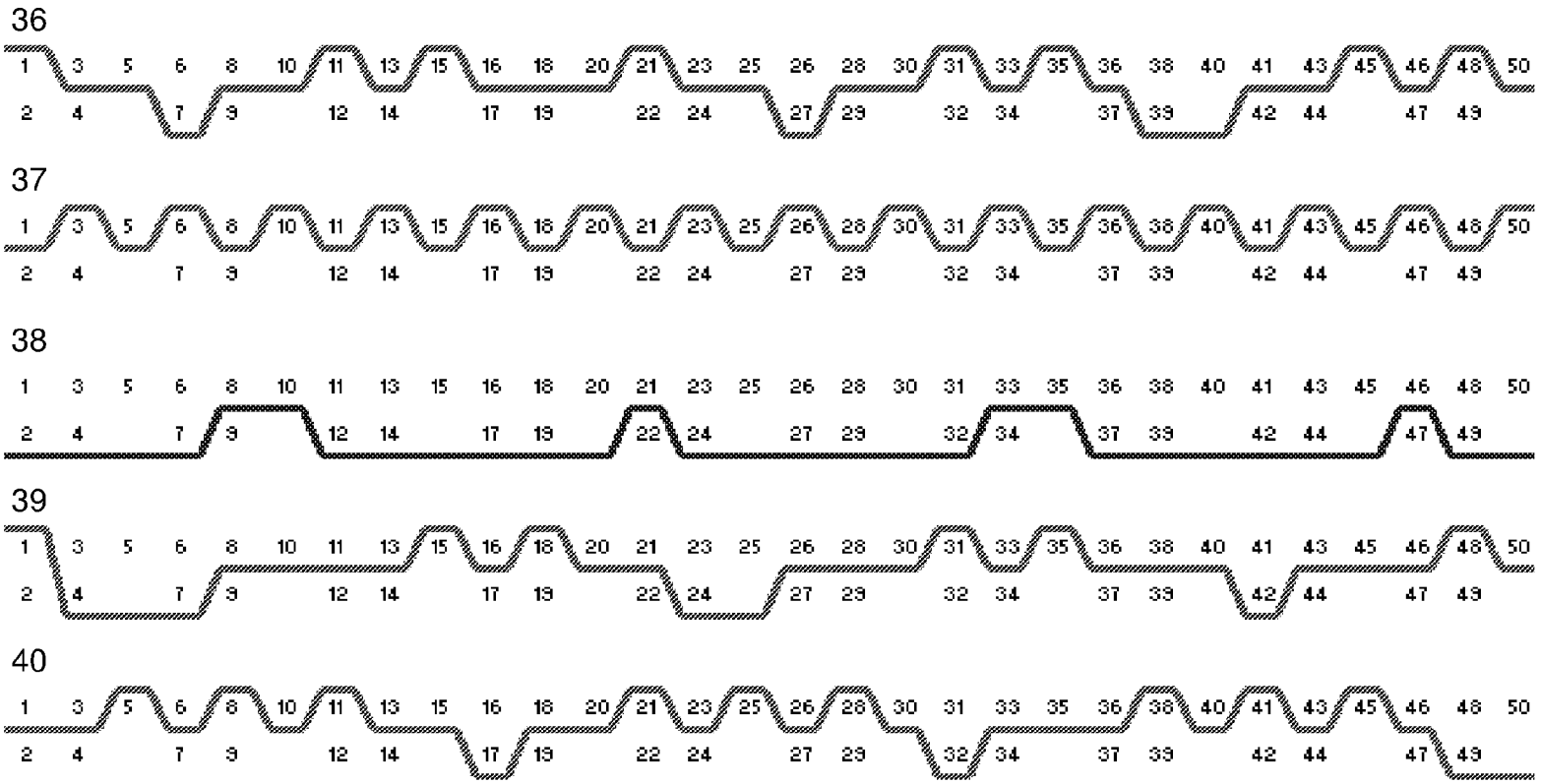
Figure 22A:
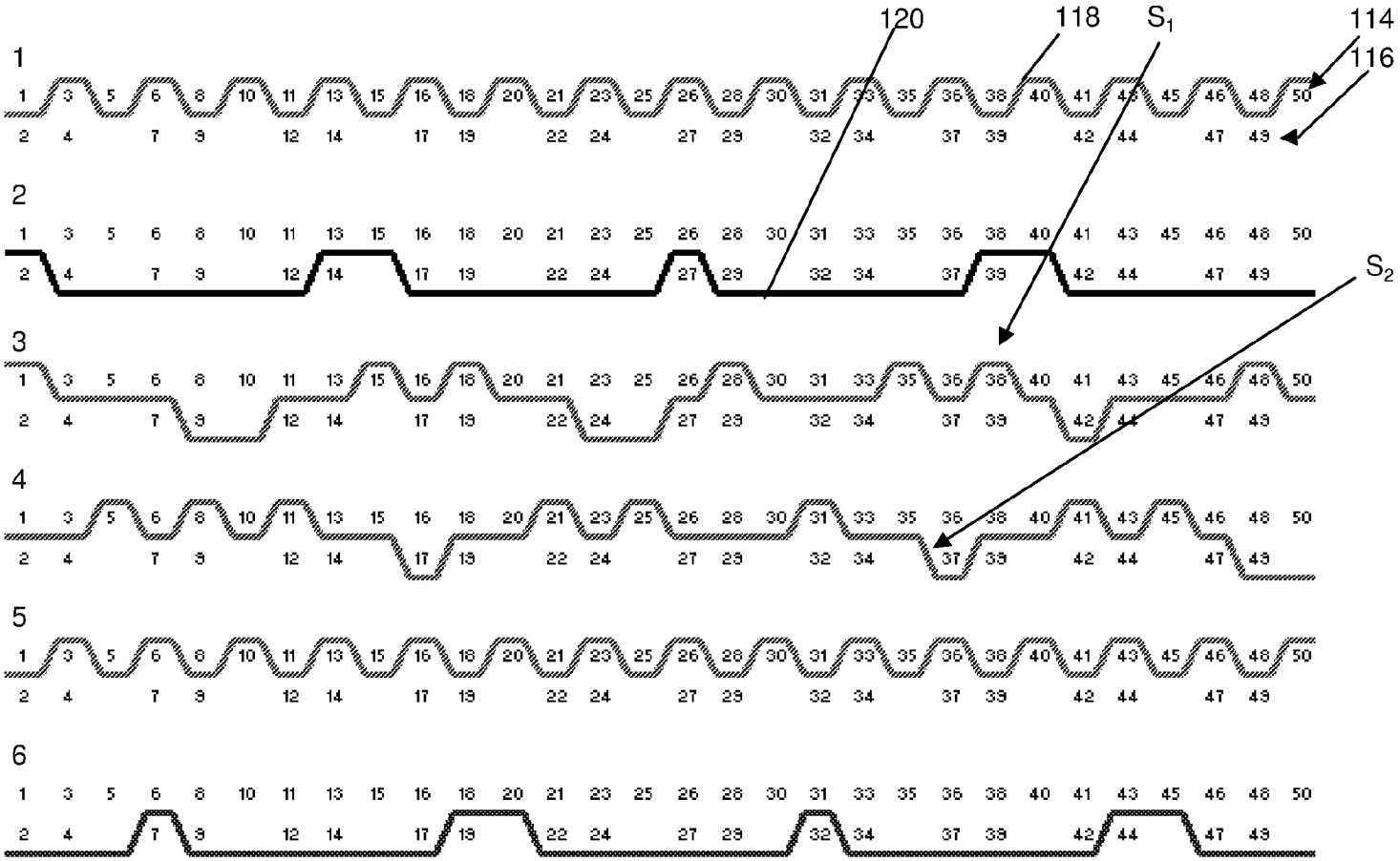
FIGS. 22A-22F and 23 illustrate an alternative design form of that shown according to FIGS. 1A-1D and 2.
Figure 22B:
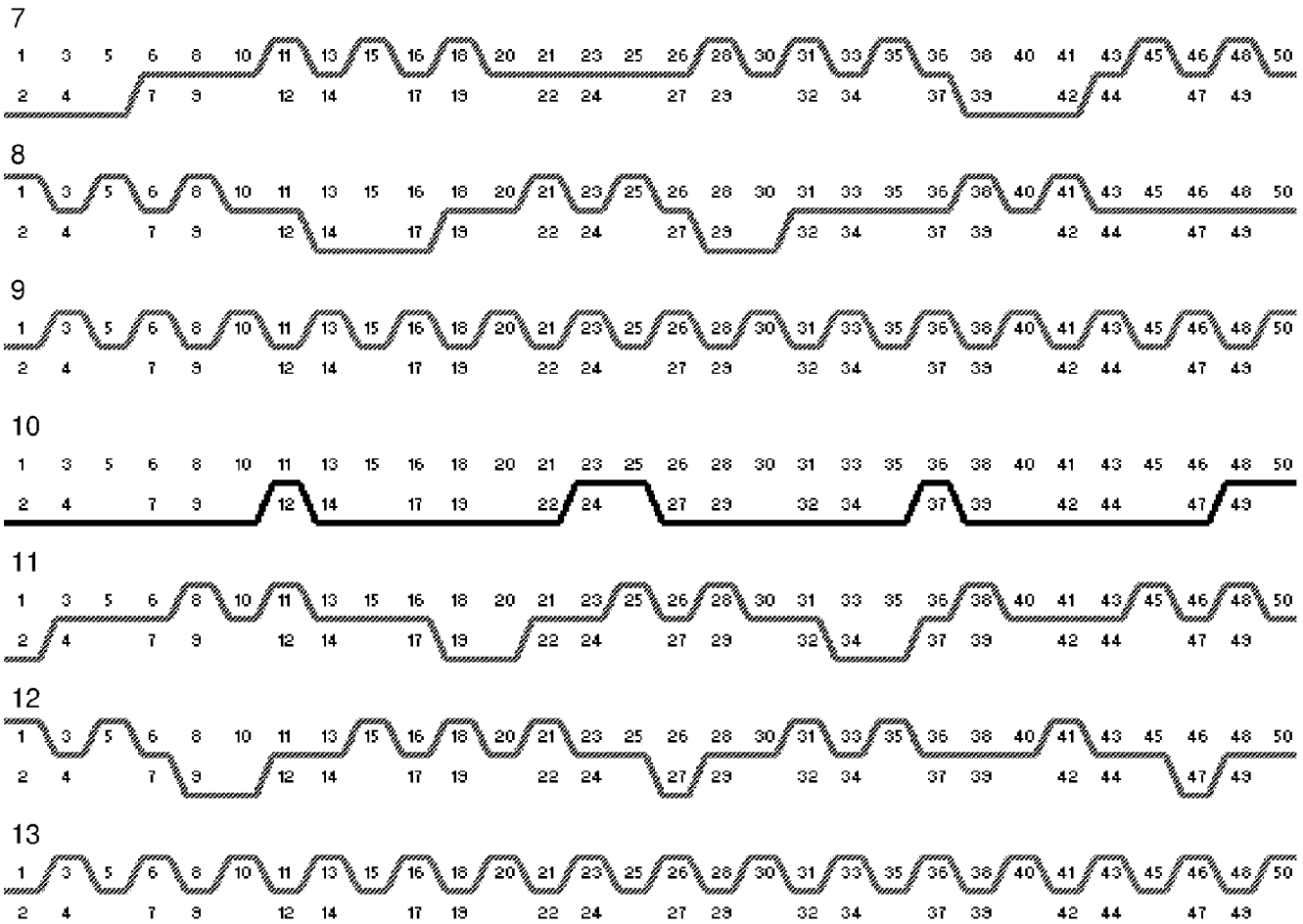
Figure 22C:
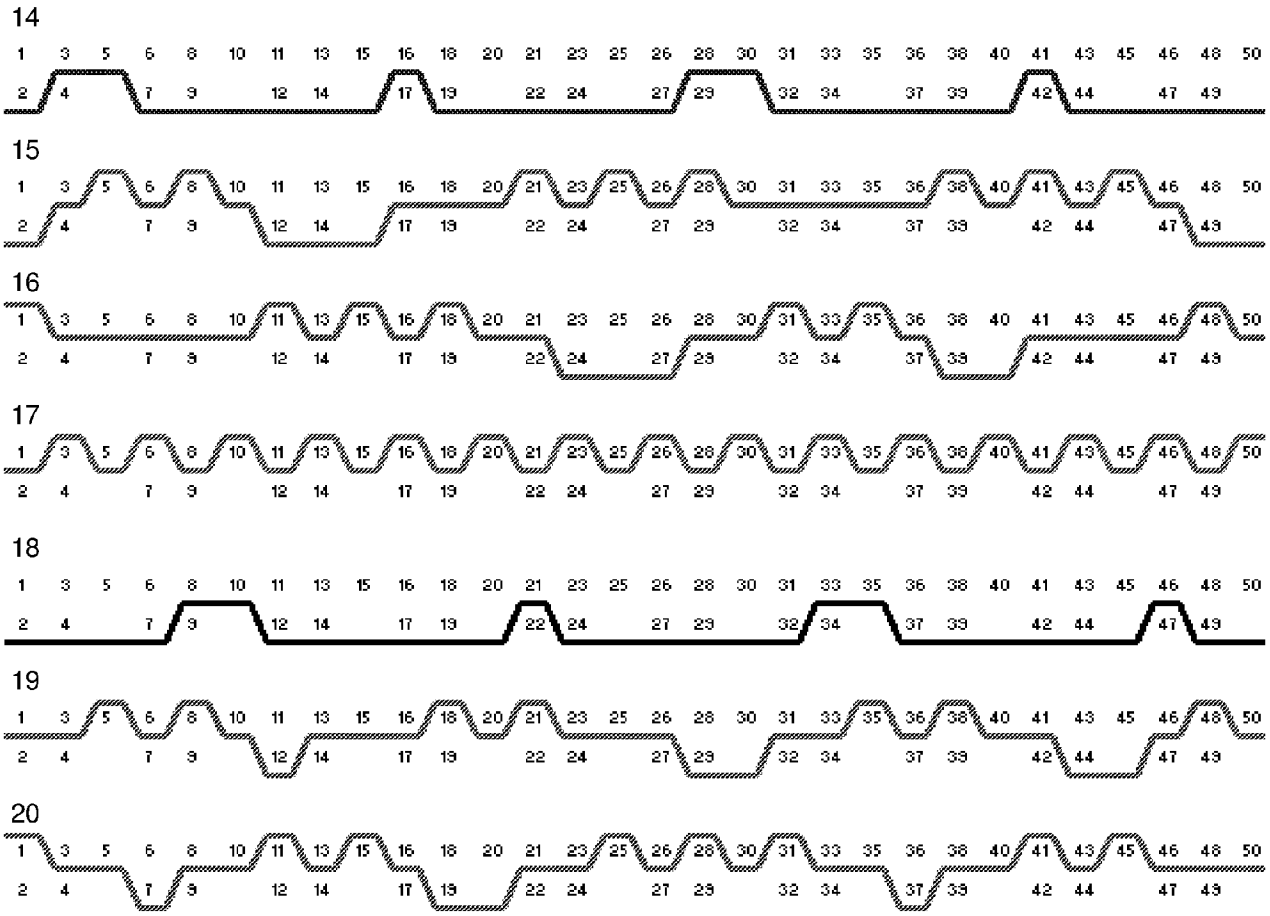
Figure 22D:
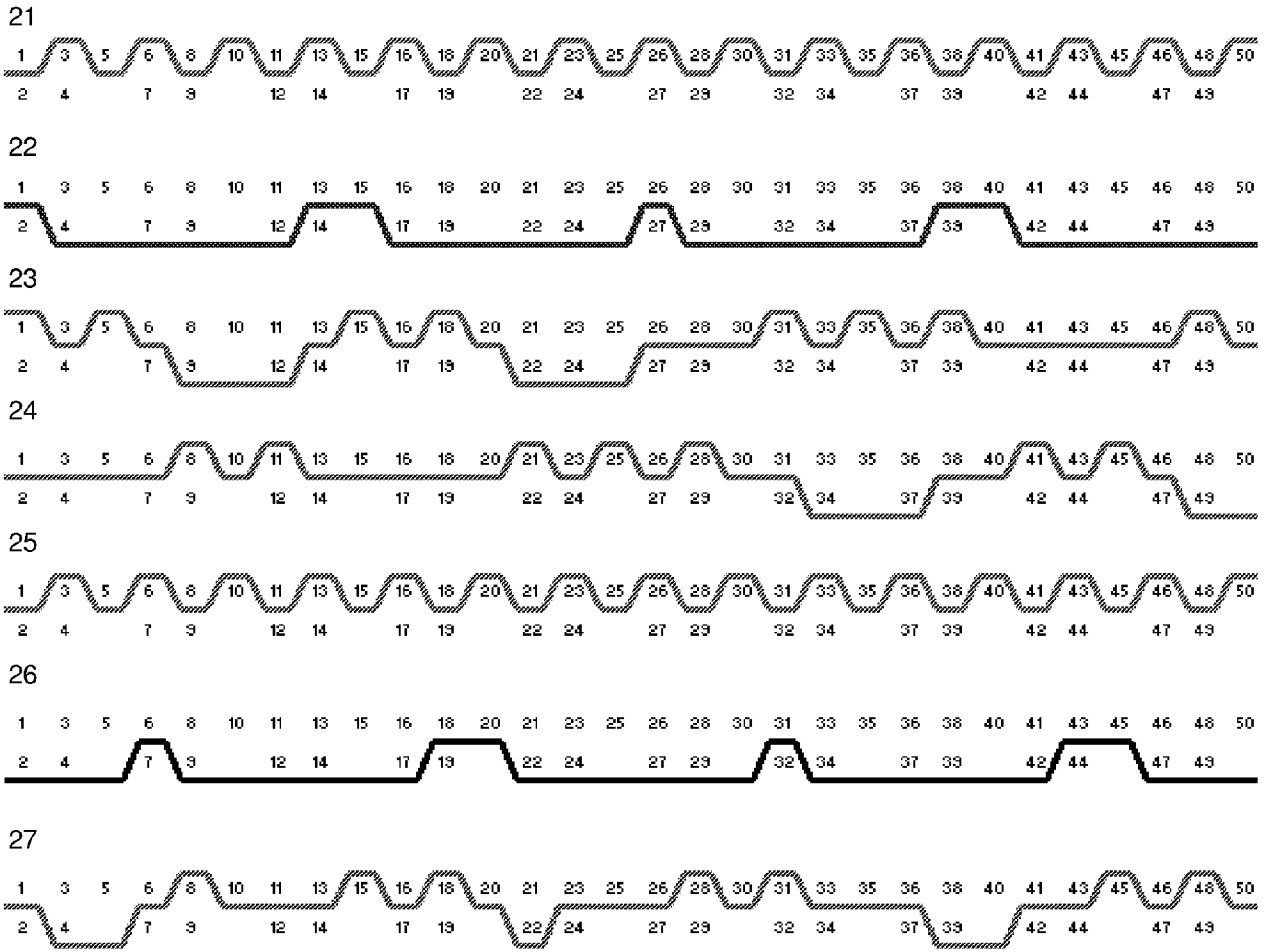
Figure 22E:
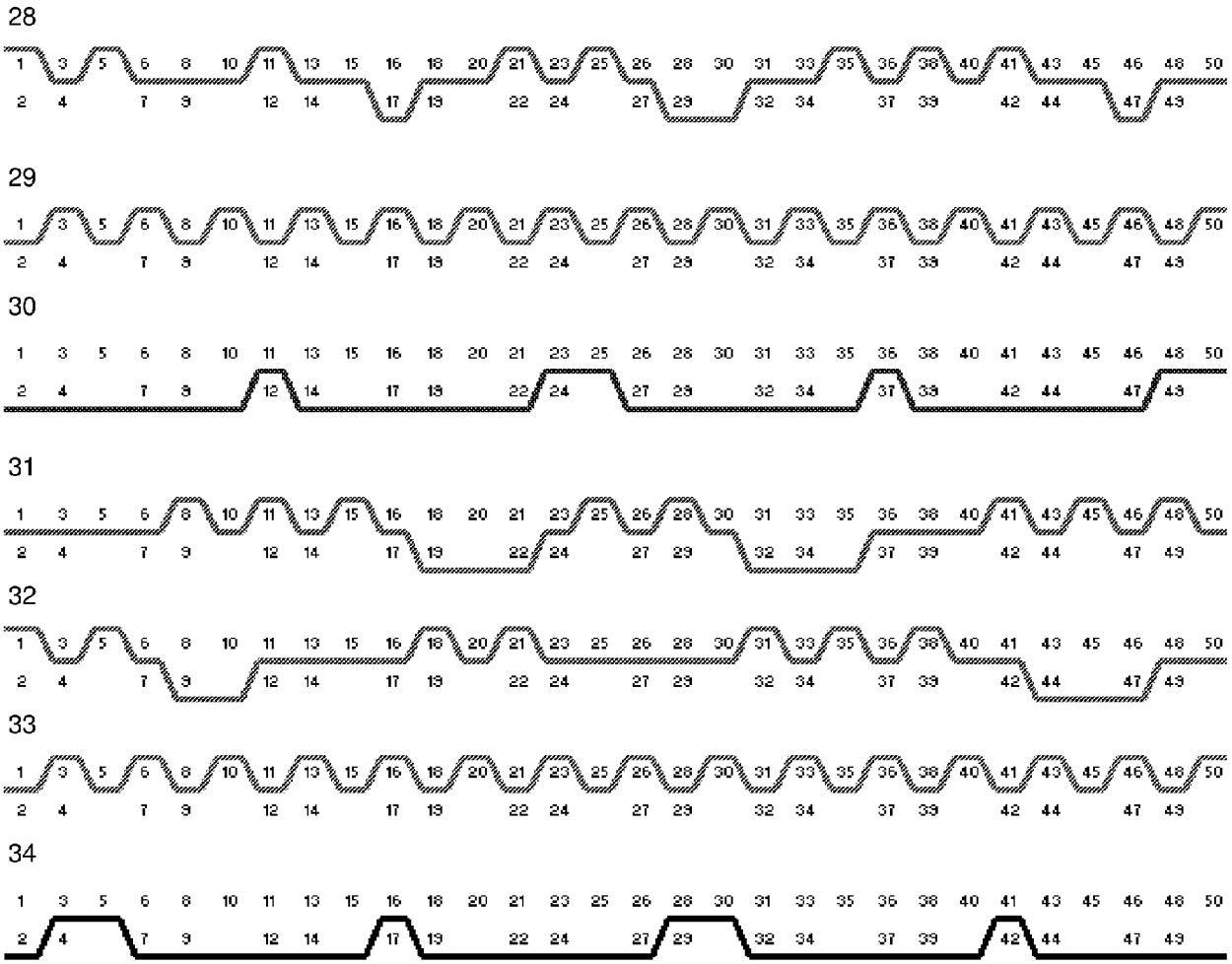
Figure 22F:
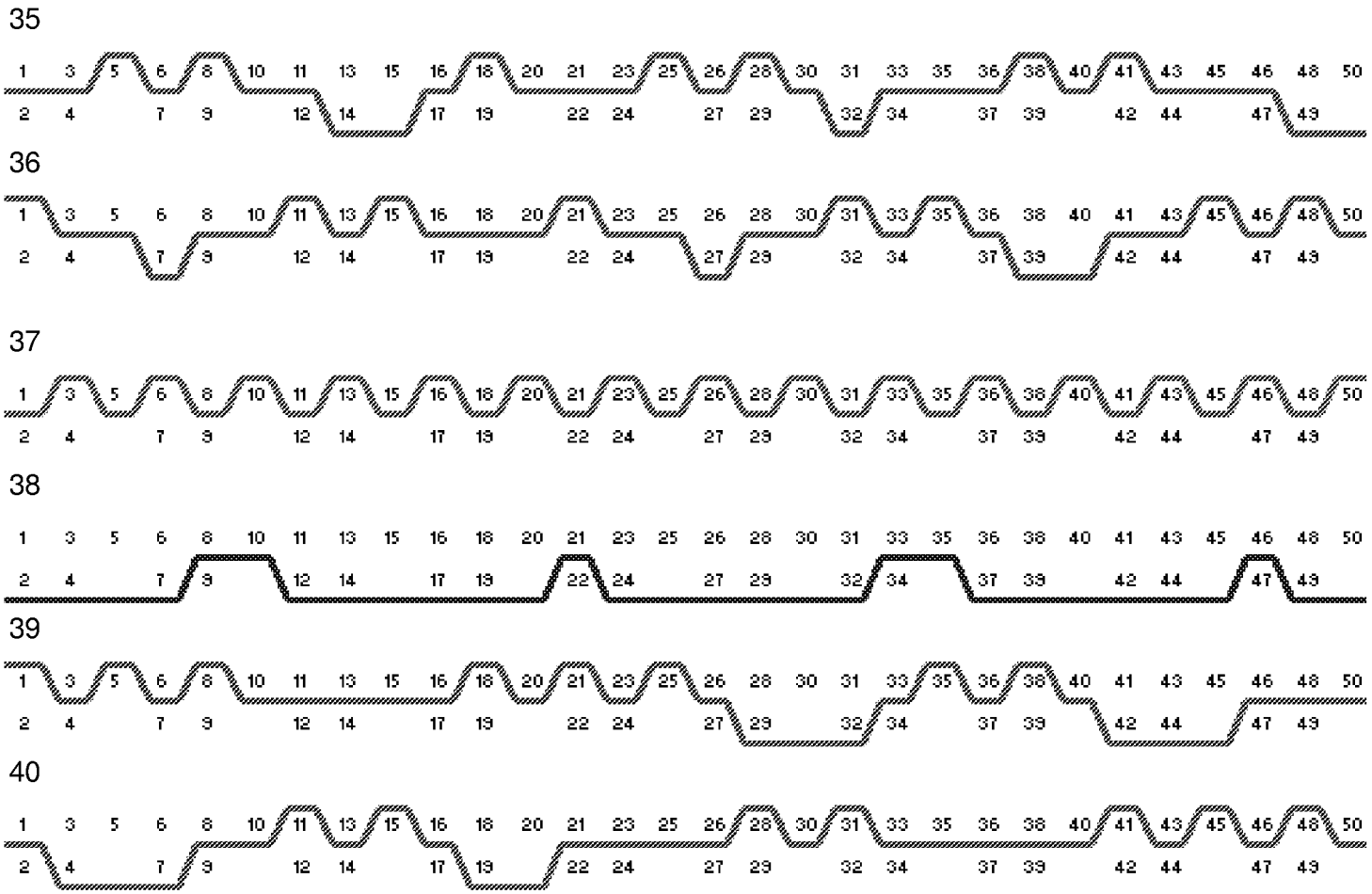

FIG. 15 shows the location of changeover points W, or respectively binding segments $S_1$, in the first fabric layer 114. One recognizes the changeover point diagonals $D_W$ in which a uniform, non-interrupted sequence of changeover points W exists. This is not contrasted by the fact that here, viewed in a longitudinal direction of the binding threads, one thread of the first fabric layer extending transversely to the longitudinal direction of the binding thread—in this instance in warp direction—is present between two changeover points W of one changeover point diagonal $D_W$ of the first type on which, at least in allocation to this changeover point diagonal, no changeover point is formed. This interruption-free sequence of changeover points is broken in the changeover point diagonal $D_W'$ of the second type in that a changeover point offset location V exists always in the binding thread repeat in which the uniform sequence is interrupted. In the allocation to each changeover point offset location V, there exists an offset changeover point $W_V$, which is located offset by two warp threads in the longitudinal direction of the binding threads.

Figure 14:
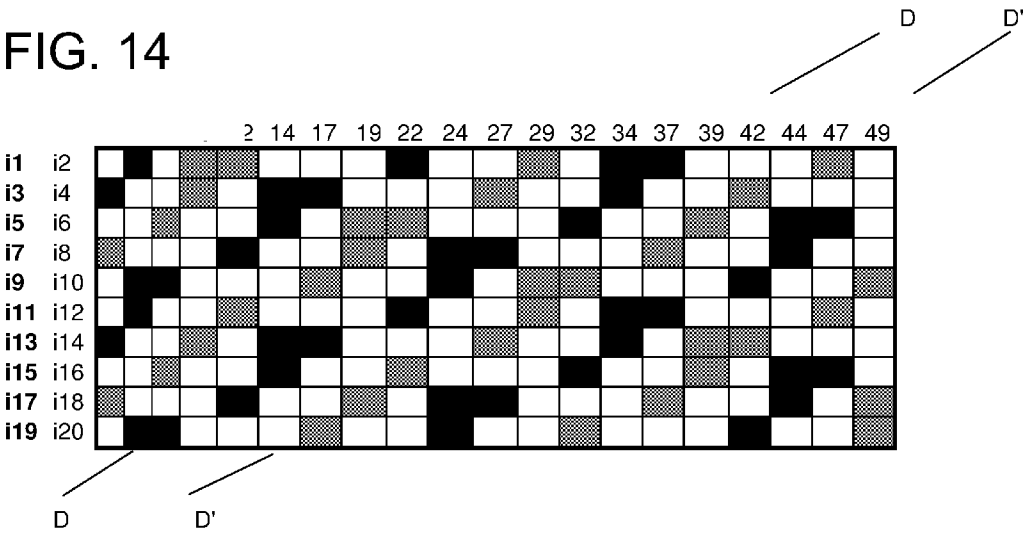
Figure 17:
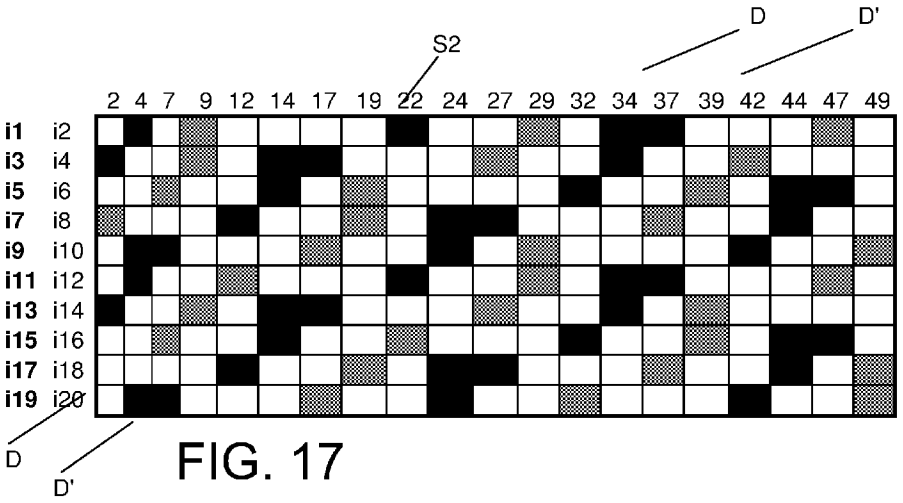
FIGS. 16A-16F and 17 illustrate an alternative design form of that shown according to FIGS. 1A-1D and 2.

A comparison with FIG. 14 shows that in this design variation the changeover point diagonals $D_W$ and $D_W'$ and the binding segment diagonals D or respectively D' are not angled relative to each other, but progress parallel to each other. Since however no changeover points can be located where, in the second fabric layer 116 binding segments and therefore also binding segment diagonals are formed, it is ensured that here the diagonals progressing parallel to each other are arranged not one above the other, but transversely to the longitudinal direction of the diagonal.

With reference to FIG. 13A-13G an additional example with two binding threads i1 and i2 of a changeover point W is illustrated for this design variation. One can see that binding thread i1 changes directly into the second fabric layer 116 before thread 33, beneath thread 34 located there, after it has formed a binding segment $S_1$ on threads 28, 30 and 31, which progresses transversely to the longitudinal binding thread direction. In other words it does not incorporate a segment in which it runs between the two fabric layers 114 and 116 or respectively cross threads located there, as is the case, for example, with the same changeover location W on binding thread i2 which changes its position between the two fabric layers 114 and 116 prior to cross thread 32 and which extends on the one hand between cross threads 31 and 32 and then on the other hand through cross threads 33 and 34, thereby crossing binding thread 11 which is changing directly from first fabric layer 114 into second fabric layer 116.

FIGS. 16A-16F and 17 illustrate a variation of the previously described embodiment whereby binding segments $S_1$, formed in first fabric layer 114 with one type of binding thread pairs and again related to tied around warp threads, follow the following sequence: 2-3-3-2-3-2, whereas with the other type of binding thread pairs the sequence is: 3-2-3-2-3-2. In this case too, basically only four different binding thread progressions with accordingly only two different binding thread pair types are utilized within the illustrated binding thread repeat.

Binding segments $S_2$ created in second fabric layer 116 are arranged along diagonal D or respectively D', whereby within binding segment diagonal D—particularly recognizable by means of diagonal D—a comparatively great uniformity is achieved through a homogenous repeat of the pattern of positioning of the binding segments of the type of the binding segments or respectively the type of binding threads used to form the binding segments.

FIGS. 18A-18G and 19 illustrate an embodiment in which the two binding thread pairs are respectively designed with the sequence of binding segments $S_1$ in the first fabric layer as: 2-3-3-2-3-2 or respectively 3-2-3-2-3-2. Here too, four different binding thread progressions are utilized in order to generate two different binding thread pair types which will then alternate within one binding thread repeat in the warp direction. Binding segments $S_2$ of the second fabric layer are arranged along the binding segment diagonals D and D'.

In regard to the previously discussed FIGS. 16A-16F, 17, 18A-18G and 19 it must be explained that the weave designs illustrated therein, in regard to the location of the changeover points or respectively of the binding segments in the first fabric layer 114, are consistent with the previously discussed design referred to in FIG. 15. Whereas there are always six binding segments $S_1$ in the first fabric layer in the previously described design forms, there is an additional alternating binding thread pair in the first fabric layer 114 having eight binding segments $S_1$ in the design form illustrated in FIG. 20A-20G. The number of binding segments $S_2$ in the second fabric layer 116 which is available on a particular binding thread pair is six in this case. This can also be seen in FIG. 21, where six such binding segments $S_2$ can be recognized as being allocated to each binding thread pair. The binding thread pairs of different types distinguish themselves in that for the one type—for example in binding thread pair i1 and i2—only binding segments $S_2$ are formed, which encompass one single warp thread, whereas with the binding thread pair of the other type—for example binding threads i3 and i4—a binding segment $S_2$ is always formed whereby the associated binding thread floats over two warp threads.

Based on this greater number and the different types of binding segments, an alignment of the binding segments along binding segment diagonals occurs again, whereby here a greater number of diagonals D, D' D" and D'" occurs in one binding thread repeat. It can be seen that the binding segments of different diagonals may for example contact each other continuously in the warp direction, in other words can be arranged in the warp direction adjacent to each other. A great uniformity exists in the sequence of the binding segments arranged in the individual diagonals. In particular it can also be seen that in binding segment diagonal D'" which includes binding segments of different types, an alternating sequence of a binding segment, which includes two warp threads is present, followed by a separation from one warp thread.

The design variation illustrated in FIGS. 22A-22F and 23 also includes eight binding segment pairs $S_1$ respectively at every second binding thread pair in first fabric layer 114. Here too, there are basically two types of binding thread pairs, hence a total of four different binding thread progressions, whereby at each second binding thread pair one binding thread floats comparatively long between two binding segments $S_1$ provided by same, namely over five warp threads in the first fabric layer 114, between the two fabric layers 114 and 116. This can be seen, for example, on binding thread pair i3 and i4 where binding thread i3 floats over warp threads 20, 21, 23, 25 and 26 of first fabric layer 114. In second fabric layer 116 six binding segments $S_2$ are always created at each binding thread pair which either tie off over one warp thread or over two warp threads.

Figure 23:
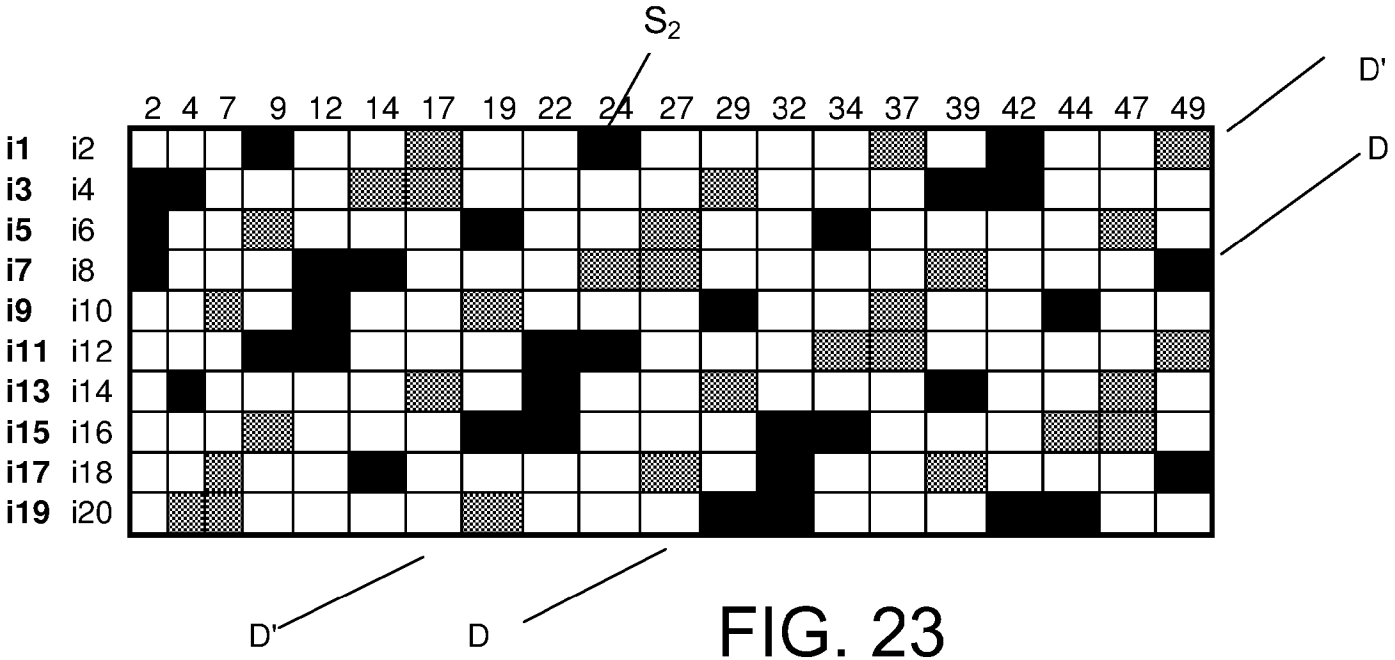

FIG. 23 shows that here too the binding segments $S_2$ of the second fabric layer are arranged along binding segment diagonals D and D'.

Figure 24:
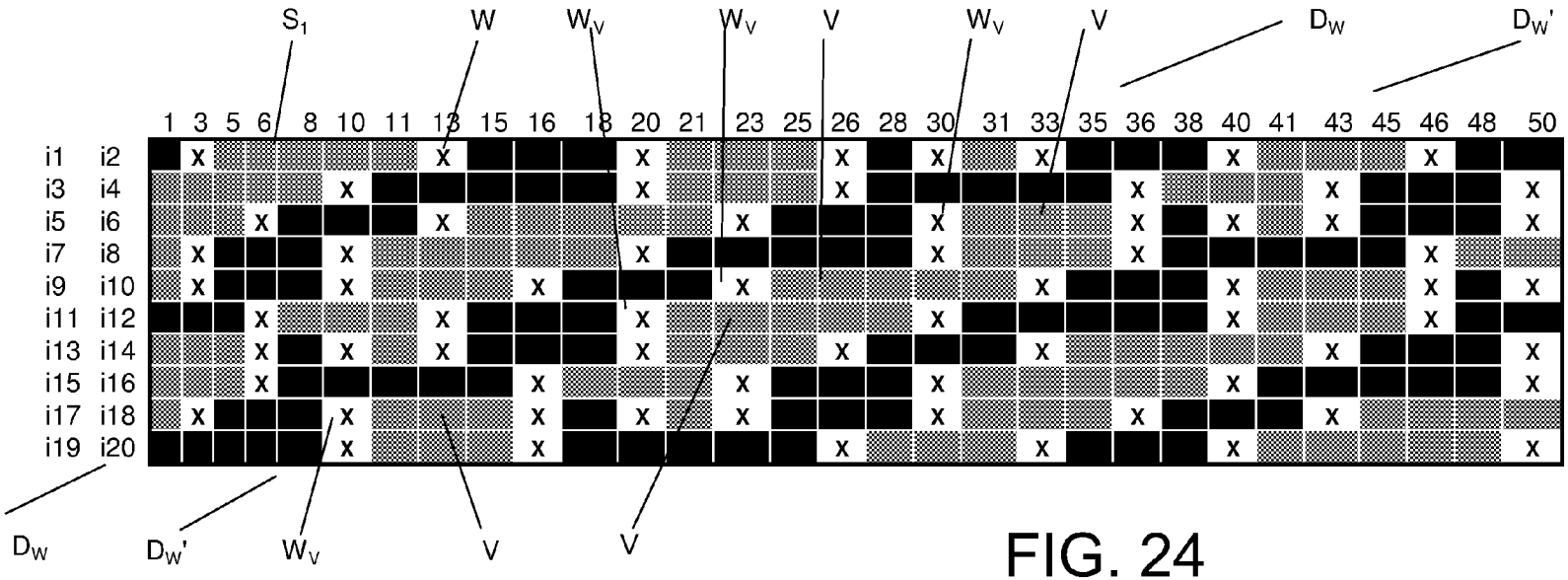
FIG. 24 illustrates the arrangement of binding segments in a paper side fabric layer and the changeover points created between such binding segments for the binding pattern illustrated in FIGS. 22A-22F and 23.

FIG. 22A-22F together with FIGS. 23 and 24 shows the configuration of changeover points W or respectively of changeover point diagonals $D_W$ and $D_W$'. In this arrangement too, the changeover diagonals $D_W$ and $D_W$' extend parallel to binding segment diagonals D and D'. The changeover point diagonals $D_W$ of the first type respectively again include an arrangement of changeover points W, provided without interruption of the uniformity, and which are positioned in a longitudinal binding thread direction, respectively separated by a thread—in this case a warp thread—extending transversely to the longitudinal binding thread direction. In the changeover point diagonals $D_W$' of the second type, allocated to each such diagonal are four changeover point offset locations V respectively, or four offset changeover locations $W_V$. Here too, the offset changeover points $W_V$ may be regarded as an independent changeover point diagonal of the second type, whereby the uniformity prevailing in the changeover points $D_W$ of the first type is interrupted by the absence of changeover points.

Different design variations were described previously wherein a very high uniformity is provided in the first, machine side fabric layer 114 through the provision of a plain weave, which is also continued through the binding threads or respectively binding thread pairs integrated into first fabric layer 114, whereas in the second fabric layer, basically also through arrangement of the therein created binding segments $S_2$, along the binding segment diagonals, a certain uniformity is ensured. With reference to FIGS. 25 through 28 other types of weaves are illustrated below, respectively on the basis of two basic weave weft threads 118, 120 for the two fabric layers 114, 116 or respectively on the basis of two binding threads i1, i2 for first fabric layer 114.

Figure 25:
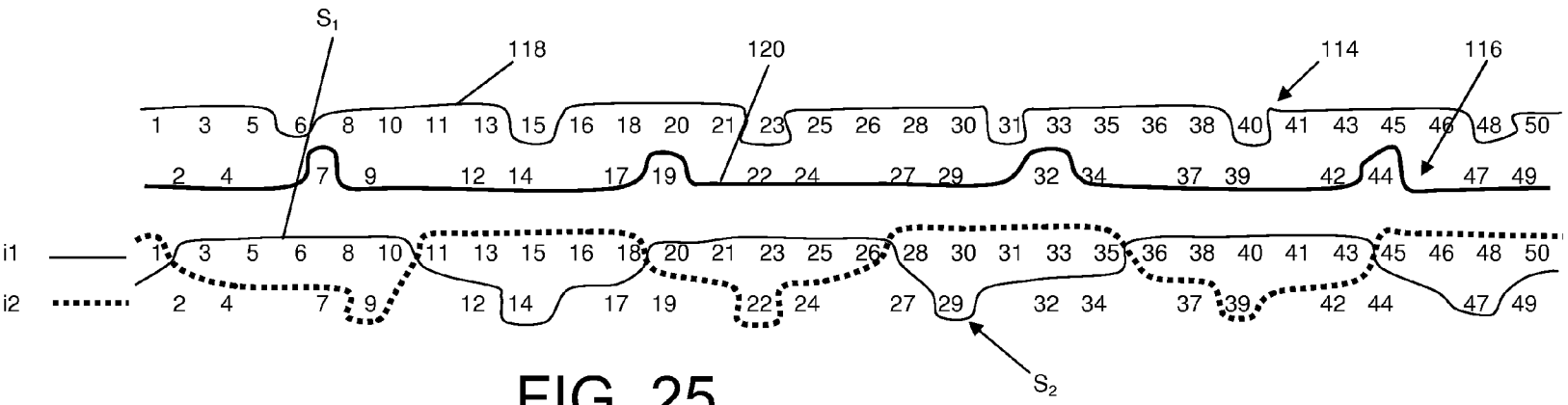
FIG. 25 illustrates a binding thread pair and an allocated pair of basic weave threads for an alternative basic weave pattern.

In FIG. 25 one recognizes that in this example basic weave weft threads 118 of first fabric layer 114 always float over the outside of four warp threads of first fabric layer 114 and then bind underneath one warp thread. This provides for a 1-4 weave in the first fabric layer. Accordingly, the binding segments $S_1$ of first fabric layer 114 formed by the binding thread pairs, can respectively extend over a greater number of warp threads—in the illustrated example five warp threads. Binding segments $S_1$, located immediately adjacent to each other in the weft direction and which are formed respectively by the different binding threads of a respective binding thread pair, always follow each other immediately. In other words, they are not separated by a warp thread.

Figure 26:
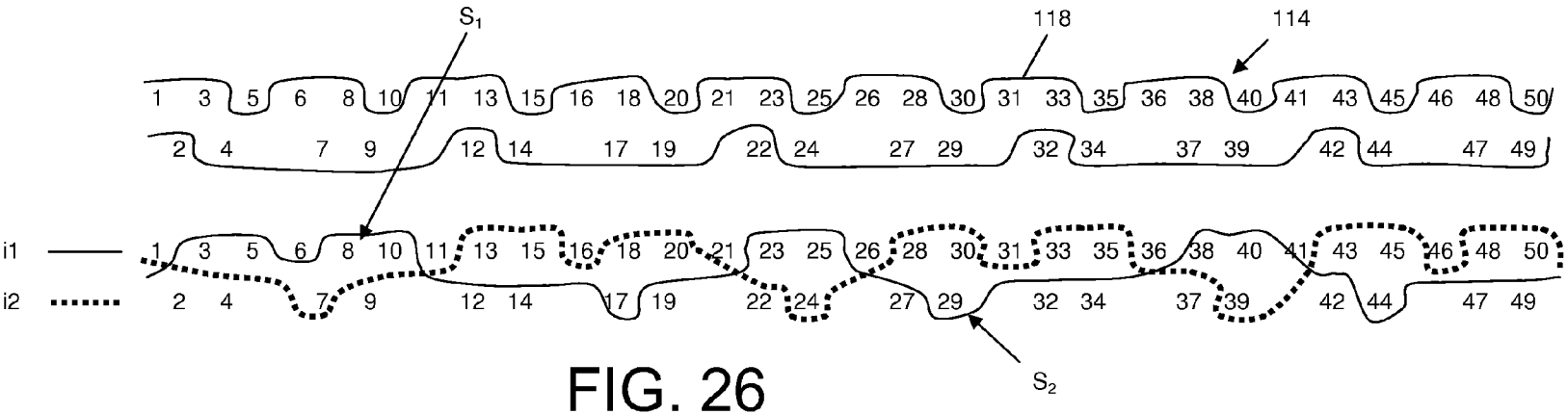
FIG. 26 illustrates a binding thread pair and an allocated pair of basic weave threads for an alternative basic weave pattern.

In the design form illustrated in FIG. 26 the flotations of basic weave weft threads 118 of first fabric layer 114 extend respectively over two warp threads, thus providing a 1-2 weave. A correlative pattern is also created by the binding threads of the various binding thread pairs. Here, binding segments $S_1$ of first fabric layer 114 extend over a total of five warp threads, whereby flotation occurs over the first and second, or respectively the fourth and fifth warp thread, while the binding thread progresses underneath the center thread of these five warp threads, in other words on its inside. Thus each binding segment $S_1$—also due to the fact that binding segments $S_1$ located successively in the weft direction are always separated by a warp thread—continues with the weave of the first fabric layer.

Figure 27:
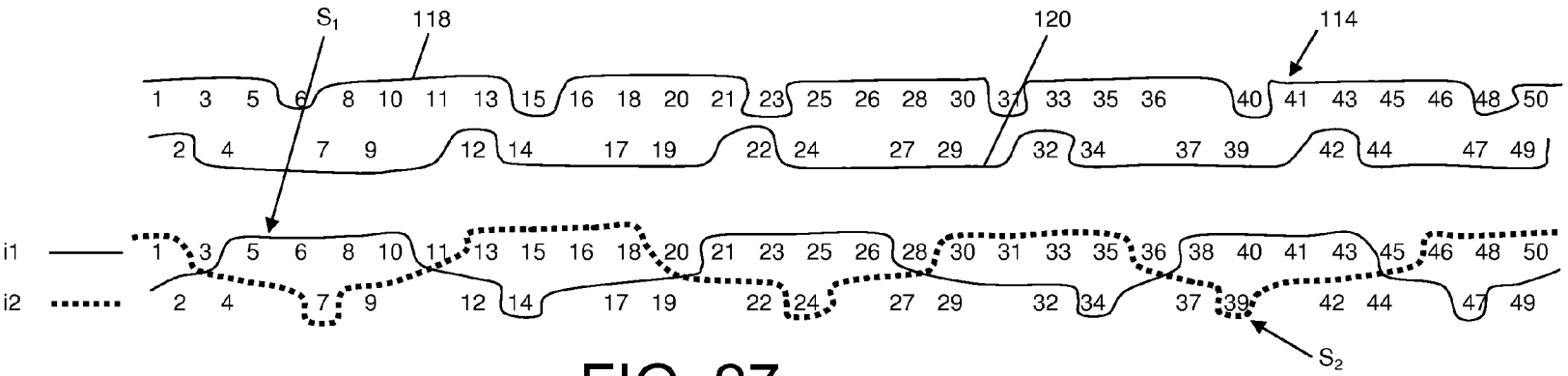
FIG. 27 illustrates a binding thread pair and an allocated pair of basic weave threads for an alternative basic weave pattern.

As shown in FIG. 25, FIG. 27 also illustrates a 1-4 weave in the first fabric layer, whereby basic weave weft threads 118 of first fabric layer 114 float on the outside of four warp threads and then run underneath one respective fifth warp thread. Here, binding segments $S_1$ formed in first fabric layer 114 are configured such that they extend respectively over four warp threads that, in other words a flotation over four warp threads is provided, whereas successive binding segments $S_1$ are then separated by a warp thread. Also in this example, the binding threads of a respective binding thread pair continue on with the exact weave of the basic weave weft threads 118 of the first fabric layer.

Figure 28:
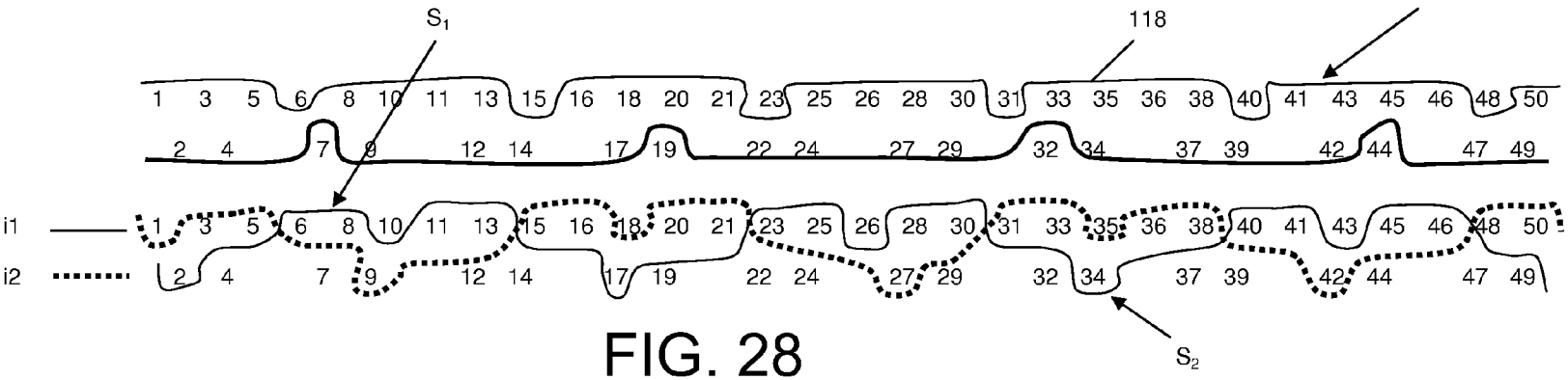
FIG. 28 illustrates a binding thread pair and an allocated pair of basic weave threads for an alternative basic weave pattern.

FIG. 28 combines a 1-4 weave in first fabric layer 114 with the basic weave weft threads 118 contained therein with a corresponding weave of the binding thread pairs. Binding segments $S_1$ of first fabric layer 114 includes five warp threads, whereby the respectively involved binding threads float on the outside of two warp threads, then progress underneath one warp thread, and then float again on the outside of two warp threads before a changeover occurs to a binding segment, which is always formed by the other binding thread of the same binding thread pair. Since binding segments $S_1$ are again located immediately adjacent to each other—in other words are not separated by a weft thread—a weave pattern results in which there is always a flotation over four warp threads, whereby however this flotation is formed by segments of two different binding threads.

In all design examples illustrated in FIGS. 25 through 28, all binding segments $S_2$ in second fabric layer 116 are formed always with one single warp thread. In a particular binding thread repeat, especially in this case viewed in the weft direction, the number of binding segments $S_1$ is consistent with the number of binding segments $S_2$. It can be further seen in FIGS. 25 through 28 that for the machine side, in other words for the second fabric layer 116, a basic weave is preferably selected wherein the involved basic weave weft threads 120 feature comparatively long flotations on the outside, so that in interaction with the various guide- and drive rolls a comparatively flat surface forms.

The inventive design with the arrangement of binding segments contained in the machine side fabric layer along respective binding segment diagonals can naturally also be used if the binding threads are configured to extend in the warp direction. Moreover it is possible to provide binding threads extending in the warp direction as well as in the weft direction, whereby then the aforementioned positioning for the binding threads extending in warp direction, as well as in weft direction of respective binding segments can be realized, or respectively be overlapped. Moreover it must be pointed out that on a fabric belt for a machine to produce web material the binding threads—regardless of whether they are in the embodiment of weft threads or warp threads—can be configured to extend in the machine direction, in other words the belt travel direction, or in a cross machine direction, in other words transverse to the belt travel direction.

Moreover it is provided that, although the preceding explanations describe exclusively design examples having two fabric layers, the invention may also find application in fabric belts having more than two fabric layers, for example three fabric layers. Thus, a third fabric layer may be disposed between the first fabric layer, providing the surface to support the completed web material, and the second fabric layer, providing the back side for contact with the various drive- or guide-rolls. The binding threads providing cohesion of the different fabric layers may extend through all these fabric layers, in other words may again form binding segments in the first fabric layer, as well as in the second fabric layer and then also in the third fabric layer. Basically however, the binding threads previously discussed in detail which form the binding segments in the second fabric layer can connect the second fabric layer directly with the third fabric layer. Additional binding threads or binding thread pairs may be provided which realize connection of the first fabric layer into the third fabric layer.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A fabric belt for a machine for producing a web material, in particular paper or cardboard, the fabric belt comprising:

a first fabric layer (114) on a web material side of the fabric belt;

a second fabric layer (116) on a machine side of the fabric belt, the first fabric layer (114) and the second fabric layer (116) each having a basic weave connected to each other by binding threads (i1-i20) extending in a binding thread direction, the first fabric layer (114) and the second fabric layer (116) having base binding threads (1-50, 118, 120) extending in the binding thread direction and transversely to the binding thread direction, wherein the binding threads (i1-i20) form binding segments ($S_2$) which are successive in the binding thread direction in the second fabric layer (116) and in which the binding threads (i1-i20) are tied off on at least one base binding thread of the second fabric layer (116) extending transversely to the binding thread direction, wherein the binding segments ($S_2$) formed in the second layer (116) are arranged in a binding pattern repeat extended in the binding thread direction and transverse to the binding thread direction along at least one binding segment diagonal (D) progressing obliquely to the binding thread direction and transverse to the binding thread direction;

wherein the binding threads (i1-i20) in the first fabric layer (114) form successive binding segments (S1) in the binding thread direction in which the binding threads (i1-i20) are tied off on at least one basic weave thread (1, 3, . . . , 48, 50) of the first fabric layer (114) extending transversely to the binding thread direction;

wherein a number ratio of the binding segments (S1) in the first fabric layer (114) relative to the binding segments (S2) in the second fabric layer (116) is greater than 1; and wherein a number ratio of the basic weave threads (1, 3, . . . , 48, 50) of the first fabric layer (114) extending transversely to the binding thread direction and the basic weave threads (2, 4, . . . , 47, 49) of the second fabric layer (116) is greater than 1.

2. The fabric belt of claim 1, wherein the binding threads (i1-i20) have adjacently located threads that together form at least one binding thread pair.

3. The fabric belt of claim 2, wherein the binding threads (i1-i20) of at least one of the binding thread pairs are located immediately adjacent next to each other.

4. The fabric belt of claim 1, wherein in the first fabric layer (114) the binding segments ($S_1$) of at least one of the binding threads (i1-i20) of the at least one binding thread pair and the binding segments ($S_1$) of the other binding thread (i1-i20) of the same binding thread pair follow consecutively alternating in the binding thread direction.

5. The fabric belt of claim 4, wherein the binding threads (i1-i20) of at least one of the binding thread pairs cross each other at changeover points (W) and that one of the binding threads (i1-i20) in order to form the binding segment ($S_1$) in the first fabric layer (114) crosses into same and that the changeover points (W) are arranged along a plurality of changeover point diagonals ($D_W$, $D_W'$).

6. The fabric belt of claim 5, wherein the changeover diagonals ($D_W$, $D_W'$) extend parallel to the at least one binding segment diagonal (D).

7. The fabric belt of claim 5, wherein the changeover point diagonals ($D_W$ and $D_W'$) extend angled relative to the at least one binding segment diagonal (D).

8. The fabric belt of claim 7, wherein the changeover point diagonals ($D_W$ and $D_W'$) include at least one changeover point diagonal ($D_W$) of a first kind with uninterrupted stringing together of the changeover points (W) and at least one changeover point diagonal ($D_W'$) of a second kind with interrupted stringing together of the changeover points (W) due to changeover point offsets (V).

9. The fabric belt of claim 8, wherein the changeover point diagonals ($D_W$) of the first type and the changeover point diagonals ($D_W'$) of the second type alternate with a uniform pattern.

10. The fabric belt of claim 9, wherein the changeover point offset locations (V) are arranged in a uniform pattern.

11. The fabric belt of claim 1, wherein in at least one binding segment diagonal (D) essentially all consecutive binding segments ($S_2$) are at least one of binding segments ($S_2$) of a same type and are formed by binding threads of the same type.

12. The fabric belt of claim 1, wherein in the at least one binding segment diagonal (D) the binding segments ($S_2$) that follow each other are at least one of a different type and have binding segments formed by binding threads of a different type.

13. The fabric belt of claim 12, wherein in at least one binding segment diagonal (D) the binding segments ($S_2$) of the different type and/or the binding segments formed by the binding threads of the different type alternate with each other in a uniform pattern.

14. The fabric belt of claim 11, wherein in one binding thread repeat several binding segment diagonals (D, D', D", D'") are provided with varying distribution relative to each other and/or a different type of binding segments ($S_2$) and/or binding segments formed by threads of a different type.

15. The fabric belt of claim 2, wherein the at least one binding thread pair is a plurality of binding thread pairs, with one binding thread repeat the number of the binding thread pairs with a different progression relative to each other of the binding threads (i1-i20) forming the binding thread pairs is smaller than a number of the binding thread pairs present in one binding thread repeat.

16. The fabric belt of claim 2, wherein the at least one binding thread pair is a plurality of binding thread pairs, the binding threads (i1-i20) of at least one of the binding thread pairs in the first fabric layer (114) form an apparent basic weave thread of the first fabric layer (114) thereby continuing the weave of the first fabric layer (114).

17. The fabric belt of claim 1, wherein a repeat length of the binding threads (i1-i20) in the binding thread direction is greater than a repeat length of the basic weave of the first fabric layer (114) and/or the second fabric layer (116) in the binding thread direction.

18. A machine for producing a web material, in particular paper or cardboard, comprising a fabric belt having a first fabric layer (114) on a web material side of the fabric belt; and a second fabric layer (116) on a machine side of the fabric belt, the first fabric layer (114) and the second fabric layer (116) each having a basic weave connected to each other by binding threads (i1-i20) extending in a binding thread direction, the first fabric layer (114) and the second fabric layer (116) having base binding threads (1-50, 118, 120) extending in the binding thread direction and transversely to the binding thread direction, wherein the binding threads (i1-i20) form binding segments ($S_2$) which are successive in the binding thread direction in the second fabric layer (116) and in which the binding threads (i1-i20) are tied off on at least one base binding thread of the second fabric layer (116) extending transversely to the binding thread direction, wherein the binding segments ($S_2$) formed in the second layer (116) are arranged in a binding pattern repeat extended in the binding thread direction and transverse to the binding thread direction along at least one binding segment diagonal (D) progressing obliquely to the binding thread direction and transverse to the binding thread direction;

wherein the binding threads (i1-i20) in the first fabric layer (114) form successive binding segments (S1) in the binding thread direction in which the binding threads (i1-i20) are tied off on at least one basic weave thread (1, 3, . . . , 48, 50) of the first fabric layer (114) extending transversely to the binding thread direction;

wherein a number ratio of the binding segments (S1) in the first fabric layer (114) relative to the binding segments (S2) in the second fabric layer (116) is greater than 1; and wherein a number ratio of the basic weave threads (1, 3, . . . , 48, 50) of the first fabric layer (114) extending transversely to the binding thread direction and the basic weave threads (2, 4, . . . , 47, 49) of the second fabric layer (116) is greater than 1.

19. A fabric belt for a machine for producing a web material, in particular paper or cardboard, the fabric belt comprising:

a first fabric layer (114) on a web material side of the fabric belt;

a second fabric layer (116) on a machine side of the fabric belt, the first fabric layer (114) and the second fabric layer (116) each having a basic weave connected to each other by binding threads (i1-i20) extending in a binding thread direction, the first fabric layer (114) and the second fabric layer (116) having base binding threads (1-50, 118, 120) extending in the binding thread direction and transversely to the binding thread direction, wherein the binding threads (i1-i20) form binding segments ($S_2$) which are successive in the binding thread direction in the second fabric layer (116) and in which the binding threads (i1-i20) are tied off on at least one base binding thread of the second fabric layer (116) extending transversely to the binding thread direction, wherein the binding segments ($S_2$) formed in the second layer (116) are arranged in a binding pattern repeat extended in the binding thread direction and transverse to the binding thread direction along at least one binding segment diagonal (D) progressing obliquely to the binding thread direction and transverse to the binding thread direction;

wherein the binding threads (i1-i20) have adjacently located threads that together form at least one binding thread pair; and wherein that between the binding threads (i1-i20) of at least one of the binding thread pairs at least one basic weave thread (120) of the second fabric layer (116) extending in the binding thread direction and/or at least one basic weave thread of the first fabric layer extending in the binding thread direction is arranged.

* * * * *